US008294538B2

(12) United States Patent
Ueda

(10) Patent No.: US 8,294,538 B2
(45) Date of Patent: Oct. 23, 2012

(54) TRANSMISSION LINE MICROWAVE APPARATUS INCLUDING AT LEAST ONE NON-RECIPROCAL TRANSMISSION LINE PART BETWEEN TWO PARTS

(75) Inventor: Tetsuya Ueda, Kyoto (JP)

(73) Assignee: National University Corporation Kyoto Institute of Technology, Kyoto (JP)

( * ) Notice: Subject to any disclaimer, the term of this patent is extended or adjusted under 35 U.S.C. 154(b) by 561 days.

(21) Appl. No.: 12/530,102

(22) PCT Filed: Mar. 5, 2008

(86) PCT No.: PCT/JP2008/053964

§ 371 (c)(1),
(2), (4) Date: Sep. 4, 2009

(87) PCT Pub. No.: WO2008/111460

PCT Pub. Date: Sep. 18, 2008

(65) Prior Publication Data

US 2010/0060388 A1 Mar. 11, 2010

(30) Foreign Application Priority Data

Mar. 5, 2007 (JP) ..... 2007-054445

(51) Int. Cl.
*H01P 3/08* (2006.01)

(52) U.S. Cl. ..... 333/236; 333/245

(58) Field of Classification Search ..... 333/236–238, 333/245, 246
See application file for complete search history.

(56) References Cited

U.S. PATENT DOCUMENTS

| | | | | |
|---|---|---|---|---|
| 6,958,729 | B1 * | 10/2005 | Metz | 343/700 MS |
| 2005/0190101 | A1 | 9/2005 | Hiramatsu et al. | |
| 2010/0110943 | A2 * | 5/2010 | Gummalla et al. | 370/281 |
| 2011/0026624 | A1 * | 2/2011 | Gummalla et al. | 375/260 |

FOREIGN PATENT DOCUMENTS

| | | |
|---|---|---|
| JP | 5-183329 | 7/1993 |
| JP | 2005-124038 | 5/2005 |

(Continued)

OTHER PUBLICATIONS

International Search Report issued Jun. 10, 2008 in International (PCT) Application No. PCT/JP2008/053964.

(Continued)

*Primary Examiner* — Robert Pascal
*Assistant Examiner* — Kimberly Glenn
(74) *Attorney, Agent, or Firm* — Wenderoth, Lind & Ponack, L.L.P.

(57) ABSTRACT

A transmission line microwave apparatus includes at least one nonreciprocal transmission line part, which includes a series branch circuit equivalently including a capacitive element and a shunt branch circuit equivalently including an inductive element. The nonreciprocal transmission line part has gyrotropic characteristic by being magnetized in a magnetization direction different from the propagation direction of a microwave, and has an asymmetric structure to a plane formed by the propagation direction and the magnetization direction. The nonreciprocal transmission line part has a propagation constant and an operating frequency set in a dispersion curve that represents a relation between the propagation constant and the operating frequency so that the propagation constant in the forward direction and the propagation constant in the backward direction have nonreciprocal phase characteristics different from each other. A microwave transmission line is constituted by cascade-connecting at least one non-reciprocal transmission line part between first and second ports.

15 Claims, 32 Drawing Sheets

FOREIGN PATENT DOCUMENTS

| | | |
|---|---|---|
| JP | 2005-160009 | 6/2005 |
| WO | 2006/137575 | 12/2006 |

OTHER PUBLICATIONS

Kensuke Okubo et al., "Effect of Nonuniform Magnetic Field on Left Handed Ferrite Microstrip Line", 2006 Asia-Pacific Microwave Conference Digest, Dec. 2006, pp. 1769-1772.

M. Tsutsumi et al., "Nonreciprocal Left-Handed Microstrip Lines Using Ferrite Substrate", 2004 IEEE MTT-S International Microwave Symposium Digest, TU5C-3, Jun. 2004, vol. 1, pp. 249-252.

Anthony Lai et al., "Composite Right/Left-Handed Transmission Line Metamaterials", IEEE Microwave Magazine, Oct. 12, 2004 (date of receipt), vol. 5, No. 3, pp. 34-50.

Makoto Tsutsumi et al., "Nonreciprocal Left Handed Transmission Characteristics in Ferrite Microstrip Lines", The transactions of the Institute of Electronics, Information and Communication Engineers C, vol. J87-C, No. 2, pp. 274-275, Feb. 2004 (along with English translation).

Tetsuya Ueda et al., "Left-Handed Transmission Characteristics of Ferrite Microstrip Lines without Series Capacitive Loading", IEICE Transactions on Electron, vol. E89-C, No. 9, pp. 1318-1323, Sep. 2006.

Atsushi Sanada et al., "Novel Zeroth-Order Resonance in Composite Right/Left-Handed Transmission Line Resonators", Proceeding of 2003 Asia-Pacific Microwave Conference, Soul Korea, pp. 1581-1591, Nov. 4-7, 2003.

Atsushi Sanada et al., "A Planar Zeroth-Order Resonator Antenna Using a Left-Handed Transmission Line", Proceedings of 34th European Microwave Conference, Amsterdam, Netherlands, pp. 1341-1344, Oct. 11-15, 2004.

Tetsuya Ueda et al., "Left-Handed Transmission Characteristics of Rectangular Waveguides Periodically Loaded With Ferrite", IEEE Transactions on Magnetics, vol. 41, No. 10, pp. 3532-3537, Oct. 2005.

Shuang Zhang et al., "Experimental Demonstration of Near-Infrared Negative-Index Metamaterials", Physical Review Letters, The American Physical Society, PRL-95, pp. 137404-1-13704-4, Sep. 23, 2005.

Gunnar Dolling et al., "Low-loss negative-index metamaterial at telecommunication wavelengths", Optics Letters, vol. 31, No. 12, pp. 1800-1802, Jun. 15, 2006.

D. R. Smith et al., "Composite Medium with Simultaneously Negative Permeability and Permittivity", Physical Review Letters, The American Physical Society, vol. 84, No. 18, pp. 4184-4187, May 1, 2000.

R. Marques et al., "Left-Handed-Media Simulation and Transmission of EM Waves in Subwavelength Split-Ring-Resonator-Loaded Metallic Waveguides", Physical Review Letters, The American Physical Society, vol. 89, No. 18, pp. 183901-1-183901-4, Oct. 28, 2002.

Juan D. Baena et al., "Artificial magnetic metamaterial design by using spiral resonators", Physical Review Letters, The American Physical Society, vol. B69, pp. 014402-1-014402-5, 2004.

International Preliminary Report on Patentability issued Sep. 17, 2009 in International (PCT) Application No. PCT/JP2008/053964.

* cited by examiner

TRANSMISSION LINE MICROWAVE APPARATUS INCLUDING AT LEAST ONE NON-RECIPROCAL TRANSMISSION LINE PART BETWEEN TWO PARTS

TECHNICAL FIELD

The present invention relates to a transmission-line microwave apparatus provided with a transmission-line microwave circuit employing a nonreciprocal transmission line that has a nonreciprocal phase characteristic such that a propagation constant in a forward direction and a propagation constant in a backward direction are different from each other, and to a novel transmission-line antenna apparatus that uses a leaky wave from the nonreciprocal transmission line. It is noted that the microwave in the present specification refers to, for example, microwave, millimeter wave, sub-millimeter wave and terahertz wave in a frequency band higher than the UHF (Ultra High Frequency) band. A "nonreciprocal right-handed and left-handed transmission line" is hereinafter referred to as a "nonreciprocal right/left handed transmission line".

BACKGROUND ART

Recently, researches on the left-handed transmission (Left Handed Transmission (LHT)) line in which the inductance and the capacitance of the conventional distributed constant transmission line are replaced with each other in arrangement are stepped up (See, for example, the Non-Patent Documents 1-3). Since specificities such as backward wave characteristics and lens effects appear in circuits of the left-handed transmission lines, a novel microwave circuit devices are greatly expected.

Patent Document 1: Japanese patent laid-open publication No. JP 05-183329 A.

Patent Document 2: Japanese patent laid-open publication No. JP 2005-124038 A.

Patent Document 3: Japanese patent laid-open publication No. JP 2005-160009 A.

Non-Patent Document 1: Makoto Tsutsumi et al., "*Nonreciprocal Left Handed Transmission Characteristics in Ferrite Microstrip Lines*", The transactions of the Institute of Electronics, Information and Communication Engineers C, Vol.J87-C, No.2, pp.274-275, February 2004.

Non-Patent Document 2: M. Tsutsumi et al., "Nonreciprocal Left-Handed Microstrip Lines using ferrite substrate", 2004 IEEE MTT-S International Microwave Symposium, TU5C-3, pp. 249-252, June 2004.

Non-Patent Document 3: Tetsuya Ueda, et al., "Left-Handed Transmission Characteristics of Ferrite Microstrip Lines without Series Capacitive Loading", IEICE Transactions on Electron, Vol. E89-C, No. 9, pp. 1318-1323, September 2006.

Non-Patent Document 4: Atsushi Sanada et al., "Novel Zeroth-Order Resonance in Composite Right/Left-Handed Transmission Line Resonators", Proceeding of 2003 Asia-Pacific Microwave Conference, Soul Korea, pp. 1581-1591, Nov. 4-7, 2003.

Non-Patent Document 5: Atsushi Sanada et al., "A Planar Zeroth-Order Resonator Antenna Using a Left-Handed Transmission Line", Proceedings of 34th European Microwave Conference, Amsterdam, Netherlands, pp. 1341-1344, Oct. 11-15, 2004.

Non-Patent Document 6: Tetsuya Ueda, et al. "Left-Handed Transmission Characteristics of Rectangular Waveguides Periodically Loaded With Ferrite", IEEE Transactions on Magnetics, Vol. 41, No. 10, pp. 3532-3537, October 2005.

Non-Patent Document 7: Shuang Zhang et al., "Experimental Demonstration of Near-Infrared Negative-Index Metamaterials", Physical Review Letters, The American Physical Society, PRL-95, pp. 137404-1-13704-4, Sep. 23, 2005.

Non-Patent Document 8: Gunnar Dolling et al., "Low-loss negative-index metamaterial at telecommunication wavelengths", Optics Letters, Vol. 31, No. 12, pp. 1800-1802, Jun. 15, 2006.

Non-Patent Document 9: D. R. Smith et al., "Composite Medium with Simultaneously Negative Permeability and Permittivity", Physical Review Letters, The American Physical Society, Vol. 84, No. 18, pp. 4184-4187, May 1, 2000.

Non-Patent Document 10: R Marques et al., "Left-Handed-Media Simulation and Transmission of EM Waves in Subwavelength Split-Ring-Resonator-Loaded Metallic Waveguides", Physical Review Letters, The American Physical Society, Vol. 89, No. 18, pp. 183901-1-183901-4, Oct. 28, 2002.

Non-Patent Document 11: Juan D. Baena et al., "Artificial magnetic metamaterial design by using spiral resonators", Physical Review Letters, The American Physical Society, Vol. B69, pp. 014402-1-014402-5, 2004.

DISCLOSURE OF THE INVENTION

Problems to be Dissolved

For example, in the Non-Patent Document 1, a left-handed transmission line circuit is constituted in a ferrite microstrip line, and the nonreciprocal propagation characteristic of an edge guided mode in a frequency band in which the permeability is negative is verified numerically and experimentally. Specifically, it is verified that the edge guided mode propagates in the band in which the permeability is negative along with nonreciprocal characteristics of isolation of not smaller than 20 dB. Moreover, in an antenna apparatus that radiates a leaky wave from a conventional transmission line is disclosed in, for example, the Patent Documents 1-3.

However, no application to the antenna apparatus that employs the nonreciprocal left-handed transmission line circuit has been reported. In particular, the nonreciprocal left-handed transmission line aimed to transmit a microwave signal, and there was little leaky wave radiation from the nonreciprocal left-handed transmission line. It is noted that if the direction of the power of the microwave signal that propagates in the invented nonreciprocal transmission line is reversed, the left-handed transmission line can operate as a right-handed transmission line.

Moreover, neither a nonreciprocal transmission line in which one of the forward direction and the backward direction is the left-handed transmission line and the other is the right-handed transmission line nor a transmission-line microwave circuit (e.g., a phase shifter, an antenna apparatus, a resonator, filter, an microwave power divider, an oscillator, etc.) employing the same has been devised. In particular, a resonant frequency in conventional microwave resonators is determined depending on the line length, and the microwave circuit employing the resonators, and the resonators themselves therefore have led to a problem that the apparatus configuration is increased in scale depending on the resonant frequency.

The first object of the present invention is to solve the above problems and provide a transmission line microwave apparatus, such as a transmission line microwave circuit, a microwave resonator and a microwave circuit employing the same, which can be remarkably reduced in size in comparison with the prior art and has unique action and advantageous effects.

The second object of the present invention is to solve the above problems and provide a transmission line antenna apparatus, which forms a main beam by using a leaky wave from a transmission line such as a left-handed or right-handed transmission line and is able to control the main beam direction.

Means for Dissolving the Problems

According to the first aspect of the present invention, there is provided a transmission line microwave apparatus including at least one nonreciprocal transmission line part, where the nonreciprocal transmission line part has a series branch circuit equivalently including a capacitive element and a shunt branch circuit equivalently including an inductive element, and the nonreciprocal transmission line part has gyrotropic characteristics by being magnetized in a magnetization direction different from a propagation direction of a microwave. In this case, the nonreciprocal transmission line part has an asymmetric structure with respect to a plane formed by the propagation direction and the magnetization direction, and the nonreciprocal transmission line part has a predetermined propagation constant and an operating frequency set in a dispersion curve that represents a relation between the propagation constant and the operating frequency so that a propagation constant in a forward direction and a propagation constant in a backward direction have nonreciprocal phase characteristics different from each other. The transmission-line microwave apparatus includes a microwave transmission line constituted by cascade-connecting the at least one nonreciprocal transmission line part between first and second ports.

In the above-mentioned transmission line microwave apparatus, the predetermined propagation constant and the operating frequency are set in the dispersion curve so that the power transmission is performed by left-handed transmission in a direction from the first port toward the second port and the power transmission is performed by right-handed transmission in a direction from the second port toward the first port in the microwave transmission line at a predetermined operating frequency.

In addition, in the above-mentioned transmission line microwave apparatus, the predetermined propagation constant and the operating frequency are set in the dispersion curve so that electric power transmission is performed by left-handed transmission or right-handed transmission in a direction from the first port toward the second port and the power transmission is performed so that the propagation constant is zero and a guide wavelength is infinite in a direction from the second port to the first port in the microwave transmission line at the predetermined operating frequency.

Further, in the above-mentioned transmission line microwave apparatus, the microwave transmission line is a microwave phase shifter that is constituted by setting the predetermined propagation constant and the operating frequency in the dispersion curve to shift the phase by a predetermined amount of phase shift.

Still further, in the above-mentioned transmission line microwave apparatus, when a microwave signal propagates in a propagation direction from the first port toward the second port in the microwave transmission line at a predetermined operating frequency, the microwave transmission line radiates a wireless signal of a radiation pattern that has a main beam of a leaky wave in a direction substantially to the propagation direction and radiates a wireless signal of a radiation pattern that has a main beam of a leaky wave in a direction substantially opposite to the propagation direction or a direction substantially perpendicular to the propagation direction.

Further, in the above-mentioned transmission line microwave apparatus, the transmission line microwave apparatus is a microwave resonator constituted so that, when the propagation constant in a first mode of propagation in a direction from the first port toward the second port is set to $\beta_+$ and the propagation constant in a second mode of propagation in a direction from the second port toward the first port is set to $\beta_-$, then $\beta_+=-\beta_-\neq 0$ is satisfied.

The above-mentioned transmission line microwave apparatus includes the microwave resonator, and a coupling transmission line provided to be coupled with the microwave resonator, then the transmission line microwave apparatus constitutes a microwave filter.

In addition, the above-mentioned transmission line microwave apparatus includes the microwave resonator; and a negative resistance element provided to be coupled with the microwave resonator, then the transmission line microwave apparatus constitutes a microwave oscillator.

Further, the above-mentioned transmission line microwave apparatus includes the microwave resonator; and an microwave power feeding transmission line provided to be coupled with the microwave resonator, then the transmission line microwave apparatus constitutes a microwave antenna apparatus.

Still further, the above-mentioned transmission-line microwave apparatus includes the microwave resonator; a power-feeding transmission line provided to be coupled with the microwave resonator; and a plurality of branching transmission lines provided to be coupled with a microwave transmission line constructing the microwave resonator, then the transmission-line microwave apparatus constitutes a microwave power divider.

In addition, in the above-mentioned transmission line microwave apparatus, the microwave transmission line is an asymmetric microstrip line formed on a substrate that is magnetized spontaneously or magnetized by an external magnetic field.

Further, in the above-mentioned transmission line microwave apparatus, the microwave transmission line is an asymmetric waveguide including a magnetic material that is magnetized spontaneously or magnetized by an external magnetic field.

Still further, in the above-mentioned transmission line microwave apparatus, the microwave transmission line is an asymmetric dielectric transmission line including a magnetic material that is magnetized spontaneously or magnetized by an external magnetic field.

Still further, in the above-mentioned transmission line microwave apparatus, the capacitive element is a microwave element having a negative effective permeability for an electromagnetic wave mode propagation along the transmission line, and the inductive element is a microwave element having a negative effective permittivity for the electromagnetic wave mode propagation along the transmission line.

According to the second aspect of the present invention, there is provided a transmission-line antenna apparatus composed of the transmission-line microwave apparatus employing a transmission line. The transmission line includes a substrate that is magnetized spontaneously or magnetized by an external magnetic field and has a ground conductor on a back surface thereof; a microstrip line formed on the substrate; a plurality of capacitors that separate the microstrip line into a plurality of line parts and connect mutually adjacent line parts of the plurality of separated line parts; and a plurality of short-circuit stub conductors that connect the line parts to the ground conductor. The transmission-line antenna apparatus includes control means for performing control by inputting a microwave signal to at least one of one end and another end of the transmission line, operating the transmission line as a forward wave transmission line or a backward wave transmission line at a predetermined operating frequency and controlling at least one of an amplitude and a phase of the inputted microwave signal with utilizing nonreciprocal characteristics of the transmission line, and this leads to a main beam that uses a leaky wave leaked from the transmission line as a radiation wave.

In the above-mentioned transmission antenna apparatus, the substrate further includes a dielectric substrate, the magnetic substrate and the dielectric substrate are combined integrally together by their side surfaces at a boundary portion, and the dielectric substrate further includes a ground conductor on the back surface thereof.

In addition, in the above-mentioned transmission-line antenna apparatus, the control means forms the main beam of the radiation wave by inputting the microwave signal to one end and another end of the transmission line and controlling at least one of the amplitude and the phase of the inputted microwave signal.

Further, in the above-mentioned transmission-line antenna apparatus, the control means forms the main beam of the radiation wave by inputting the microwave signal to one end of the transmission line and controlling at least one of the amplitude and the phase of the inputted microwave signal, thereby reflecting a forward wave at another end of the transmission line.

Still further, in the above-mentioned transmission-line antenna apparatus, the control means forms the main beam of the radiation wave by inputting the microwave signal to another end of the transmission line and controlling at least one of the amplitude and the phase of the inputted microwave signal, thereby reflecting a backward wave at one end of the transmission line.

Still further, in the above-mentioned transmission antenna apparatus, the control means forms the main beam of the radiation wave by selectively inputting the microwave signal to one end and another end of the transmission line and controlling at least one of the amplitude and the phase of the inputted microwave signal.

Advantageous Effects of the Invention

According to a transmission-line microwave apparatus of the present invention, there is provided the microwave transmission line including at least one nonreciprocal transmission line part, where the nonreciprocal transmission line part has a series branch circuit equivalently including a capacitive element and a shunt branch circuit equivalently including an inductive element, and the nonreciprocal transmission line part has gyrotropic characteristics by being magnetized in a magnetization direction different from a propagation direction of a microwave. In this case, the nonreciprocal transmission line part has an asymmetric structure with respect to a plane formed by the propagation direction and the magnetization direction, and the nonreciprocal transmission line part has a predetermined propagation constant and an operating frequency set in a dispersion curve that represents a relation between the propagation constant and the operating frequency so that a propagation constant in a forward direction and a propagation constant in a backward direction have nonreciprocal phase characteristics different from each other. The transmission-line microwave apparatus includes a microwave transmission line constituted by cascade-connecting the at least one nonreciprocal transmission line part between first and second ports.

Therefore, the transmission-line microwave apparatus that can be remarkably reduced in size in comparison with the prior art and has unique operation and advantageous effects can be provided. Specifically, when a microwave is inputted from each of the first and second ports, two mutually different right-handed mode and left-handed mode with an equal wave number vector can be simultaneously transmitted despite that the directions of their transmitted power have directional relations opposed to each other. By utilising this phenomenon, a microwave phase shifter, a leaky wave antenna apparatus, and a microwave power divider can be constituted. Moreover, by constituting the microwave resonator, the unique performance and advantageous effects can be attained so that a predetermined resonant frequency independent of the line length is owned, the magnitude of the electromagnetic field distribution is constant with respect to the line direction of the microwave transmission line, and a phase change (phase gradient) determined depending on the wave number vector is owned. By utilizing the advantageous features, a microwave filter, a microwave oscillator and a microwave antenna apparatus can be constituted.

Moreover, according to the transmission-line antenna apparatus of the present invention, by inputting a microwave signal to at least one of the one end and another end of the transmission line, making the transmission line operate as the right-handed transmission line or the left-handed transmission line at a predetermined frequency, and controlling at least one of the amplitude and the phase of the inputted microwave with utilizing the nonreciprocal characteristics of the transmission line, the main beam that uses a leaky wave leaked from the transmission line as a radiation wave is formed. Therefore, a transmission-line antenna apparatus capable of forming the main beam by using the leaky wave from the transmission line of the left-handed or right-handed transmission line and controlling the main beam direction can be provided. In particular, an antenna apparatus capable of controlling the main beam direction by one transmission line can be formed, achieving a remarkable size reduction in comparison with the prior art array antenna having a plurality of antenna elements, also through simple manufacturing processes.

REFERENCE NUMERALS

Figure 1:
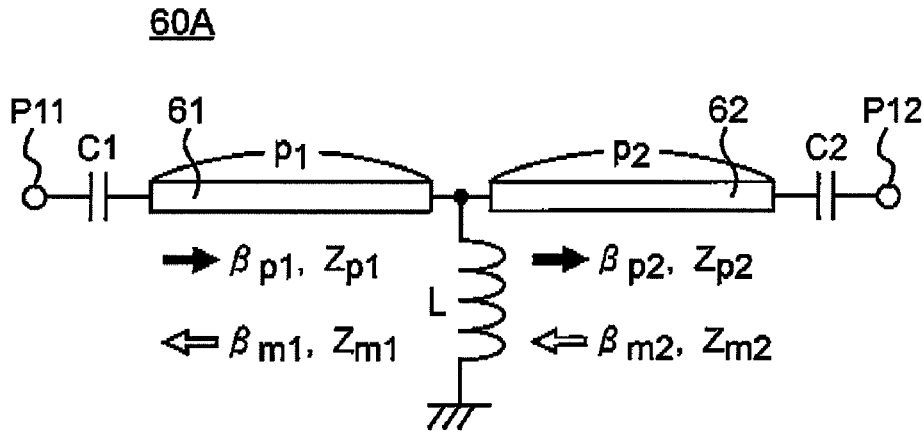
FIG. 1 is a circuit diagram showing a configuration of a unit cell 60A of a first example of a ladder type nonreciprocal right/left handed transmission line according to a first preferred embodiment of the present invention.

1: transmission-line antenna apparatus
2: transmission line
10: dielectric substrate
10F: ferrite substrate
10M: magnet substrate
10S: semiconductor substrate
10*a*: boundary portion
11: ground conductor
12, 12P1, 12P2, 12S: strip conductor
12A: microstrip line
13: short-circuit stub conductor
14: gap
20: magnet substrate
30: direct-current magnetic field generator
40: microwave signal generator
41: power divider
42, 44: variable attenuator
43, 45: phase shifter
46: switch
50: controller
60A, 60B, 60C, 60D, 60A-1 to 60A-M: unit cell of transmission line
61, 62: transmission line part
63: microwave signal generator
64-1 to 64-N: signal branching transmission line
65-1 to 65-N: coupling capacitor
66: transformer
66*a*: primary coil
66*b*: secondary coil
67, 68: transmission line
70, 70A, 70B, 70C, 70D: transmission-line apparatus
71: rectangular waveguide
72: ferrite part
72*a*: magnetic metal fine wire structure part
73: metal part
74: ferrite plate
74*a*: semiconductor plate
75: split ring resonator
76: dielectric disk resonator
76*a*: dielectric rod resonator
77*a*, 77*b*: metal sheet
77*c*: strip metal sheet
77*g*: ground metal sheet
78, 79: metal post
80: ferrite substrate
81 and 82: dielectric sheet
83: strip conductor
84: split ring resonator
85: dielectric resonator
86, 88, 89, 91: transmission line
87, 90: load resistance
C, C1, C2: capacitor
CC1 to CcM+1, C11 to C14: coupling
L, L1, L2: inductor
P1, P2, P11, P12, P81, P82, P83-1 to P83-N, P91, P92: port
Q1: field-effect transistor (FET)-

BEST MODE FOR CARRYING OUT THE PRESENT INVENTION

Preferred embodiments of the present invention will be described below with reference to the drawings. It is noted that like components are denoted by like reference numerals in the following preferred embodiments.

First Preferred Embodiment

Figure 2:
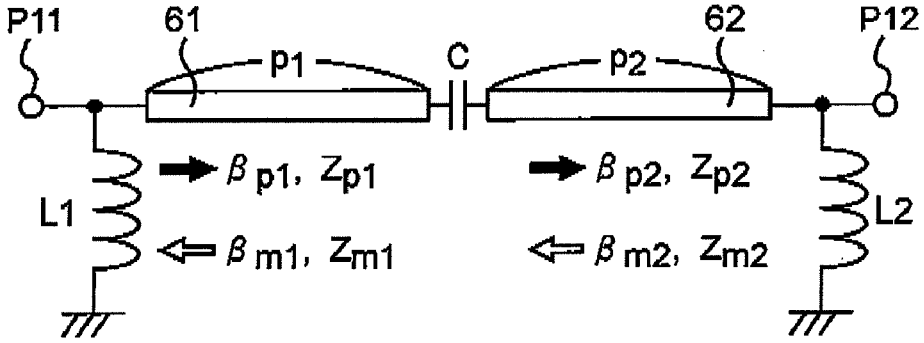
FIG. 2 is a circuit diagram showing a configuration of a unit cell 60B of a second example of the ladder type nonreciprocal right/left handed transmission line of the first preferred embodiment of the present invention.
Figure 3:
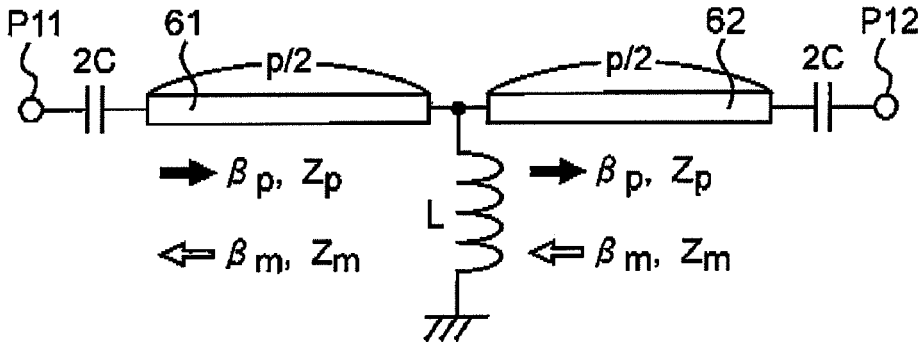
FIG. 3 is a circuit diagram showing a configuration of a unit cell 60C of a third example of the ladder type nonreciprocal right/left handed transmission line of the first preferred embodiment of the present invention.
Figure 4:
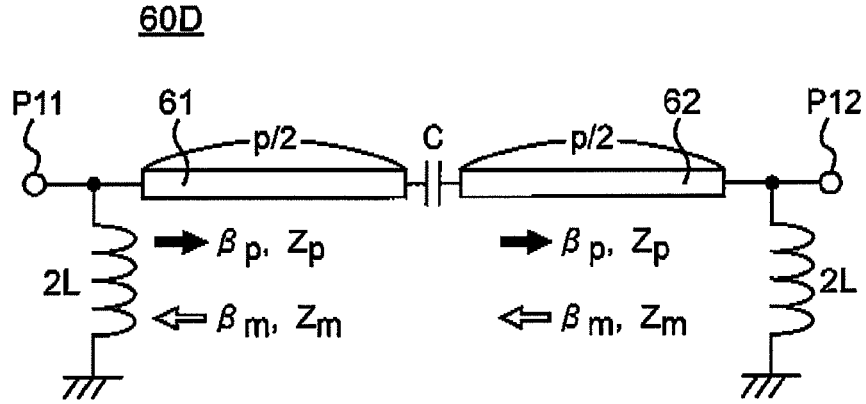
FIG. 4 is a circuit diagram showing a configuration of a unit cell 60D of a fourth example of the ladder type nonreciprocal right/left handed transmission line of the first preferred embodiment of the present invention.

FIG. 1 is a circuit diagram showing a configuration of a unit cell 60A of a first example of a ladder-type nonreciprocal right/left handed transmission line according to the first preferred embodiment of the present invention. FIG. 2 is a circuit diagram showing a configuration of a unit cell 60B of a second example of the ladder-type nonreciprocal right/left handed transmission line of the first preferred embodiment of the present invention. FIG. 3 is a circuit diagram showing a configuration of a unit cell 60C of a third example of the ladder-type nonreciprocal right/left handed transmission line of the first preferred embodiment of the present invention. FIG. 4 is a circuit diagram showing a configuration of a unit cell 60D of a fourth example of the ladder-type nonreciprocal right/left handed transmission line of the first preferred embodiment of the present invention.

The fundamental configuration of the nonreciprocal transmission line of the present invention is first described below with reference to FIGS. 1 to 4 and so on.

As shown in, for example, FIGS. 1 to 4, the configuration proposed in the ladder-type nonreciprocal right/left handed transmission line of the present invention is a ladder-type transmission line configuration constituted by, for example, at least one or more of the unit cells 60A to 60D. In this case, the configuration of the unit cell includes a transmission line part that has a nonreciprocal phase shift phenomenon of different propagation constants in the forward direction and the backward direction and has a configuration in which a capacitive element is equivalently inserted in a series branch circuit and an inductive element is equivalently inserted in a shunt branch circuit (See FIGS. 1 to 4). The objective circuit or apparatus as the transmission line configuration includes not only printed board circuits, waveguides, dielectric lines such as strip lines, microstrip lines, slot lines and coplanar lines for use in microwave, millimeter wave, sub-millimeter wave and terahertz wave but also all sorts such as configurations that support waveguide modes including plasmon, polariton, magnon and the like or an evanescent mode, combinations of them, and free spaces describable as an equivalent circuit.

The transmission line that has the nonreciprocal phase shift phenomenon is constituted by a transmission line of a structure that partially or totally includes materials having particularly gyrotropic characteristics among the transmission line configurations described above and is magnetized in different magnetization directions with respect to the propagation direction of electromagnetic wave (more preferably in a direction orthogonal to the propagation direction) to have asymmetricity with respect to a plane formed by the propagation direction and the magnetization direction. As the transmission lines having the nonreciprocal phase shift phenomenon described above, a lumped-parameter element that has an equivalent nonreciprocal phase shift function and is sufficiently small compared with the wavelength is also regarded as an objective besides the transmission lines. The materials having the gyrotropy include all of the cases where a dielectric constant tensor or a magnetic permeability tensor or both of them are expressed as a state that has gyrotropy due to spontaneous magnetization or magnetization induced by an externally applied direct-current current or a low-frequency magnetic field or the orbiting movements of free charges. As concrete objective examples, ferrimagnetic materials such as ferrite, ferromagnetic materials, solid-state plasma (semiconductor materials etc.) and liquid, gaseous plasma media, and magnetic artificial media constituted by fine patterning or the like for use in microwave, millimeter wave and so on can be enumerated.

The capacitive element inserted in the series branch circuit may include not only capacitors that are often used in electric circuits and distributed type capacitance devices for use in microwave, millimeter wave and so on but also a circuit or a circuit device such that the effective permeability for the electromagnetic wave mode propagation along the transmission line equivalently has a negative value. As concrete examples exhibiting a negative effective permeability, a spatial arrangement that includes at least one of split ring resonators made of metal and magnetic resonators of a spiral configuration or the like, a spatial arrangement of a dielectric resonator under the magnetic resonant condition or all sorts of microwave circuits that operate in the waveguide mode having a negative effective permeability or the evanescent mode like an edge guided mode propagation along a ferrite substrate microstrip line can be used since they are described as a line in which the series branch circuit operates predominantly as a capacitive element in the equivalent circuit model. Further, the capacitive element inserted in the series branch circuit may be a series connection or a parallel connection of capacitive elements and inductive elements or combinations of them besides the above. There may be an element or a circuit that exhibits a capacitive property as a whole in the insertion portion.

As the inductive element inserted in the shunt branch circuit, not only a lumped element such as a coil for use in an electrical circuit, a distributed type inductive element such as a short-circuit stub for use in microwave, millimeter wave and so on but also a circuit or a device in which the effective permittivity for the electromagnetic wave mode propagation along the transmission line has a negative value can be used. In concrete, a spatial arrangement that includes at least one electric resonator of a metal fine wire, a metal sphere or the like, a spatial arrangement of a dielectric resonator under the electric resonance state besides metal, or all sorts of microwave circuits that operate in the waveguide mode having a negative effective permeability or the evanescent mode such as a waveguide in which the TE mode is in below-cutoff region, a parallel plate waveguide or the like can be used since they are described as a transmission line in which the shunt branch operates predominantly as an inductive element in the equivalent circuit model. Moreover, as the inductive element inserted in the shunt branch circuit may be a series connection or a parallel connection of capacitive elements and inductive elements or combinations of them besides the above. There may be a circuit or an element that exhibits a capacitive property as a whole in the insertion portion.

When the effective permeability for the electromagnetic wave mode propagation along the transmission line is negative in the nonreciprocal phase shift transmission line, the evanescent mode may occur. However, since the negative effective permeability corresponds to a case where a capacitive element is inserted in the series branch, the equivalent circuit of the line includes both the nonreciprocal phase shift part and the series capacitance element part.

When the effective permittivity for the electromagnetic wave mode propagation along the transmission line is negative in the transmission line that has the nonreciprocal phase shift phenomenon, the evanescent mode may occur. However, since the negative effective permittivity corresponds to a case where an inductive element is inserted in the shunt branch circuit, the equivalent circuit of the line includes both the nonreciprocal phase shift part and the shunt inductive element part.

Next, the fundamental operation and configuration of the nonreciprocal transmission line of the present invention are described below with reference to FIGS. 1 to 12.

As shown in FIGS. 9 to 12, the nonreciprocal transmission line handled in the present invention is wholly constituted by including at least one or more of unit cells 60A to 60D of FIGS. 1 to 4 and cascade-connecting them together. It is noted that the line is not necessarily constituted by unit cells 60A to 60D of an identical type even when a plurality of unit cells 60A to 60D are cascade-connected together. FIGS. 1 and 2 show the cases where the unit cells 60A and 608 have an asymmetric T type structure and an asymmetric n type structure, respectively. FIGS. 3 and 4 show the cases where a symmetric T type structure and a symmetric π type structure are owned as a simpler case. Since a case where the line length (i.e., period length $p=p_1+p_2$) of the unit cells 60A to 60D is sufficiently small in comparison with the wavelength is assumed as a rule, essentially similar results are obtained even in the case of the T type, the π type or the L type as in the handling of the unit cells in the prior art composite right/left-handed transmission line. Actually, the L type is included in the case of FIG. 1 or 2 by parameter handling. On the other hand, it is emphasized that the line length of the unit cells 60A to 60D with respect to the wavelength does not restrict the fundamental operation described here.

The line structures shown in FIGS. 1 to 4 are simple, where a capacitive element or a circuit network exhibiting a capacitive property is inserted in a series branch circuit of the nonreciprocal transmission line including two transmission line parts 61 and 62 that have respective line lengths (the line length is p/2 in FIGS. 3 and 4, and the line lengths are $p_1$ and $p_2$ of FIGS. 1 and 2), and an inductive element or an inductive circuit network is inserted in the shunt branch circuit. In order to simply show the effective values of these elements collectively, a capacitor $C_i$ (i=1, 2) and an inductor L are inserted in FIG. 1. In a manner similar to above, a capacitor C and an inductor $L_i$ (i=1, 2) are inserted in FIG. 2. As parameters that express the characteristics of the nonreciprocal transmission line part, a propagation constant and a characteristic impedance in the forward direction (referring to a direction from a port P11 toward a port P12) are assumed to be $\beta_p$ and $Z_p$, respectively, and those in the backward direction (referring to a direction from the port P12 toward the port P11) are assumed to be $\beta_m$ and $Z_m$, respectively. As a concrete example, in the case of the symmetric type transmission lines as in FIGS. 3 and 4 ($p_1=p_2=p/2$, $\beta_{p1}=\beta_{p2}=\beta_p$, $\beta_{m1}=\beta_{m2}=\beta_m$, $Z_{p1}=Z_{p2}=Z_p$, $Z_{m1}=Z_{m2}=Z_m$. In particular, $C_1=C_2=2C$ in the case of the T type, $L_1=L_2=2L$ in the case of the π type) in the transmission line having a transmission line part 61 that has the propagation constant $\beta_{p1}$, the characteristic impedance $Z_{p1}$ and the line length $p_1$ and a transmission line part 62 that has the propagation constant $\beta_{p2}$, the characteristic impedance $Z_{p2}$ and the line length $p_2$, as shown in FIGS. 1 and 2, the following equation is obtained if a periodic boundary condition is imposed on both ends of the unit cells 60A to 60D:

$$\cos\left[\left(\beta-\frac{\Delta\beta}{2}\right)p\right]=\left(1-\frac{1}{\omega^2 LC}\frac{Z_pZ_m}{(Z_p+Z_m)^2}\right)\cos\bar{\beta}p+\frac{1}{Z_p+Z_m}\left(\frac{Z_pZ_m}{\omega L}+\frac{1}{\omega C}\right)\sin\bar{\beta}p-\frac{1}{2\omega^2 LC}\frac{Z_p^2+Z_m^2}{(Z_p+Z_m)^2} \quad (1)$$

where Δβ and $\bar{\beta}$ are expressed by the following equations:

$$\Delta\beta=\beta_p-\beta_m$$

$$\bar{\beta}=\frac{\beta_p+\beta_m}{2}$$

The symbols ω and β express the operating angular frequency and the propagation constant of an electromagnetic wave that propagates along a periodic structure, respectively. The Equation (1) expresses the relation between the operating angular frequency ω and the propagation constant β, and therefore, a dispersion relation formula (ω-β diagram) results.

In the Equation (1), if the reciprocal characteristic ($\beta_p=\beta_m$ and $Z_p=Z_m$) is assumed, the transmission line becomes the same as the prior art reciprocal composite right/left handed transmission line, and the Equation (1) is simplified to the following equation:

$$\cos\beta p=\cos\beta_p p-\frac{1}{2\omega^2 LC}\cos^2\frac{\beta_p p}{2}+\frac{j}{2}\left(\frac{Y}{Y_p}+\frac{Z}{Z_p}\right)\sin\beta_p p \quad (2)$$

It is noted that the admittance Y and the impedance Z in the Equation (2) are defined as Y=1/jωL and Z=1/jωC, respectively.

Figure 5:
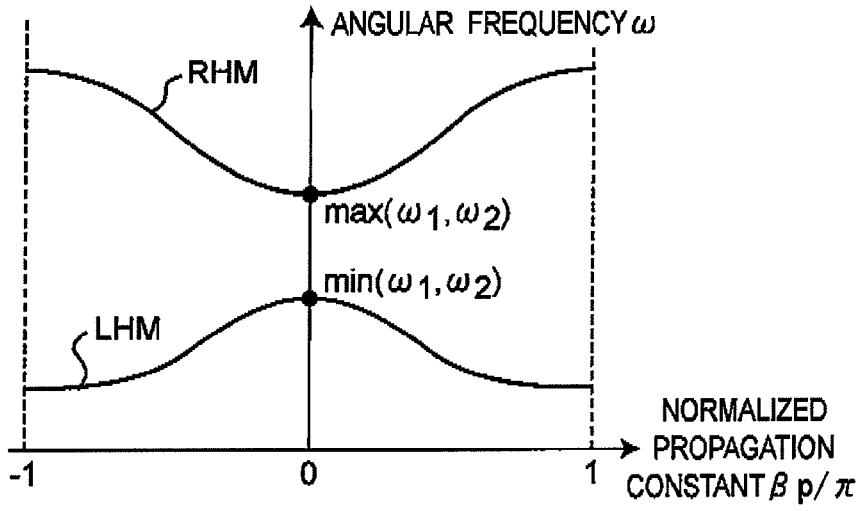
FIG. 5 is a graph showing a dispersion curve (relation of an angular frequency ω to a normalized propagation constant βp/π) in an unbalanced case in a prior art reciprocal right/left handed transmission line.
Figure 6:
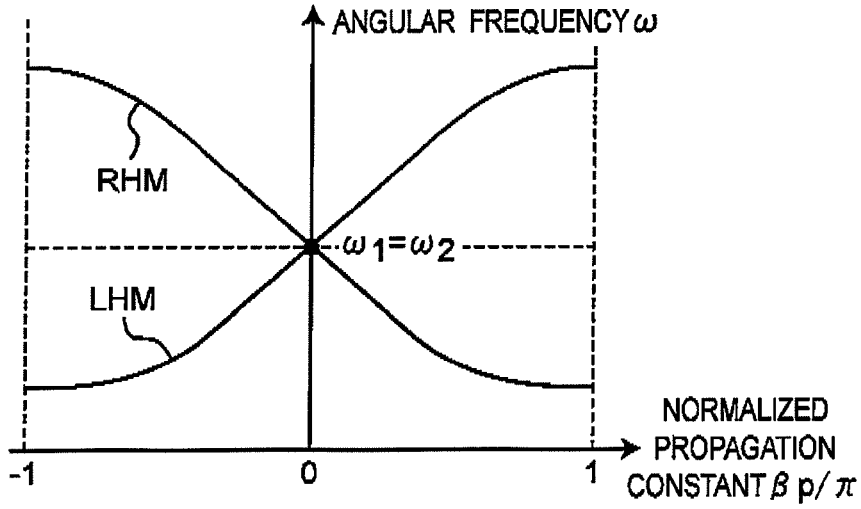
FIG. 6 is a graph showing a dispersion curve (relation of the angular frequency ω to the normalized propagation constant βp/π) in a balanced case in the prior art reciprocal right/left-handed transmission line.

FIG. 5 is a graph showing a dispersion curve (relation of the angular frequency ω to the normalized propagation constant βp/π) in an unbalanced case in a conventional reciprocal right/left handed transmission line. FIG. 6 is a graph showing a dispersion curve (relation of the angular frequency ω to the normalized propagation constant βp/π) in an balanced case in the conventional reciprocal right/left handed transmission line.

In the case of the conventional right/left handed composite transmission line as expressed by the Equation (2), a typical dispersion curve is expressed as in FIG. 5, and a forbidden band generally appears between bands that express the right-handed (RH) transmission characteristic and the left-handed (LH) transmission characteristic. Frequencies at the upper limit of the left-handed transmission band and at the lower limit of the right-handed transmission band are obtained as the solutions of a quadratic equation concerning square of the angular frequency $\omega^2$ by imposing the condition of the propagation constant β=0 on the Equation (2). As a result, the following two solutions are obtained:

$$\omega_1=\sqrt{\frac{1}{L\varepsilon_p p}}$$

$$\omega_2=\sqrt{\frac{1}{C\mu_p p}}$$

where $\epsilon_p$ and $\mu_p$ express the effective permittivity and the effective permeability of the transmission line parts 61 and 62 in the unit cells 60A to 60D. Therefore, in order to make the cutoff frequency satisfy $\omega_1=\omega_2$ so that the forbidden band becomes zero, the Equation (2) is only required to have a multiple root on the condition that the propagation constant β=0, and the following equation is obtained as a result:

$$Z_p=\sqrt{\frac{\mu_p}{\varepsilon_p}}=\sqrt{\frac{L}{C}} \quad (3)$$

As well known, the result of the Equation (3) means that no gap is generated if an impedance $$\sqrt{\frac{L}{C}}$$

produced by the capacitor C that is the capacitive element to be inserted in the series branch circuit and the inductor L that is the inductive element to be inserted in the shunt branch circuit is identical to the characteristic impedances $Z_p$ of the transmission Line parts 61 and 62 to be inserted, and it is a kind of impedance matching condition. The dispersion curve in the case is shown in FIG. 6.

The dispersion curve in the case of the nonreciprocal transmission line given by the Equation (1) is described. In contrast to the fact that a symmetrical structure is made with respect to the axis (i.e., ω axis) of the propagation constant β=0 in the case of the Equation (2) of the reciprocal transmission line, it can easily be understood that the case of the Equation (1) of the nonreciprocal transmission line has a structure in which the axis of symmetry of the dispersion curve is shifted in the positive direction concerning β by $$\frac{\Delta\beta}{2}=\frac{\beta_p-\beta_m}{2}$$

with respect to the axis of β=0 when the left-hand side terms of the Equation (1) are seen. Therefore, FIG. 7 is obtained in correspondence with FIG. 5.

Figure 7:
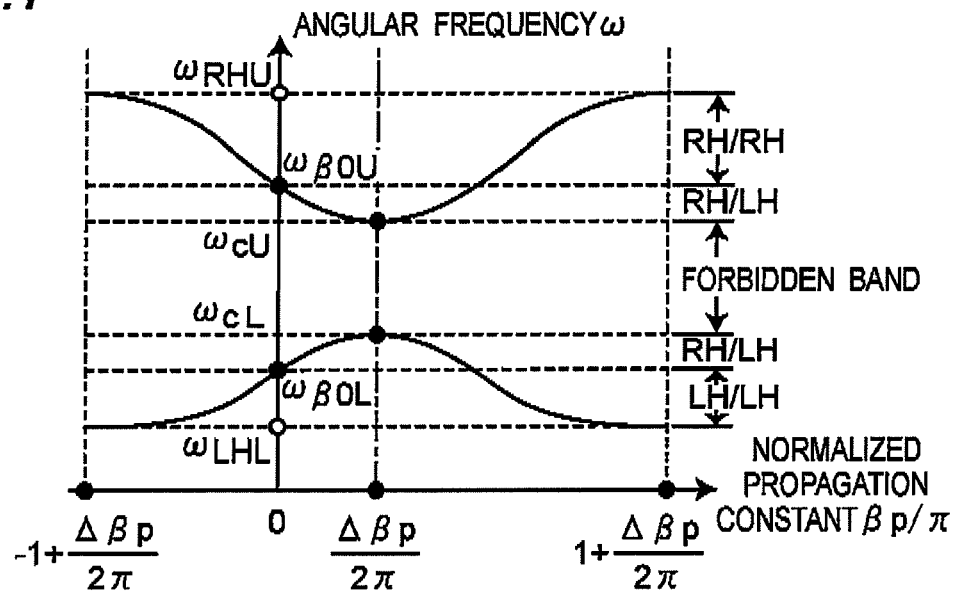
FIG. 7 is a graph showing a dispersion curve (relation of the angular frequency ω to the normalized propagation constant βp/π) in an unbalanced case in the nonreciprocal right/left handed transmission line of the first preferred embodiment.
Figure 8:
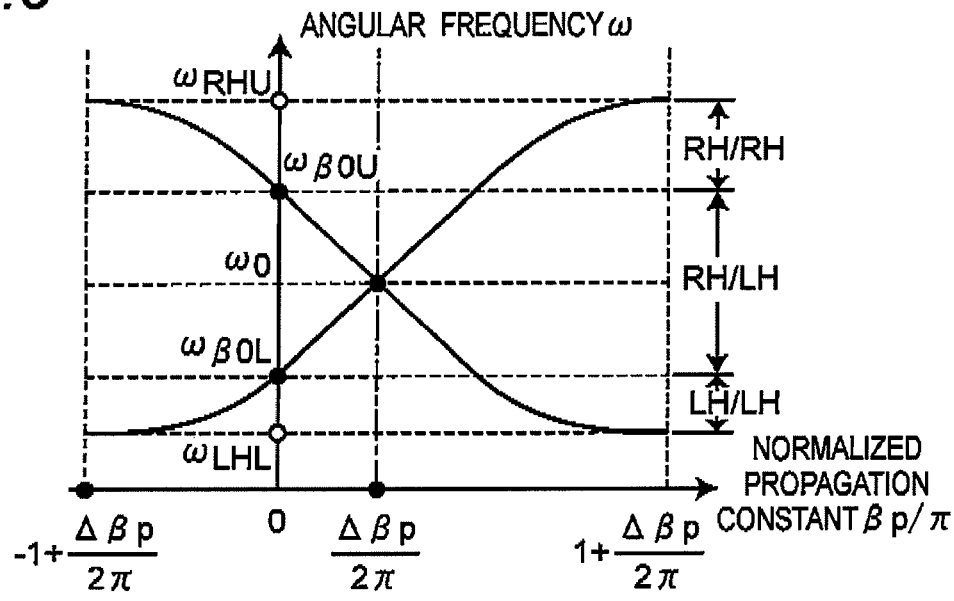
FIG. 8 is a graph showing a dispersion curve (relation of the angular frequency ω to the normalized propagation constant βp/π) in a balanced case in the nonreciprocal right/left-handed transmission line of the first preferred embodiment.

FIG. 7 is a graph showing a dispersion curve (relation of the angular frequency ω to the normalized propagation constant βp/π) in an unbalanced case in the nonreciprocal right/left handed transmission line of the first preferred embodiment. FIG. 8 is a graph showing a dispersion curve (relation of the angular frequency ω to the normalized propagation constant βp/π) in an balanced case in the nonreciprocal right/left handed transmission line of the first preferred embodiment.

As described above, the composite right/left handed transmission line employing the nonreciprocal transmission line largely differs from the case where the reciprocal transmission line is employed in that the axis of symmetry of the dispersion curve is shifted from the ω axis, and this is ascribed to the fact that the propagation constants in the forward direction and the backward direction are $\beta p \neq \beta_m$, i.e., the effect of a nonreciprocal phase shift. This consequently enables classification into the following five kinds of transmission bands (A) to (E):

(A) The left-handed transmission is performed in both the forward and backward propagation directions. It is noted that the magnitudes of the propagation constants are different from each other.

(B) The left-handed transmission is performed in the forward direction, while the propagation constant is zero and the guide wavelength becomes infinite in the backward direction.

(C) The left-handed transmission is performed in the forward direction, and the right-handed transmission is performed in the backward direction.

(D) The right-handed transmission is performed in the forward direction, while the propagation constant is zero and the guide wavelength becomes infinite in the backward direction.

(E) The right-handed transmission is performed in both the forward and backward propagation directions. It is noted that the magnitudes of the propagation constants are different from each other.

It is noted that a stop band (forbidden band) generally appears at the center of the transmission band (C) as apparent from FIG. 7. In this case, the transmission bands (B) to (D) are novel uses of transmission bands. In particular, in FIGS. 7 and 8, the use of the transmission band indicated by RH/LH is novel and has an advantageous feature that the flow of phase is directed in a predetermined identical direction (left-handed transmission and right-handed transmission) even if a microwave signal is inputted bi-directionally (in the forward direction and the backward direction) to the ports.

If the case of the prior art reciprocal transmission line is considered for the sake of comparison, the two identical modes in which the power transmission direction becomes positive and negative intersect each other when the matching condition of the Equation (3) holds, i.e., without coupling of the two modes at a point where the propagation constant $\beta=0$ as shown in FIG. 6. In a manner similar to above, the Equation (1) becomes a quadratic equation concerning the square of angular frequency $\omega^2$ on the symmetric axis line $\beta=\Delta\beta/2$ of the dispersion curve given by the Equation (1), and the following equation is obtained if the multiple root condition is imposed in order not to generate a band gap:

$$Z_p = \sqrt{\frac{\mu_p}{\varepsilon_p}} = \sqrt{\frac{L}{C}} \tag{4}$$

or $$Z_m = \sqrt{\frac{\mu_m}{\varepsilon_m}} = \sqrt{\frac{L}{C}}.$$

It is noted that $\epsilon_p$ and $\mu_p$ represent the effective permittivity and the effective permeability, respectively, of the nonreciprocal transmission line parts 61 and 62 in the unit cells 60A to 601D in the forward direction, and $\epsilon_m$ and $\mu_m$ represent those in the backward direction. According to the Equation (4), the condition that generates no gap in the vicinity of a place where the two modes intersect each other is an impedance matching condition resembling the case of the Equation (3) of the reciprocal transmission line Moreover, it is proper to insert an inductor L and a capacitor C so that matching can be made in either the forward direction or the backward direction, and there is enumerated the advantageous feature that the impedance matching condition is gentler than in the case of the reciprocal transmission line.

A more general case where there is no symmetricity as shown in FIGS. 1 and 2, i.e., the case of the asymmetric type is described a little. Even in such an asymmetric case, the operation similar to those shown in FIGS. 7 and 8 are fundamentally performed. The position of the axis of symmetry is corrected to the position of the following equation on the normalized propagation constant $\beta p/\pi$ on the horizontal axes of FIGS. 7 and 8:

$$\frac{\beta p}{\pi} = \frac{(\beta_{p1} - \beta_{m1})p_1}{2\pi} + \frac{(\beta_{p2} - \beta_{m2})p_2}{2\pi}$$

Moreover, when the two nonreciprocal transmission line parts 61 and 62 have an identical propagation characteristic, a matching condition that generates no band gap becomes the same as that of the Equation (4). It is noted that the condition of FIG. 1 is:

$$\frac{1}{C} = \frac{1}{C1} + \frac{1}{C2}$$

and the condition of FIG. 2 is:

$$\frac{1}{L} = \frac{1}{L1} + \frac{1}{L2}$$

Figure 9:
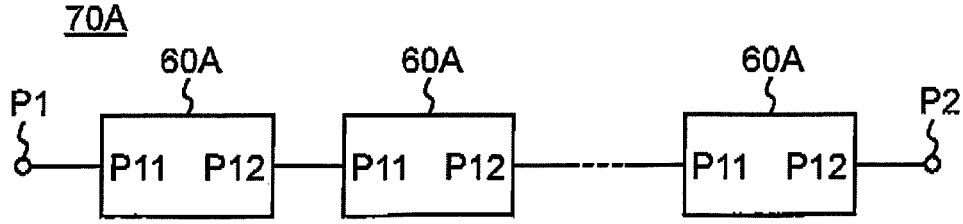
FIG. 9 is a block diagram showing a configuration of a ladder-type nonreciprocal right/left handed transmission line 70A according to the first preferred embodiment constituted by cascade-connecting a plurality of the unit cells 60A of the example of FIG. 1.

FIG. 9 is a block diagram showing a configuration of a ladder-type nonreciprocal right/left handed transmission line 70A according to the first preferred embodiment constituted by cascade-connecting a plurality of the unit cells 60A of the example of FIG. 1. Referring to FIG. 9, the ladder-type nonreciprocal right/left handed transmission line 70A is constituted by cascade-connecting the plurality of unit cells 60A between the port P1 and the port P2.

Figure 10:
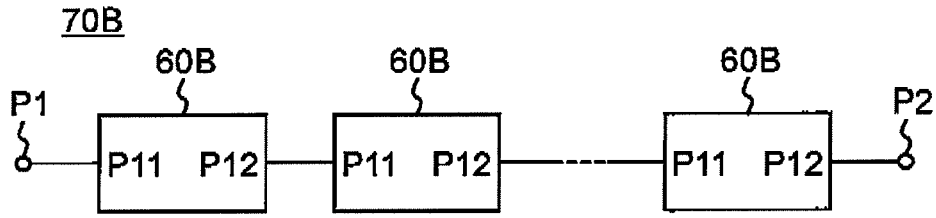
FIG. 10 is a block diagram showing a configuration of a ladder-type nonreciprocal right/left handed transmission line 70B according to the first preferred embodiment constituted by cascade-connecting a plurality of the unit cells 60B of the example of FIG. 2.

FIG. 10 is a block diagram showing a configuration of a ladder-type nonreciprocal right/left-handed transmission line 70B according to the first preferred embodiment constituted by cascade-connecting a plurality of the unit cells 60B of the example of FIG. 2. Referring to FIG. 10, the ladder type non-reciprocal right/left handed transmission line 70B is constituted by cascade-connecting the plurality of unit cells 608 between the port P1 and the port P2.

Figure 11:
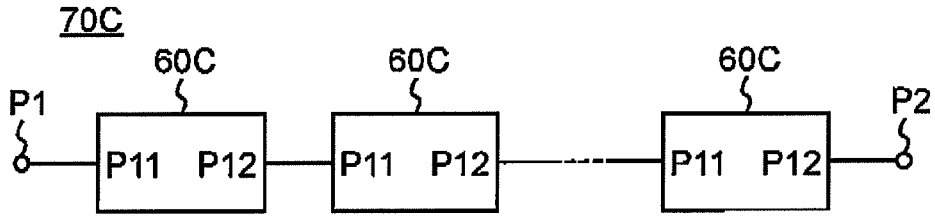
FIG. 11 is a block diagram showing a configuration of a ladder-type nonreciprocal right/left handed transmission line 70C according to the first preferred embodiment constituted by cascade-connecting a plurality of the unit cells 60C of the example of FIG. 3.

Further, FIG. 11 is a block diagram showing a configuration of a ladder-type nonreciprocal right/left handed transmission line 70C according to the first preferred embodiment constituted by cascade-connecting a plurality of the unit cells 60C of the example of FIG. 3. Referring to FIG. 11, the ladder-type nonreciprocal right/left handed transmission line 70C is constituted by cascade-connecting the plurality of unit cells 60C between the port P1 and the port P2.

Figure 12:
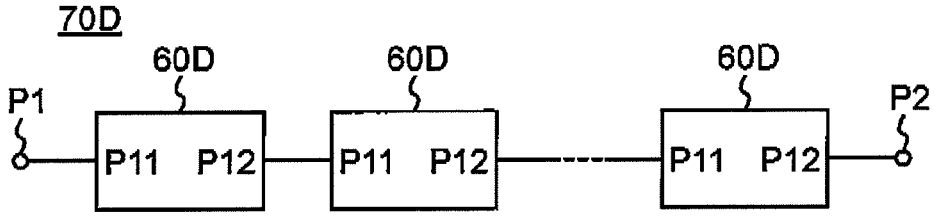
FIG. 12 a block diagram showing a configuration of a ladder-type nonreciprocal right/left handed transmission line 70D according to the first preferred embodiment constituted by cascade-connecting a plurality of the unit cells 60D of the example of FIG. 4.

Furthermore, FIG. 12 a block diagram showing a configuration of a ladder-type nonreciprocal right/left handed transmission line 70D according to the first preferred embodiment constituted by cascade-connecting a plurality of the unit cells 60D of the example of FIG. 4. Referring to FIG. 12, the ladder-type nonreciprocal right/left handed transmission line 70D is constituted by cascade-connecting the plurality of unit cells 60D between the port P1 and the port P2.

Although the identical unit cells are used in each of the constitutional examples of FIGS. 9 to 12, the present invention is not limited to this, and combinations of different unit cells may be used.

Next, the fundamental operation of the nonreciprocal transmission-line-type resonator of the present invention is described below with reference to FIGS. 13 to 17.

Figure 13:
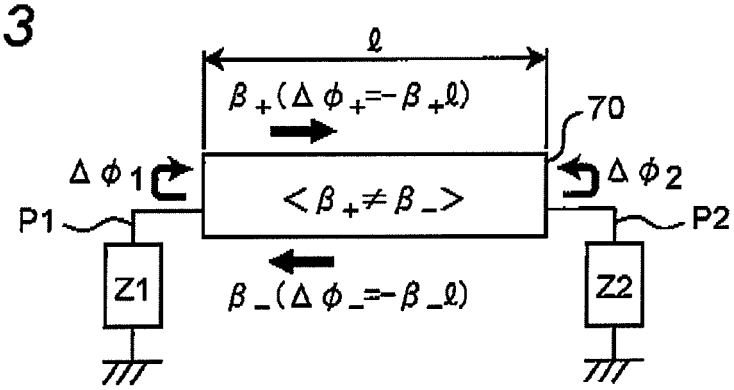
FIG. 13 is a block diagram showing a configuration of a nonreciprocal transmission-line-type resonator that employs the ladder-type nonreciprocal right/left handed transmission line 70 of the first preferred embodiment.

FIG. 13 is a block diagram showing a configuration of a nonreciprocal transmission-line-type resonator that employs the ladder-type nonreciprocal right/left handed transmission line 70 of the first preferred embodiment. FIG. 13 shows a schematic diagram of a resonator model that employs a nonreciprocal transmission line of a length of l. When a phase change due to the line length in the dominant mode of propagation from the port P1 located at a line end toward the port P2 is set to $\Delta\phi_+$, that in the backward direction is set to $\Delta\phi_-$, and a phase change depending on the terminal conditions of the ports P1 and P2 at the line ends are set to $\Delta\phi_1$ and $\Delta\phi_2$, respectively, then the resonance condition of the transmission-line type resonator is expressed by the following equation:

$$\Delta\phi=\Delta\phi_++\Delta\phi_-+\Delta\phi_1+\Delta\phi_2=2n\pi \quad (5).$$

where "n" denotes an integer.

In particular, if a case where both line ends are concurrently open or short-circuited, then the above conditional equation is simplified and expressed by the following equation:

$$\Delta\phi=\Delta\phi_++\Delta\phi_-=2n\pi \quad (6).$$

Further, it is assumed that the propagation constant in the dominant mode of propagation at a line end from the port P1 toward the port P2 is $\beta_+$ and that in the backward direction is $\beta_-$. In this case, the Equation (6) is expressed by the following equation:

$$\Delta\phi=\Delta\phi_++\Delta\phi_-=-(\beta_++\beta_-)l=2n\pi \quad (7)$$

In the Equation (7) of the resonance condition, if the condition:

$$\beta_++\beta_-=0 \quad (8)$$

is satisfied, then a microwave resonator, which satisfies the resonance condition regardless of the line length l and in which the resonance frequency does not depend on the line length, can be constituted.

Figure 14:
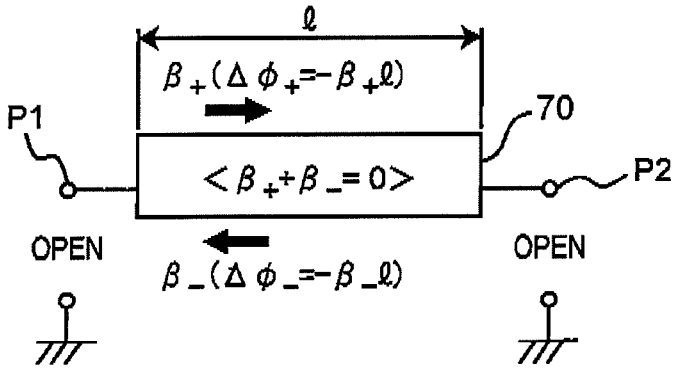
FIG. 14 is a block diagram showing an operation when both ends are open in the nonreciprocal transmission-line-type resonator of FIG. 13 in a case where the wave number vector is equal regardless of the propagation direction.
Figure 15:
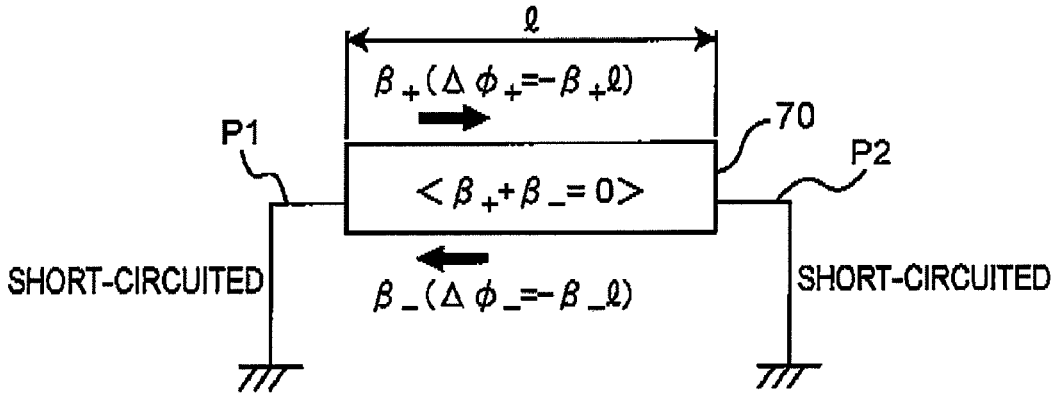
FIG. 15 is a block diagram showing an operation when both ends are short-circuited in the nonreciprocal transmission-line-type resonator of FIG. 13 in a case where the wave number vector is equal regardless of the propagation direction.

FIG. 14 is a block diagram showing an operation when both ends are open in the nonreciprocal transmission-line-type resonator of FIG. 13 in a case where the wave number vector is equal regardless of the propagation direction. FIG. 15 is a block diagram showing an operation when both ends are short-circuited in the nonreciprocal transmission-line-type resonator of FIG. 13 in a case where the wave number vector is equal regardless of the propagation direction.

In the present performed embodiment of the present invention, a nonreciprocal transmission-line-type microwave resonator that satisfies the Equation (8):

$$\beta_+=-\beta_-\neq 0$$

is proposed. The condition holds in a case where the propagation characteristics of the transmission line become the right-handed transmission (forward wave) in one propagation direction and the left-handed transmission (backward wave) in the backward propagation direction and the magnitude of the propagation constant is equal. Regarding the nonreciprocal right/left handed transmission line proposed previously, this is constructible particularly when the propagation constants in the forward direction and the backward direction have an equal magnitude in the operating band in the case of the transmission band (C) described above (See FIGS. 7 and 8).

As advantageous features of the nonreciprocal transmission-line-type resonator that satisfies the above conditions, there are enumerated the following cases:

(I) the resonance frequency does not depend on the line length (number of cells);

(II) since the wave number vectors of the wave in the forward direction and the wave in the backward direction are directed in an identical direction, standing wave having nodes and bellies as in the conventional case are not generated by the superposition of both of them, and the magnitude of the electromagnetic field distribution becomes constant in the direction of the line length; and (III) paying attention to the phase distribution, a phase change depending on the wave number vector appears on the line.

As described above, there are the advantageous features that the magnitude of the electromagnetic field distribution becomes constant along the transmission line as in the zeroth-order resonator of the prior art reciprocal transmission line, while a phase change can be provided along the line.

Figure 16:
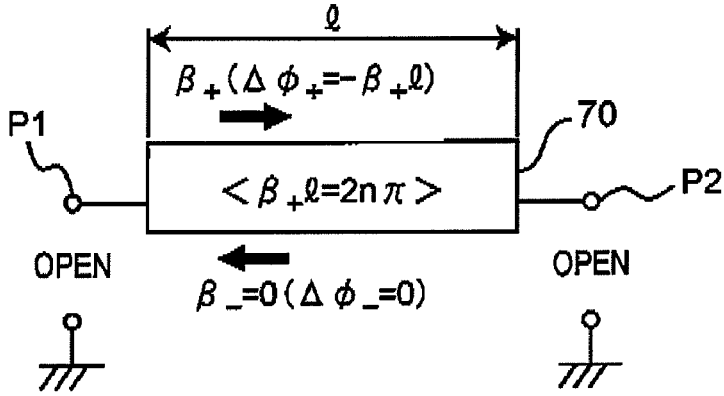
FIG. 16 is a block diagram showing an operation when both ends are open in the nonreciprocal transmission-line-type resonator of FIG. 13 in a case where the guide wavelength is infinite in one propagation direction.
Figure 17:
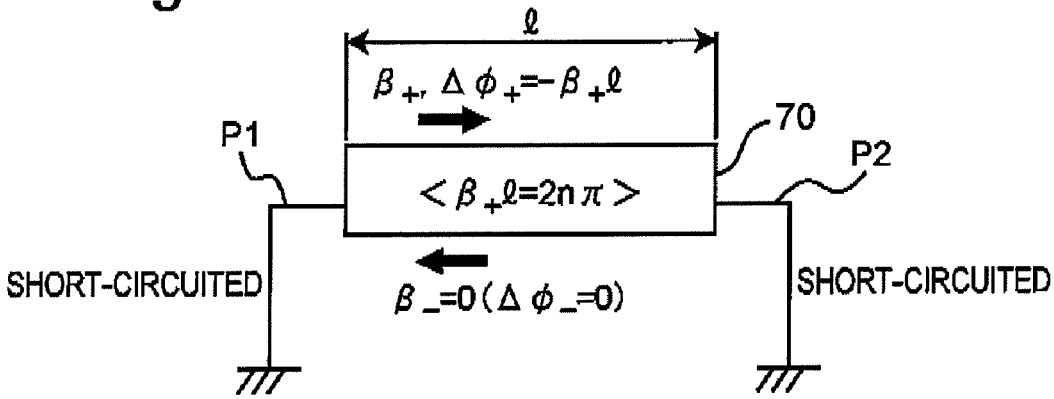
FIG. 17 is a block diagram showing an operation when both ends are short-circuited in the nonreciprocal transmission-line-type resonator of FIG. 13 in a case where the guide wavelength is infinite in one propagation direction.

FIG. 16 is a block diagram showing an operation when both ends are open in the nonreciprocal transmission line type resonator of FIG. 13 in a case where the guide wavelength is infinite in one propagation direction. FIG. 17 is a block diagram showing an operation when both ends are short-circuited in the nonreciprocal transmission line type resonator of FIG. 13 in a case where the guide wavelength is infinite in one propagation direction.

In the nonreciprocal transmission line of the transmission bands (B) and (D) described above, the magnitude of the propagation constant in one of the forward direction and the backward direction becomes zero. In this case, it can be understood that the resonance frequency depends on the line length in each of the cases of the Equations (5) and (7) as in the prior art transmission line type resonator. However, as in the nonreciprocal transmission line type resonator of the present preferred embodiment described above, a nonreciprocal transmission line type microwave resonator that has the following advantageous features can be constituted (See FIGS. 16 and 17):

(I) Since no wave phase change occurs in one propagation direction, standing wave having nodes and bellies as in the conventional case are not generated by superposition of wave in the forward direction and the backward direction, and the magnitude of the electromagnetic field distribution becomes constant in the line length direction.

(II) Paying attention to the phase distribution, a phase change depending on the wave number vector that is not zero appears on the line.

Next, a concrete constitutional example of the nonreciprocal right/left handed line configuration is described below with reference to FIGS. 18 to 34. It is noted that FIGS. 21 to 34 are separately described as second to tenth preferred embodiments.

Figure 18:
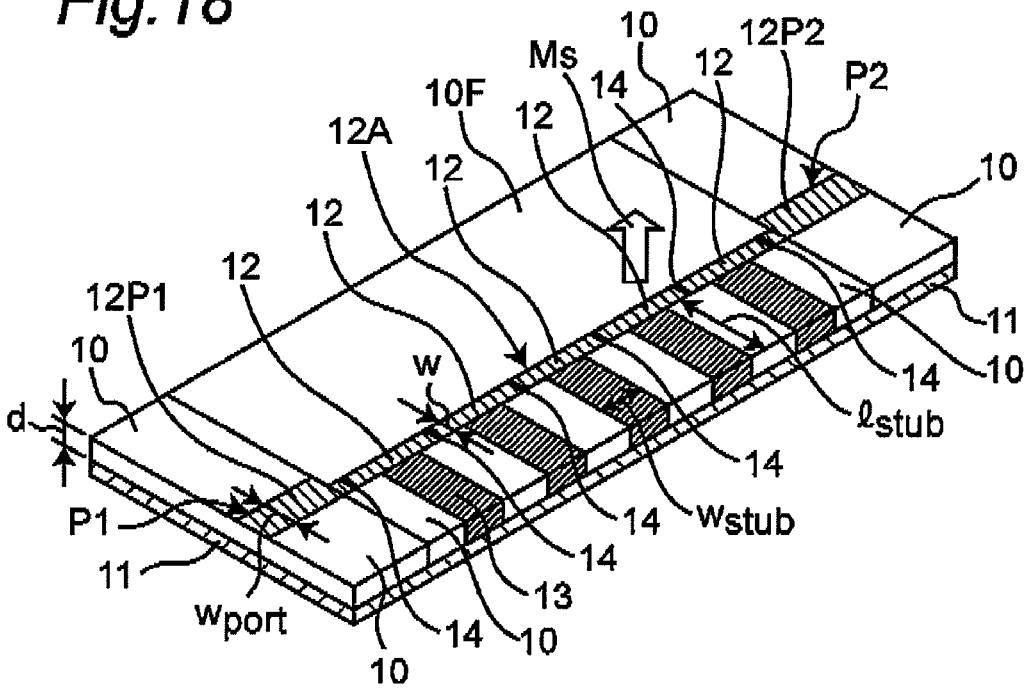
FIG. 18 is a perspective view showing the external appearance of a first example of a nonreciprocal right/left handed transmission line that has a ferrite substrate 10F according to the first preferred embodiment.

FIG. 18 is a perspective view showing the external appearance of a first example of a nonreciprocal right/left handed transmission line that has a ferrite substrate 10F according to the first preferred embodiment. In FIG. 18 is shown the nonreciprocal right/left handed transmission line that utilizes an edge mode of propagation along a microstrip line 12A formed on the ferrite substrate 10F whose structure is asymmetric and perpendicularly magnetized. This case is characterized in that capacitors C of gaps 14 that are lumped element capacitance are formed in a series branch of the transmission line, and short-circuit stub conductors 13 are formed as inductive elements in a shunt branch on the dielectric substrate 10 placed adjacent to the ferrite substrate 10F.

Referring to FIG. 18, the transmission line is constituted by including the following:

(a) a substrate, which is formed by coupling the ferrite substrate 10F that has undergone magnetization Ms caused by spontaneous magnetization or an external magnetic field in a direction perpendicular to the substrate surface with the dielectric substrate 10 made of, for example, glass epoxy resin or the like by their side surfaces at the boundary portion and has a ground conductor 11 on a back surface thereof;

(b) a microstrip line 12A formed on the boundary portion of the substrate;

(c) a plurality of capacitors C, which are formed by separating the microstrip line 12A into a plurality of strip conductors 12 that are line parts of a width w by forming respective gaps 14 and connect mutually adjacent strip conductors 12 of the plurality of strip conductors 12; and (d) a plurality of short-circuit stub conductors 13, which connect each of the strip conductors 12 to the ground conductor 11.

In the transmission line of FIG. 18, six capacitors C are loaded to form a distributed type transmission line of five periods with five short-circuit stub conductors 13 formed. Moreover, the microstrip line 12A is constituted by strip conductors 12 and strip conductors 12P1 and 12P2 (width: $w_{port}$) located at the line ends interposed between the ferrite substrate 10F and the dielectric substrate 10 and the ground conductor 11. Further, the capacitors C may be provided by real capacitors connected between mutually adjacent strip conductors 12 depending on the frequency of an inputted microwave signal or by only the stray capacitance of the gaps 14 as shown in FIG. 18 or by a series capacitance constituted of the stray capacitance of the gaps 14 and capacitors connected in parallel with them. Moreover, the stub length $l_{stub}$ and the formation interval of the short-circuit stub conductors 13 of the width $w_{stub}$ are identical to the period p [mm] of the unit cells.

Figure 19:
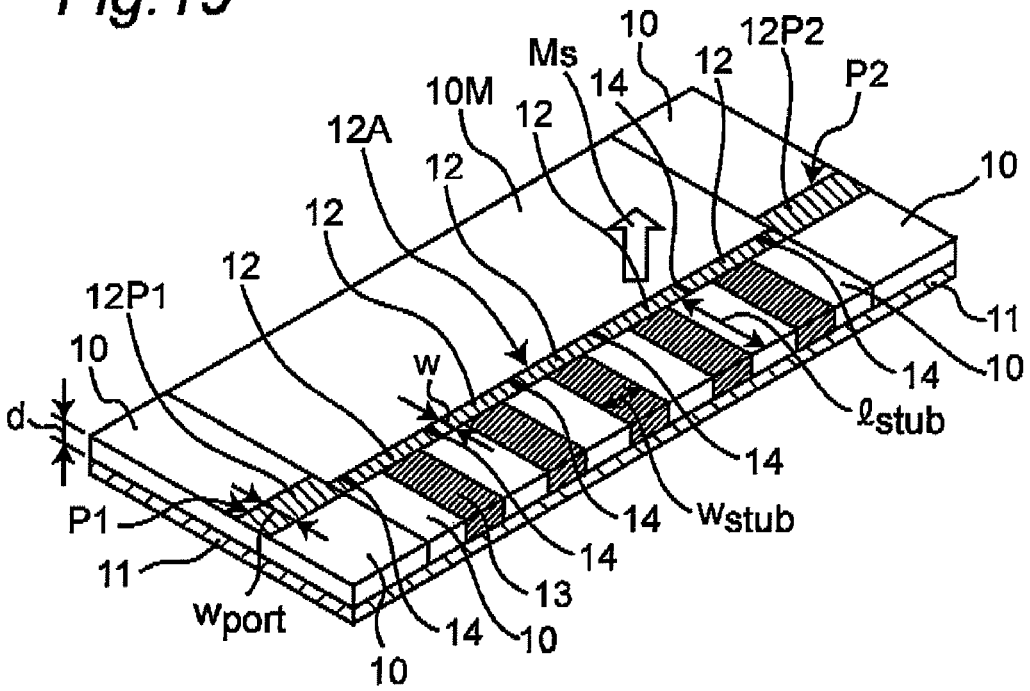
FIG. 19 is a perspective view showing the external appearance of a second example of a non-reciprocal right/left handed transmission line that has a magnetic substrate 10M according to the first preferred embodiment.

FIG. 19 is a perspective view showing the external appearance of a second example of a nonreciprocal right/left handed transmission line that has a magnetic substrate 10M according to the first preferred embodiment. Referring to FIG. 19, the nonreciprocal right/left handed transmission line of the example is characterized in that the magnetic substrate 10M is used in place of the ferrite substrate 10F in comparison with the example of FIG. 18. That is, the nonreciprocal right/left handed transmission line that utilizes the edge mode of propagation along the microstrip line 12A, which has an asymmetric configuration using the magnetic substrate 10M constituted of a magnetic metal fine wire structure of perpendicular magnetization Ms is shown as a transmission line that has a nonreciprocal phase shift phenomenon constituting the unit cells. This case is characterized in that the capacitors C of lumped capacitive elements of gaps 14 are formed on a series branch of the transmission line, and short-circuit stub conductors 13 are formed as inductive elements in a shunt branch on the dielectric substrate 10 placed adjacent to the magnetic substrate 10M.

Figure 20:
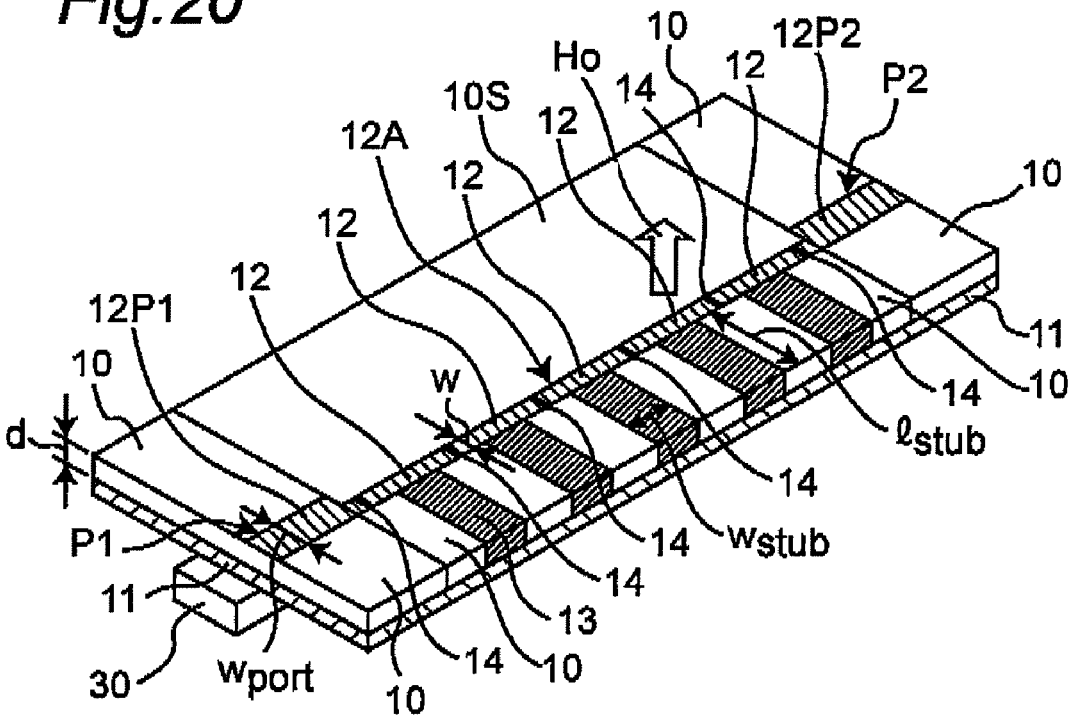
FIG. 20 is a perspective view showing the external appearance of a third example of a nonreciprocal right/left handed transmission line that has a semiconductor substrate 108 according to the first preferred embodiment.

FIG. 20 is a perspective view showing the external appearance of a third example of a nonreciprocal right/left handed transmission line that has a semiconductor substrate 10S according to the first preferred embodiment. Referring to FIG. 20, the nonreciprocal right-handed/left-handed transmission line of the example is characterized in that the semiconductor substrate 10S is used in place of the ferrite substrate 10F and a direct-current magnetic field generator 30 for applying a perpendicular direct-current magnetic field to it is used in comparison with the example of FIG. 18. That is, the nonreciprocal right/left handed transmission line that utilizes the edge mode of propagation along the microstrip line 12A, which has an asymmetric configuration using the semiconductor substrate 10S magnetized by the perpendicular magnetic field $H_0$ by using the direct-current magnetic field generator 30 is shown as a transmission line that has a nonreciprocal phase shift phenomenon constituting the unit cells. This case is characterized in that the capacitors C of lumped capacitive elements of gaps 14 are formed on a series branch of the transmission line, and short-circuit stub conductors 13 are formed as inductive elements in a shunt branch on the dielectric substrate 10 placed adjacent to the semiconductor substrate 10S.

Further, application examples employing the nonreciprocal right/left handed transmission line of the first preferred embodiment is described below. As the application examples, a phase shifter, a leaky wave antenna apparatus and a resonator are described.

The conventional phase shifter has been mainly constituted of a reciprocal transmission line and had same phase lead and same phase lag in bidirectional transmission. Even when a nonreciprocal transmission line is employed, the configuration has been to give a phase lag or a phase lead having mutually different values. By employing the nonreciprocal right/left handed transmission line proposed herein, the following configurations can be provided:

(i) A nonreciprocal phase shifter, which gives a phase lag in the forward direction as the right-handed transmission line and gives a phase lead in the backward direction as the left-handed transmission line.

(ii) A nonreciprocal phase shifter, which has a phase lag in the forward direction as the right-handed transmission line and has no phase change between input and output in the backward direction.

(iii) A nonreciprocal phase shifter, which has a phase lead in the forward direction as the left-handed transmission line and has no phase change between input and output in the backward direction.

(iv) A non-reciprocal phase shifter, which has the right-handed transmission in both the forward direction and the backward direction at an identical frequency and has different phase changes.

(v) A nonreciprocal phase shifter, which has the left-handed transmission in both the forward direction and the backward direction at an identical frequency and has different phase changes.

(vi) A nonreciprocal phase shifter constituted by combining at least two of above (i) to (v).

The operation of the nonreciprocal phase shifter will be described with reference to FIG. 7. In general, the gradient of the dispersion curve represents a group velocity, i.e., the direction of transmitted power, and therefore, forward power transmission can be assumed when $$\frac{\partial \omega}{\partial \beta}$$

is positive, and backward power transmission can be assumed when it is negative.

(a) When the operating frequency is within a domain of $\omega_{LHL}<\omega<\omega_{\beta 0L}$, the propagation constant β has a negative value in the case of the forward power transmission and the propagation constant β has a positive value in the case of the backward power transmission. Therefore, the line operates as the left-handed transmission line in each of the transmission directions. For the above reasons, the line operates as the phase shifter of (v).

(b) In the case of the nonreciprocal transmission line when the operating frequency $\omega=\omega_{\beta 0L}$, the propagation constant in the case of the forward power transmission is zero and the guide wavelength is infinite. On the other hand, in the case of the backward power transmission, the propagation constant is positive, and the line operates as the left-handed transmission line. For the above reasons, the line operates as the phase shifter of (c) In the case of the nonreciprocal transmission line when the operating frequency is within a domain of $\omega_{\beta 0L}<\omega<\omega_{cL}$ or $\omega_{cU}<\omega<\omega_{\beta 0U}$, the propagation constant β has a positive value in the case of the forward power transmission, and the propagation constant β has a positive value in the case of the backward power transmission. Therefore, the line operates as the right-handed transmission line in the forward direction and as the left-handed transmission line in the backward direction. For the above reasons, the line operates as the phase shifter of (i).

(d) In the case of the nonreciprocal transmission line when the operating frequency is $\omega=\omega_{\beta 0U}$, the propagation constant is zero and the guide wavelength is infinite in the case of the backward power transmission. On the other hand, the propagation constant is positive in the case of the forward direction transmission, and the line operates as the right-handed transmission line. For the above reasons, the line operates as the phase shifter of (ii).

(e) In the case of the nonreciprocal transmission line when the operating frequency is within a domain of $\omega_{\beta 0U}<\omega<\omega_{RHU}$, the propagation constant β has a positive value in the case of the forward power transmission, and the propagation constant has a negative value in the case of the backward power transmission. Therefore, the line operates as the right-handed transmission line in each of the transmission directions. For the above reasons, the line operates as the phase shifter of (iv).

By mechanically, electrically, magnetically or optically changing the structural parameters of the nonreciprocal right/left handed transmission line of the present invention, it is possible to continuously change the phase characteristic of the phase shifter that has the characteristic of any one of (i) to (v) at an identical frequency. Further, it is also possible to constitute the phase shifter by combining at least two or more of (i) to (v) in the operation at an identical frequency.

Next, decoupling between different kinds of modes in which the transmitted power is reversed, and the operating frequency and the wave number vector are equal is described below.

If two independent line configurations that support same or different kinds of modes in which the coupling frequency and the propagation constant are almost equal are adjacently relocated, coupling of inherent modes generally occurs, and it is often the case where, in the vicinity of the frequency, an orthogonal mode viewed in the entire system consequently comes to have either one of the following:

(A) two different wave number vectors corresponding to a symmetrical mode and an asymmetric mode, or (B) no existing waveguide mode and a stop band formed (e.g., Bragg (Bragg) reflection in the periodic configuration).

In particular, in the case of (B), hindrance of signal transmission due to the coupling may become a problem. In contrast to above, for the nonreciprocal transmission line of the present invention, it is possible to constitute a single line that supports different kinds of modes in which the operating frequency and the wave number vector are equal without coupling although the power transmission directions are opposite as in the operation when $\omega=\omega_0$ in FIG. 8. It is also possible to change the structural parameters of the nonreciprocal transmission line for coupling between the two modes and to form a stop band. Therefore, it becomes possible to perform switchover between coupling and non-coupling of the two different kinds of modes in which the frequency and the wave number vector are equal by mechanically, electrically, magnetically or optically changing the structural parameters of the nonreciprocal right/left handed transmission line of the present invention although the power transmission direction changes.

Further, a non-reciprocal leaky wave antenna apparatus that employs the nonreciprocal transmission line of the present preferred embodiment is described below.

The line that constitutes the prior art leaky wave antenna apparatus is the reciprocal transmission line, which performs equal forward radiation even for signal transmission in the backward direction when a leaky wave forms a forward radiation beam for signal transmission in the forward direction. Moreover, when the leaky wave forms a backward radiation beam for signal transmission in the forward direction, equal backward radiation is performed for signal transmission in the backward direction. By employing the nonreciprocal right/left handed transmission line of the present invention in the line part that constitutes the leaky wave antenna, the following configurations can be provided:

(i) A nonreciprocal leaky wave antenna apparatus, in which the leaky wave forms a forward radiation beam for the signal that propagates in the forward direction in the line at an identical frequency and forms a backward radiation beam with respect to the backward propagation of the signal.

(ii) A nonreciprocal leaky wave antenna apparatus, in which the leaky wave forms a forward radiation beam for the signal that propagates in the forward direction in the line at an identical frequency and forms a radiation beam on the broadside (referring to a direction orthogonal to the propagation direction, and so forth) with respect to the backward propagation of the signal.

(iii) A nonreciprocal leaky wave antenna apparatus, in which the leaky wave forms a backward radiation beam for a signal that propagates in the forward direction in the line at an identical frequency and forms a radiation beam on the broadside with respect to the backward propagation of the signal.

(iv) A nonreciprocal leaky wave antenna apparatus, in which the radiation beam caused by the leaky wave from the line is directed in an identical direction at an identical frequency regardless of the propagation direction of the signal as a special case of the nonreciprocal leaky wave antenna apparatus of (i).

(v) A nonreciprocal leaky wave antenna apparatus, in which the leaky wave forms a forward radiation beam at an identical frequency regardless of the signal propagation direction in the line, and the angle of radiation changes.

(vi) A nonreciprocal leaky wave antenna apparatus, in which the leaky wave forms a backward radiation beam at an identical frequency regardless of the signal propagation direction in the line, and the angle of radiation changes.

(vii) A nonreciprocal leaky wave antenna apparatus constituted by combining at least two or more of (i) to (vi).

These nonreciprocal leaky wave antenna apparatuses of the present preferred embodiment have the following unique action and advantageous effects:

(A) Scanning and polarization characteristic change are made possible by selecting the signal transmission direction without changing the structural parameters of the line.

Moreover, the prior art leaky wave antenna apparatus has had a problem that the propagation of the reflected wave in the line due to mismatching at the line terminal ends constituting the antenna apparatus disadvantageously forms a side lobe as an unnecessary radiation beam in the direction opposite to the case of the forward propagation. Therefore, a microwave signal is assumed to propagate in one direction in the transmission line, and matching at the line terminal ends is also important in designing the circuit. In contrast to this, the nonreciprocal leaky wave antenna apparatus that employs the nonreciprocal right/left handed transmission line of the present preferred embodiment proposed herein is able to specify the radiation beam direction in an identical direction regardless of the selection of the input terminal in the transmission line and the propagation direction of the microwave signal. As a result, the following unique action and advantageous effects are produced by optimally performing structural designing:

(B) It is made possible to input a signal from both ends of the transmission line that constitutes the antenna apparatus, control the leaky wave radiation beam by bidirectional simultaneous propagation, improve the antenna gain and the directivity and reduce the size.

(C) It is made possible to perform one-terminal inputting, control the radiation main lobe by positively utilizing terminal end reflection, improve the antenna gain and the directivity and reduce the antenna size.

(D) It is made possible to scan the radiation beam by mechanically, electrically, magnetically or optically changing the structural parameters.

Further, a resonator that employs the nonreciprocal transmission line of the present preferred embodiment is described below.

Since the propagation constants in the two modes of propagation in the forward direction and the backward direction are varied in the transmission line that constitutes the resonator, it is possible to make the null point of the electromagnetic field distribution disappear at points excluding the terminal ends. For example, the configuration can be provided when it is undesirable that a null point at which the current wave becomes zero or conversely a position at which the voltage wave becomes a null point exists on the resonator. Moreover, it is also possible to constitute a resonator that has the following advantageous features in special cases:

(A) A transmission line type resonator employing a nonreciprocal transmission line, in which the right-handed transmission is performed in the forward direction and the effective wavelength is infinite and no phase change occurs between input and output in the backward direction at an identical frequency. Although the resonance frequency depends on the line length, the amplitude becomes constant on the line, and a gradient can be given to the phase distribution on the other hand.

(B) A transmission line type resonator employing a nonreciprocal transmission line, in which the left-handed transmission is performed in the forward direction and the effective wavelength is infinite and no phase change occurs between input and output in the backward direction at an identical frequency. Although the resonance frequency depends on the line length, the amplitude becomes constant on the line, and a gradient can be given to the phase distribution on the other hand.

(C) A transmission line type resonator employing a nonreciprocal right/left handed transmission line, in which the wave number vectors in the two modes of propagation in the forward direction and the backward direction are equal to each other at an identical frequency. The resonance frequency does not depend on the line length, the amplitude further becomes constant on the line, and a gradient can be given to the phase distribution.

(D) In any one of the cases of (A) to (C), it is possible to change the phase gradient on the line that constitutes the resonator by mechanically, electrically, magnetically or optically changing the structural parameters.

(E) In general, it is possible to change the resonance frequency by mechanically, electrically, magnetically or optically changing the structural parameters.

FIG. 13 schematically shows a general configuration of the resonator that employs the nonreciprocal right/left handed transmission line of the present preferred embodiment. FIGS. 16 and 17 particularly show a configuration and resonance conditions when the terminal ends located on both sides are concurrently made open or short-circuited in the cases of (A) and (B). As apparent from FIGS. 16 and 17, it can be understood that constant amplitude and a phase gradient are owned on the line constituting the resonator, and the resonance conditions depend on the line length. On the other hand, FIGS. 14 and 15 show a configuration of a resonator in which the terminal ends on both sides are both made open or short-circuited in the case of (C). According to the schematic views, it can be understood that the wave number vectors in the modes of propagation in the forward direction and the backward direction become equal regardless of the transmission direction, and the resonance condition can be automatically satisfied regardless of the line length.

Second Preferred Embodiment

Figure 21:
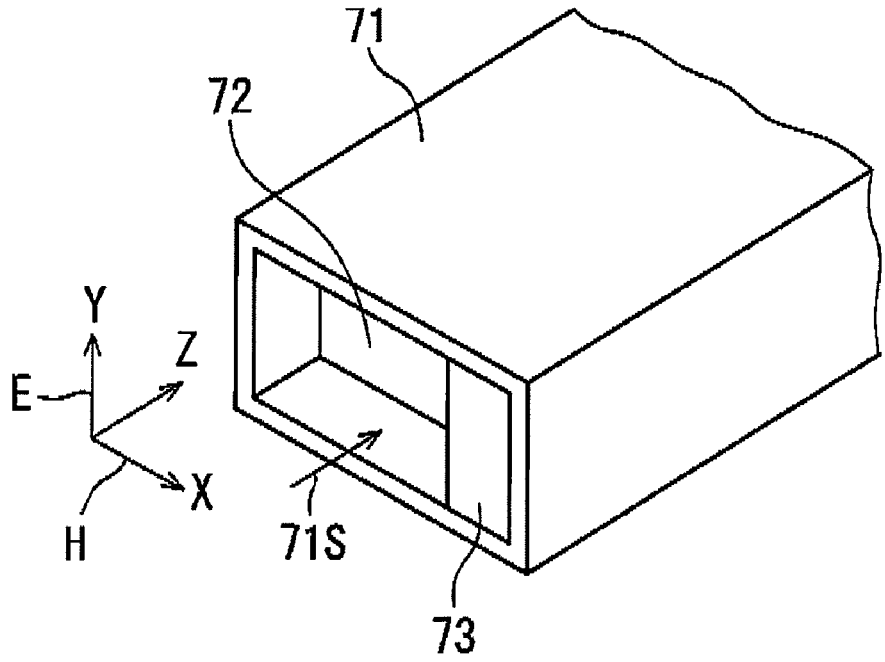
FIG. 21 is a perspective view showing the external appearance of a nonreciprocal right/left handed transmission line constituted by a rectangular waveguide 71 according to a second preferred embodiment of the present invention.
Figure 22:
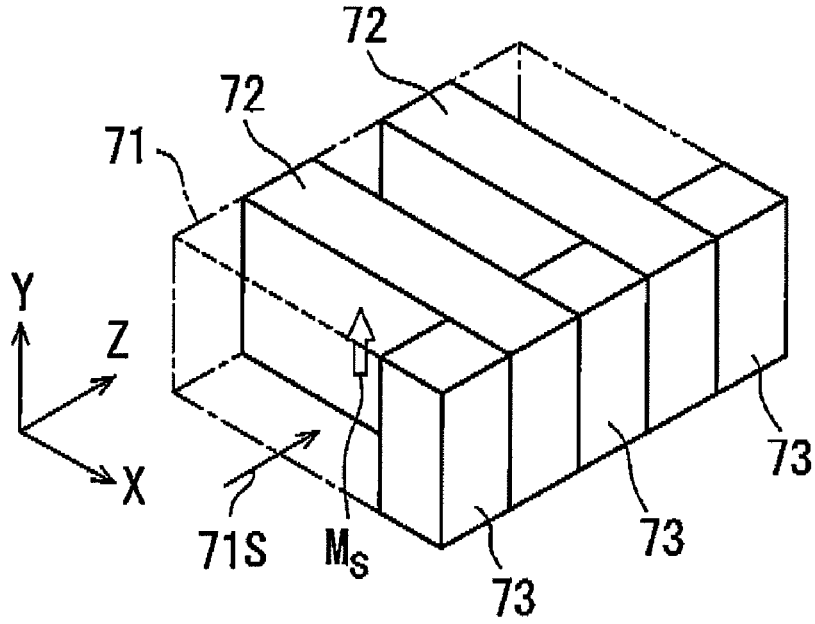
FIG. 22 is a perspective view showing the internal structure (when the rectangular waveguide 71 is removed) of the nonreciprocal right/left handed transmission line of FIG. 21.

FIG. 21 is a perspective view showing the external appearance of a nonreciprocal right/left handed transmission line constituted by a rectangular waveguide 71 according to the second preferred embodiment of the present invention. FIG. 22 is a perspective view showing the internal structure (when the rectangular waveguide 71 is removed) of the nonreciprocal right/left handed transmission line of FIG. 21.

FIGS. 21 and 22 show a transmission line that utilizes the waveguide mode stuffed with ferrite magnetized in the transverse direction having an asymmetric configuration as a transmission line that has a nonreciprocal phase shift phenomenon constituting the unit cell. In this case, an asymmetric rectangular waveguide is constituted of the rectangular waveguide 71 and metal parts 73, and so forth. The effective permeability in the TE mode of the electromagnetic wave propagating in the line structure also plays the role of a capacitive element inserted in the series branch circuit of the transmission line model since it becomes negative in the vicinity of the magnetic resonant frequency. Moreover, the waveguide TE mode of a cavity or a stuffed dielectric becomes a line structure in which an inductive element is inserted in the shunt branch circuit since the effective permittivity becomes negative at the cutoff frequency. By combining both the characteristics to arrange ferrite parts 72 that have undergone magnetization Ms in the Y direction and air gap portions (or dielectric regions) repetitively at predetermined periods inside the unit cell constituted of an asymmetric rectangular waveguide 71 that has the metal parts 73 in a portion located partially on, for example, the right-hand side seen from an opening plane 71S so that they are cascade-connected, the nonreciprocal right/left handed transmission line is constituted.

Third Preferred Embodiment

Figure 23:
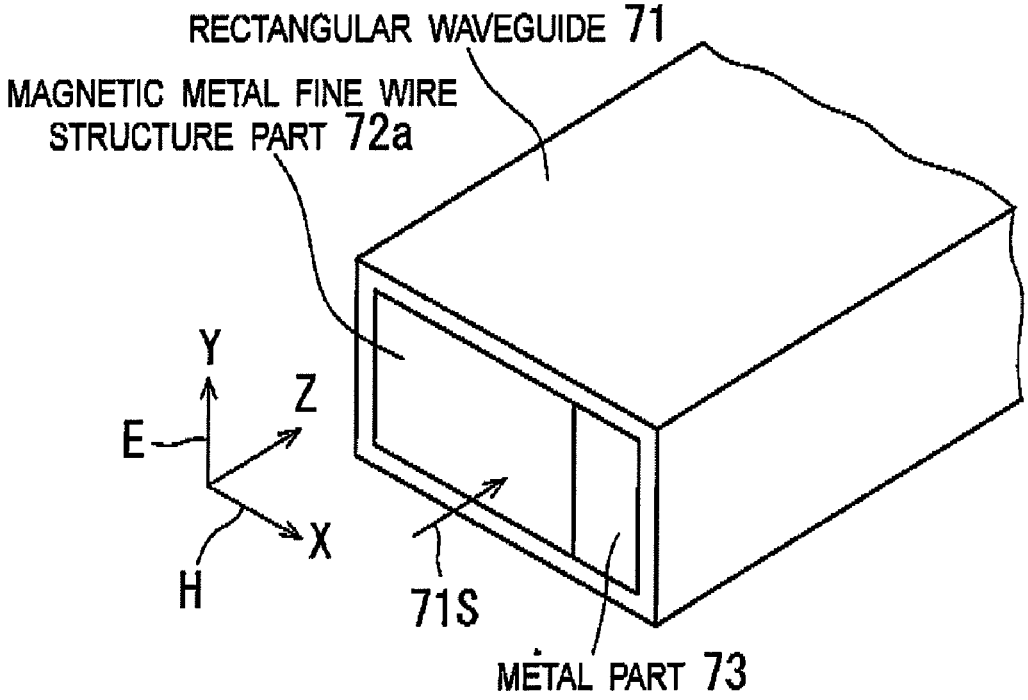
FIG. 23 is a perspective view showing the external appearance of a nonreciprocal right/left handed transmission line constituted by a rectangular waveguide 71 according to a third preferred embodiment of the present invention.
Figure 24:
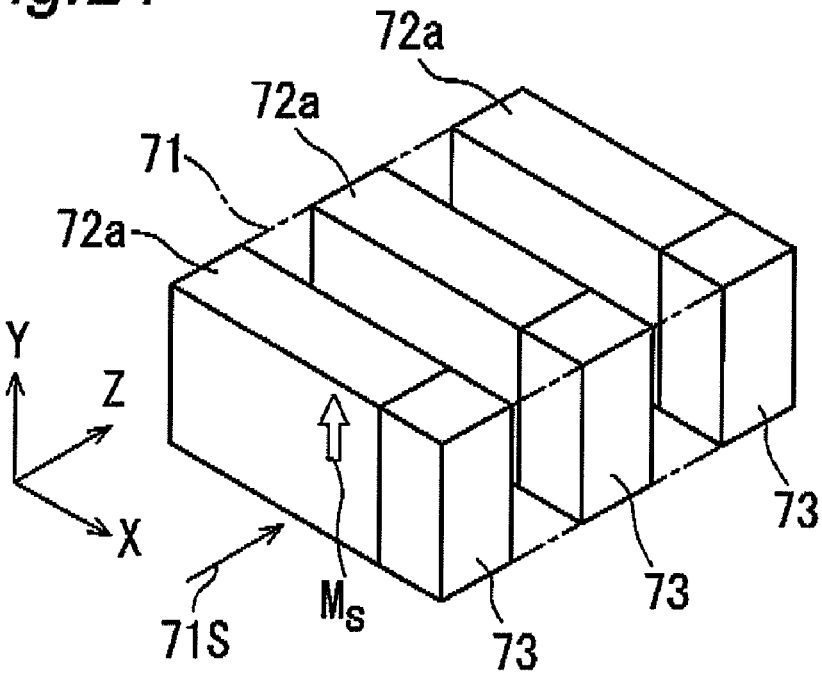
FIG. 24 is a perspective view showing the internal structure (when the rectangular waveguide 71 is removed) of the nonreciprocal right/left handed transmission line of FIG. 23.

FIG. 23 is a perspective view showing the external appearance of a non-reciprocal right/left handed transmission line constituted by a rectangular waveguide 71 according to a third preferred embodiment of the present invention. FIG. 24 is a perspective view showing the internal structure (when the rectangular waveguide 71 is removed) of the nonreciprocal right/left handed transmission line of FIG. 23.

In FIGS. 23 and 24 is shown a transmission line that utilizes an asymmetric waveguide mode of a configuration stuffed with an artificial medium constituted of magnetic metal fine wire structure parts 72*a* that have undergone magnetization Ms in the Y direction and metal parts 73 as a transmission line that has a nonreciprocal phase shift phenomenon constituting the unit cell. In this case, the effective permeability of the line structure also plays the role of a capacitive element inserted in the series branch circuit in the transmission line model since it becomes negative in the vicinity of the magnetic resonant frequency. Moreover, the waveguide TE mode of a cavity including no magnetic material or a stuffed dielectric becomes a line structure in which an inductive element is inserted in the shunt branch circuit since the effective permittivity becomes negative at the cutoff frequency. By combining both the characteristics to arrange the magnetic metal fine wire structure parts 72*a* and air gap portions (or dielectric regions) alternately at predetermined periods inside the unit cell constituted of an asymmetric rectangular waveguide 71 that has the metal parts 73 in a portion located partially on, for example, the right-hand side seen from the opening plane 71S, the nonreciprocal right/left handed transmission line is constituted.

Fourth Preferred Embodiment

Figure 25:
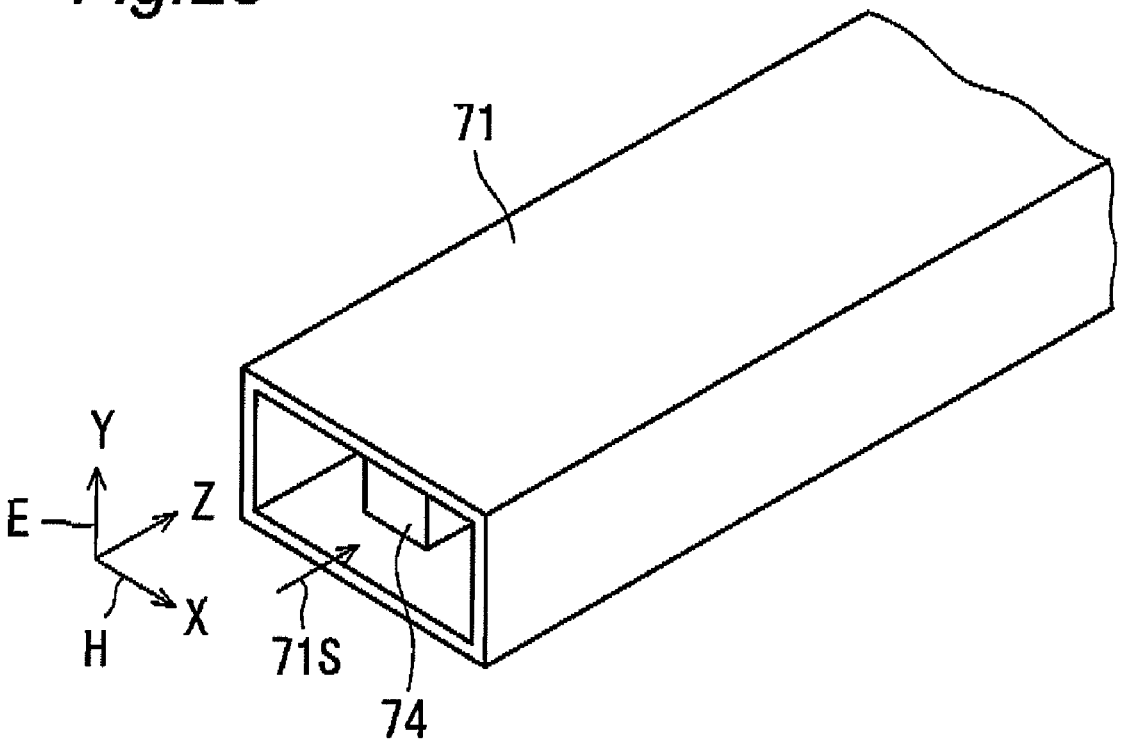
FIG. 25 is a perspective view showing the external appearance of a nonreciprocal right/left handed transmission line constituted by a rectangular waveguide 71 according to a fourth preferred embodiment of the present invention.
Figure 26:
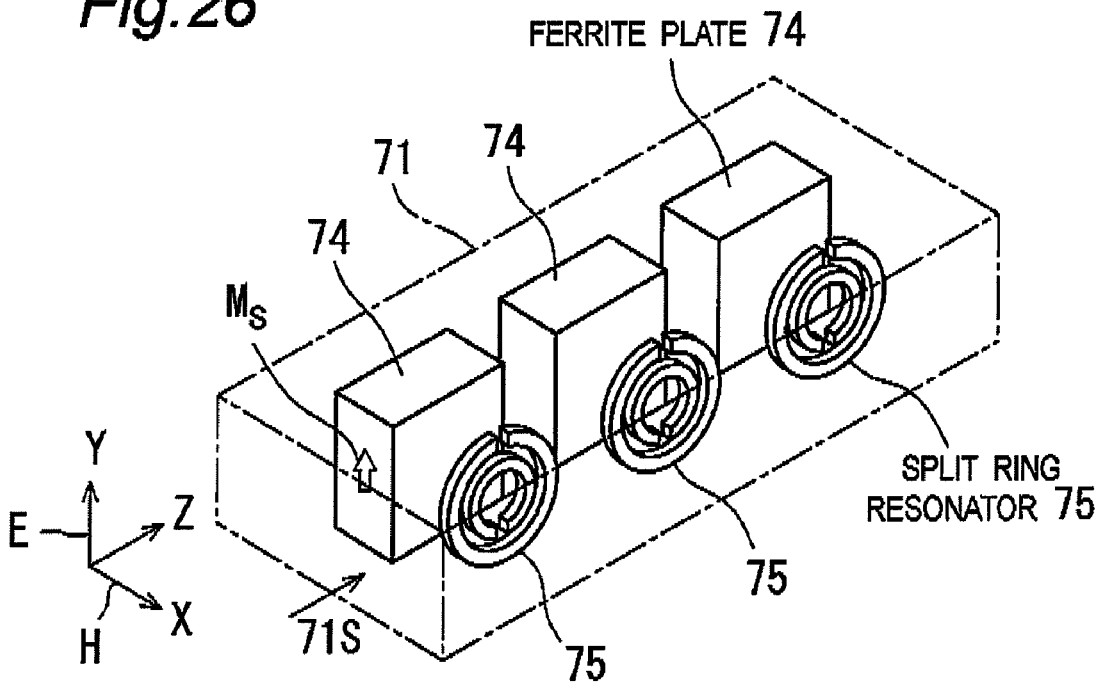
FIG. 26 is a perspective view showing the internal structure (when the rectangular waveguide 71 is removed) of the nonreciprocal right/left handed transmission line of FIG. 25.

FIG. 25 is a perspective view showing the external appearance of a nonreciprocal right/left handed transmission line constituted by a rectangular waveguide 71 according to a fourth preferred embodiment of the present invention. FIG. 26 is a perspective view showing the internal structure (when the rectangular waveguide 71 is removed) of the nonreciprocal right/left handed transmission line of FIG. 25.

Referring to FIGS. 25 and 26, ferrite plates 74 that have undergone magnetization Ms in the perpendicular direction are arranged so that the plate planes thereof are parallel to the YZ plane of the rectangular waveguide 71 and inserted repetitively periodically in the propagation direction (Z direction) of the electromagnetic wave in the rectangular waveguide 71 that has a TE cutoff mode, and split ring resonators 75 (or spiral resonators) are inserted upright on one side in the transverse direction so as to face the respective ferrite plates 74. Although not shown in the figures, the split ring resonators 75 are provided upright supported by a dielectric substrate or the like. The electric field direction (Y direction) of the electromagnetic wave and the direction of magnetization Ms in the ferrite plates 74 are directed almost in an identical direction. It is noted that the split ring resonators 75 are arranged so that the axial direction of the split ring resonators 75 are almost parallel to the transverse direction components of the magnetic field of the electromagnetic wave.

Fifth Preferred Embodiment

Figure 27:
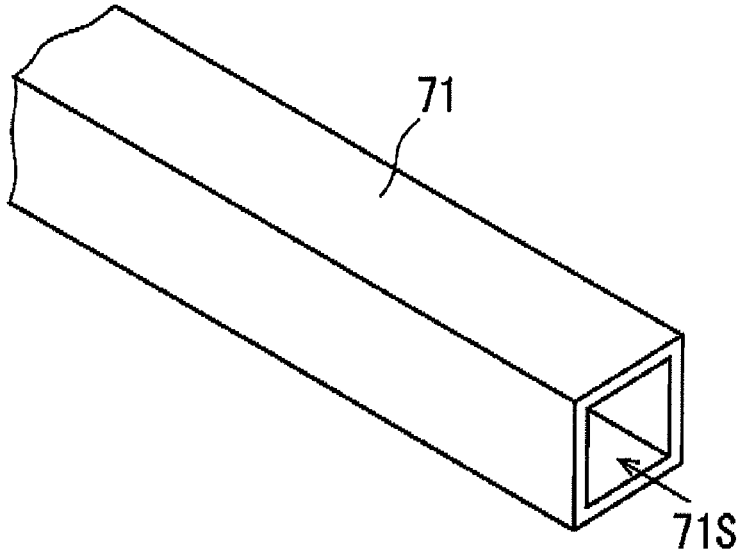
FIG. 27 is a perspective view showing the external appearance of a nonreciprocal right/left handed transmission line constituted by a rectangular waveguide 71 according to a fifth preferred embodiment of the present invention.
Figure 28:
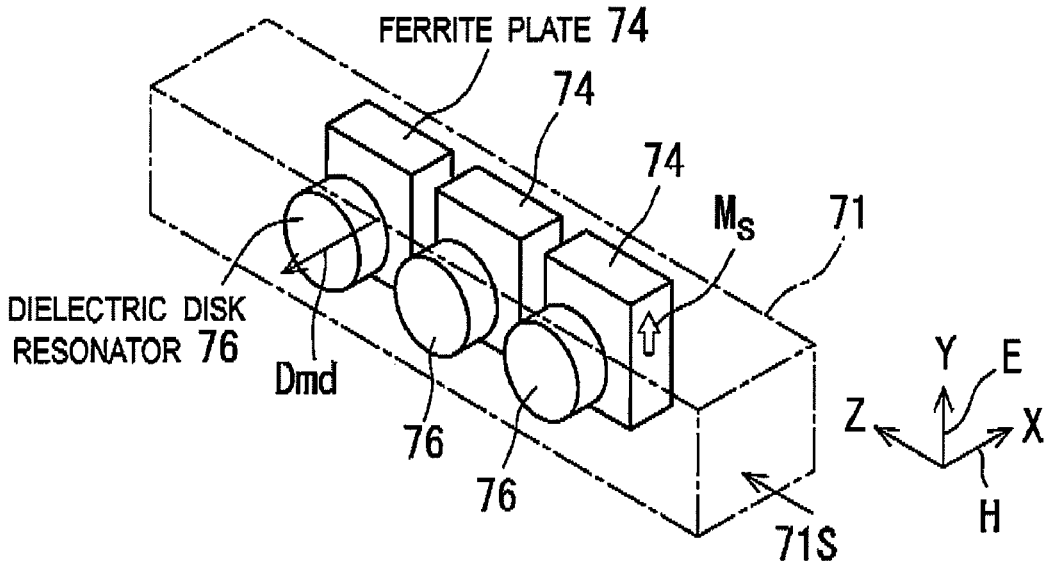
FIG. 28 is a perspective view showing the internal structure (when the rectangular waveguide 71 is removed) of the nonreciprocal right/left handed transmission line of FIG. 27.

FIG. 27 is a perspective view showing the external appearance of a nonreciprocal right/left handed transmission line constituted by a rectangular waveguide 71 according to a fifth preferred embodiment of the present invention. FIG. 28 is a perspective view showing the internal structure (when the rectangular waveguide 71 is removed) of the nonreciprocal right/left handed transmission line of FIG. 27.

Referring to FIGS. 27 and 28, the transmission line of the present preferred embodiment is characterized in that the split ring resonators 75 of FIG. 26 are replaced by dielectric resonators 76 in comparison with the transmission line of FIG. 26. In the present preferred embodiment, ferrite plates 74 that have undergone perpendicular magnetization Ms are arranged repetitively inserted in the propagation direction of the electromagnetic wave in the rectangular waveguide 71 that has the TE cutoff mode, and dielectric disk resonators 76 are arranged periodically inserted in one transverse direction so as to face the respective ferrite plates 74. Although not shown in the figures, the dielectric disk resonators 76 are provided upright supported on a dielectric substrate of a low dielectric constant, a background medium or the like. It is noted that the electric field direction (Y direction) of the electromagnetic wave and the direction of magnetization Ms in the ferrite plates 74 are directed almost in an identical direction.

Moreover, in FIG. 28, Dmd shows a direction of magnetic dipoles caused by the dielectric disk resonators 76, and so forth in the following figures. In the present preferred embodiment, the shape of the dielectric resonator or the axial direction of the structure is not important, but it is important that an electromagnetic field distribution framed by the dielectric disk resonators 76 forms the magnetic dipoles in a magnetic resonance state and the direction Dmd of the dipoles is oriented almost parallel to the transverse direction component of the magnetic field of the electromagnetic wave.

The present inventor has confirmed that the configuration of FIGS. 27 and 28 constitutes the right-handed transmission line in the forward direction and the left-handed transmission line in the backward direction by simple numerical calculation results.

Figure 29:
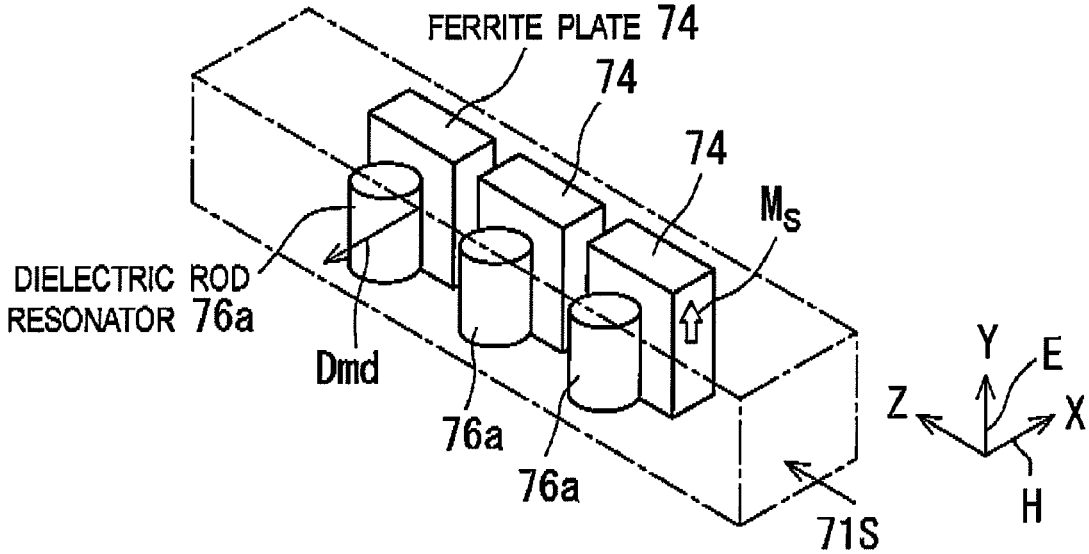
FIG. 29 is a perspective view showing the internal structure (when the rectangular waveguide 71 is removed) of a nonreciprocal right/left handed transmission line constituted by a rectangular waveguide 71 according to a modified preferred embodiment of the fifth preferred embodiment of the present invention.

FIG. 29 is a perspective view showing the internal structure (when the rectangular waveguide 71 is removed) of a nonreciprocal right/left handed transmission line constituted by a rectangular waveguide 71 according to a modified preferred embodiment of the fifth preferred embodiment of the present invention. The transmission line of FIG. 29 is characterized in that dielectric rod resonators 76*a* are provided in place of the dielectric disk resonators 76 in comparison with the transmission line of FIG. 28, and the other configuration is similar to above.

Sixth Preferred Embodiment

Figure 30:
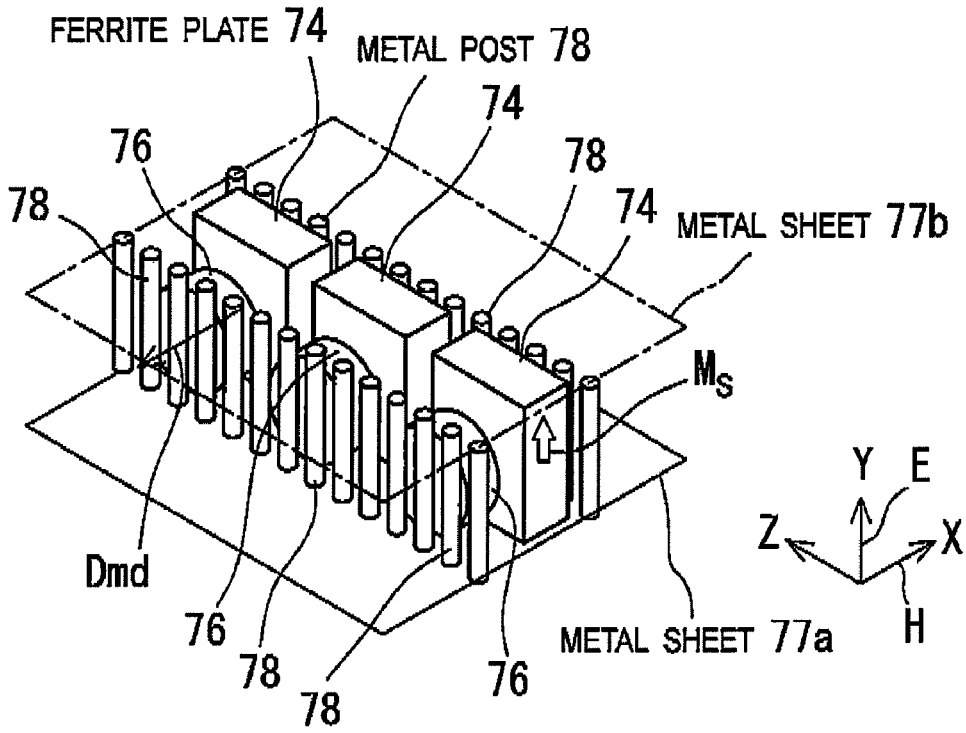
FIG. 30 is a perspective view showing the internal structure (when the metal sheet 77*b* (indicated by the dash dot line) located on the upper side is removed) of a nonreciprocal right/left handed transmission line constituted by a dielectric transmission line constituted of one pair of metal sheets 77*a* and 77*b* according to a sixth preferred embodiment of the present invention.

FIG. 30 is a perspective view showing the internal structure (when the metal sheet 77*b* (indicated by the dash dot line) located on the upper side is removed) of a nonreciprocal right/left handed transmission line constituted by a dielectric transmission line constituted of one pair of metal sheets 77*a* and 77*b* according to a sixth preferred embodiment of the present invention. In FIG. 30 is shown a dielectric transmission line in which two side walls are formed by inserting a plurality of metal posts 78 into air gaps (or dielectric substrate) of which the upper and lower surfaces are covered with the metal sheets 77*a* and 77*b* on both sides in the X direction of the ferrite plates 74 and the dielectric disk resonators 76 of FIG. 28 as a one having the operation similar to that of the rectangular waveguide 71 that has the TE cutoff mode of FIG. 28 in place of the rectangular waveguide 71.

Seventh Preferred Embodiment

Figure 31:
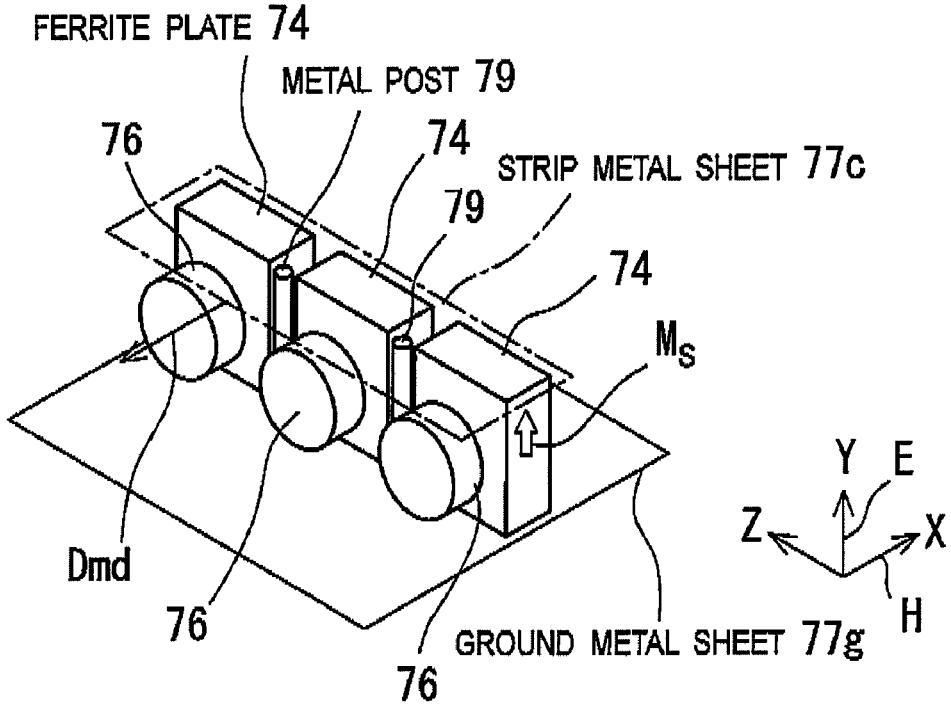
FIG. 31 is a perspective view showing the internal structure (when the strip metal sheet 77*c* (indicated by the dash dot line) located on the upper side is removed) of a nonreciprocal right/left handed transmission line constituted by a strip dielectric transmission line constituted of a strip metal sheet 77*c* and a ground metal sheet 77*g* according to a seventh preferred embodiment of the present invention.

FIG. 31 is a perspective view showing the internal structure (when the strip metal sheet 77*c* (indicated by the dash dot line) located on the upper side is removed) of a nonreciprocal right/left handed transmission line constituted by a strip dielectric transmission line constituted of a strip metal sheet 77*c* and a ground metal sheet 77*g* according to a seventh preferred embodiment of the present invention. Referring to FIG. 31, the components used in the rectangular waveguide 71 of FIG. 28 are all inserted as they are between the strip metal sheet 77*c* and the ground metal sheet 77*g* that constitute a microstrip line, and short-circuit stubs of metal posts 79 provided upright inserted between the ferrite plates 74 are further used instead of using the rectangular waveguide 71 of the TE cutoff mode as a configuration for making the effective permittivity negative.

Eighth Preferred Embodiment

Figure 32:
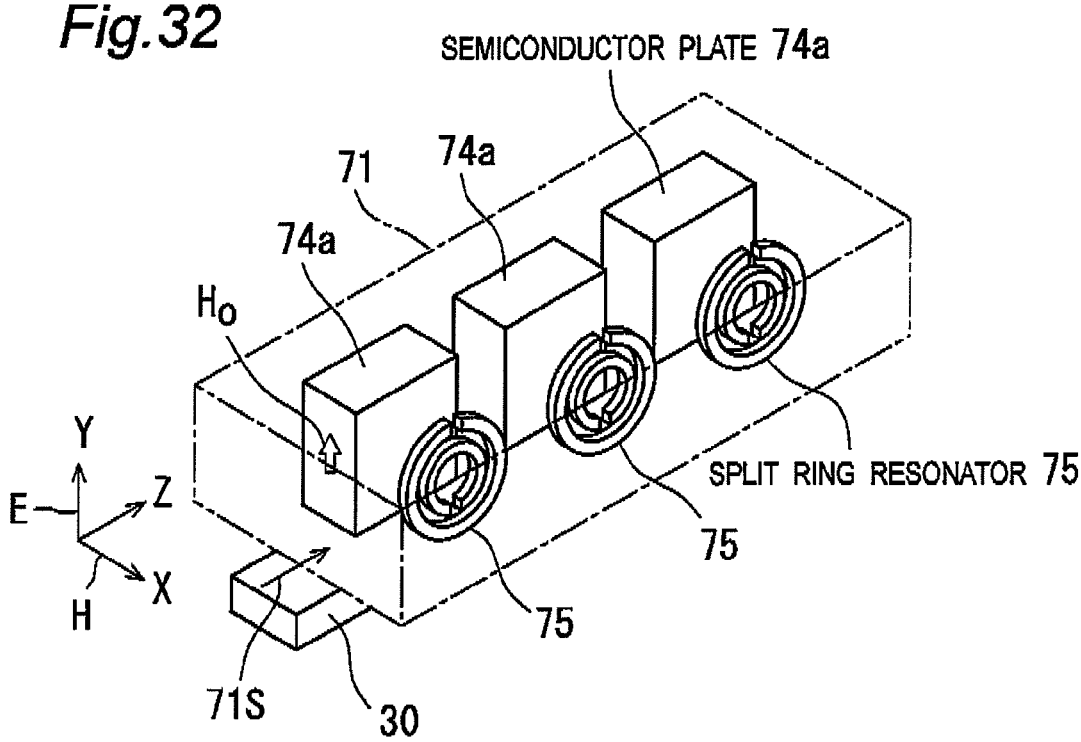
FIG. 32 is a perspective view showing the internal structure (when the rectangular waveguide 71 is removed) of a nonreciprocal right/left handed transmission line constituted by a rectangular waveguide 71 according to a modified preferred embodiment of an eighth preferred embodiment of the present invention.

FIG. 32 is a perspective view showing the internal structure (when the rectangular waveguide 71 is removed) of a nonreciprocal right/left handed transmission line constituted by a rectangular waveguide 71 according to a modified preferred embodiment of an eighth preferred embodiment of the present invention. Referring to FIG. 32, the transmission line of the present preferred embodiment is characterized in that the ferrite plates 74 of FIG. 26 are replaced by semiconductor plates 74*a*, and a direct-current magnetic field generator 30 that applies a magnetic field $H_0$ in the perpendicular direction to the semiconductor plates 74*a* from the outside of the rectangular waveguide 71 is provided under the rectangular waveguide 71.

Ninth Preferred Embodiment

Figure 33:
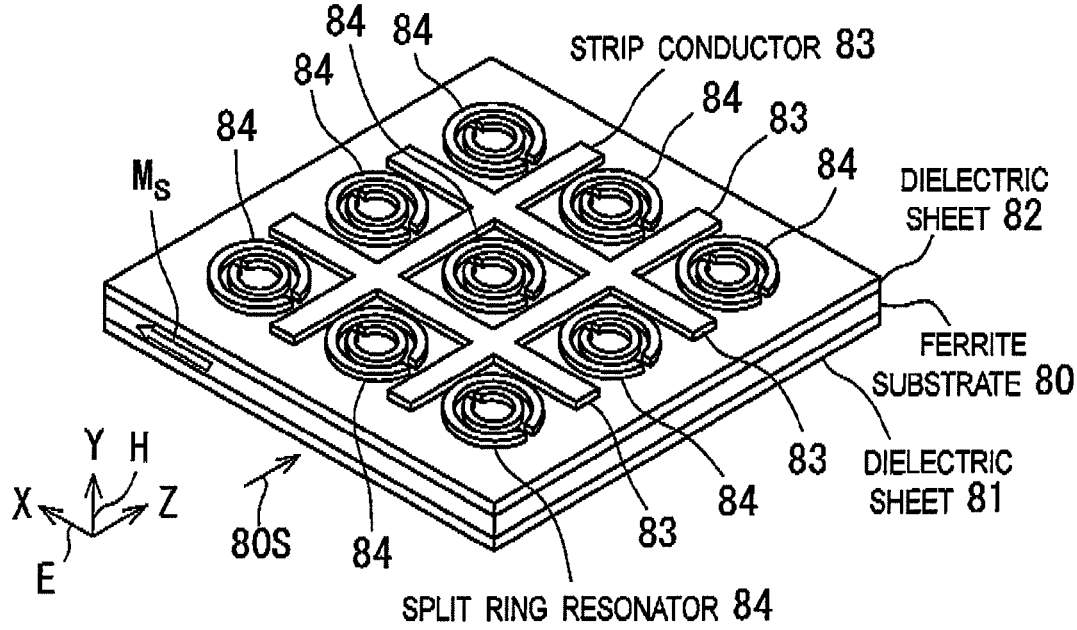
FIG. 33 is a perspective view showing the external appearance of a nonreciprocal right/left handed transmission line constituted by a ferrite-dielectric transmission line in which a metallic mesh-shaped strip conductor 83 is formed on a line substrate provided by interposing a ferrite substrate 80 between one pair of dielectric sheets 81 and 82 according to a ninth preferred embodiment of the present invention.

FIG. 33 is a perspective view showing the external appearance of a nonreciprocal right/left handed transmission line constituted by a ferrite-dielectric transmission line in which a metallic mesh shaped strip conductor 83 is formed on a line substrate provided by interposing a ferrite substrate 80 between one pair of dielectric sheets 81 and 82 according to a ninth preferred embodiment of the present invention.

Referring to FIG. 33, a transmission line is constituted by arranging split ring resonators 84 constituted as a two-dimensional configuration in an identical plane and a strip conductor 83 of a metal mesh shape formed around them parallel to a ferrite substrate 80 interposed between one pair of dielectric sheets 81 and 82 and on the upper side of the substrate. In the example, a case where a dielectric sheet 82 (or a gap may be used) is provided between the strip conductor 83 and the ferrite substrate 80 is shown. On the other hand, under the ferrite substrate 80, any one of the following is arranged so as to be in parallel:

(1) a metal film, which includes only the strip conductors 83 of a metal mesh shape constituted as a two-dimensional configuration;

(2) a metal film, which includes only the split ring resonators 84 constituted as a two-dimensional configuration; and (3) a metal film, which includes the strip conductors 83 and the split ring resonators 84 of a mesh shape that have a size different from that of the metal film on the upper side, giving asymmetricity to the line structure. A gap 81 is provided between the lower metal film and the ferrite substrate 80, and the ferrite substrate 80 has a magnetization vector Ms in a direction parallel to the surface. In this case, the magnetization vector Ms and the electric field component of the incident electromagnetic wave are directed almost in an identical direction in arrangement. In FIG. 33, 80S denotes the incident direction of a microwave signal to the transmission line, and so forth.

It is also possible to use one-dimensional configuration as the inserted metal film of FIG. 33, and in this case, it may be acceptable to arrange the split ring resonators 84 and the metal fine wires alternately in the propagation direction of the electromagnetic wave so that the metal fine wires are formed arranged in a direction almost parallel to the electric field vector. Moreover, although the ferrite substrate 80 that has the magnetization Ms generated by spontaneous magnetization or an external magnetic field is used in FIG. 33, the present invention is not limited to this, and a dielectric substrate magnetized by the external magnetic field may be used.

Tenth Preferred Embodiment

Figure 34:
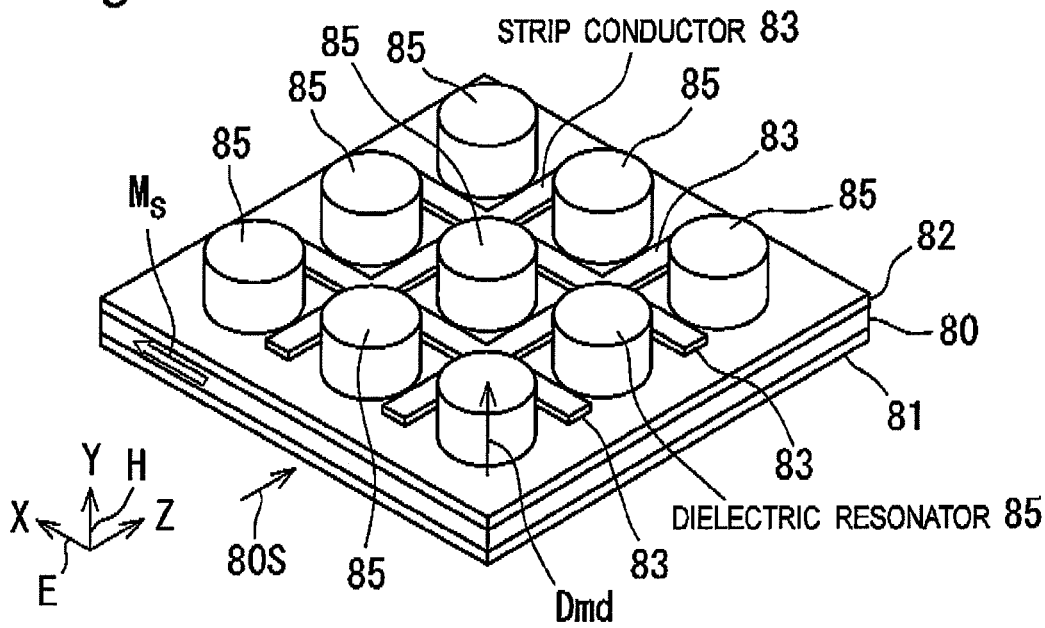
FIG. 34 is a perspective view showing the external appearance of a nonreciprocal right/left handed transmission line constituted by a ferrite-dielectric transmission line in which a metallic mesh-shaped strip conductor 83 and dielectric resonators 85 are formed on a line substrate provided by interposing a ferrite substrate 80 between one pair of dielectric sheets 81 and 82 according to a tenth preferred embodiment of the present invention.

FIG. 34 is a perspective view showing the external appearance of a non-reciprocal right/left handed transmission line constituted by a ferrite-dielectric transmission line in which a metallic mesh-shaped strip conductor 83 and dielectric resonators 85 are formed on a line substrate provided by interposing a ferrite substrate 80 between one pair of dielectric sheets 81 and 82 according to a tenth preferred embodiment of the present invention. Referring to FIG. 34, the present preferred embodiment is characterized in that the dielectric resonators 85 are used in place of the split ring resonators 84 of FIG. 34 in comparison with the transmission line of FIG. 33, and the other configuration is similar to above. Although the case of a dielectric disk resonator is shown as the dielectric resonators 85 in FIG. 34, the shape or nor the axial direction itself of the configuration is not important, but it is important that an electromagnetic field distribution generated by the resonator forms a magnetic dipole in a magnetic resonance state and the direction of the dipole is oriented almost parallel to the transverse direction component of the magnetic field of the electromagnetic wave.

Eleventh and Twelfth Preferred Embodiments

Figure 35:
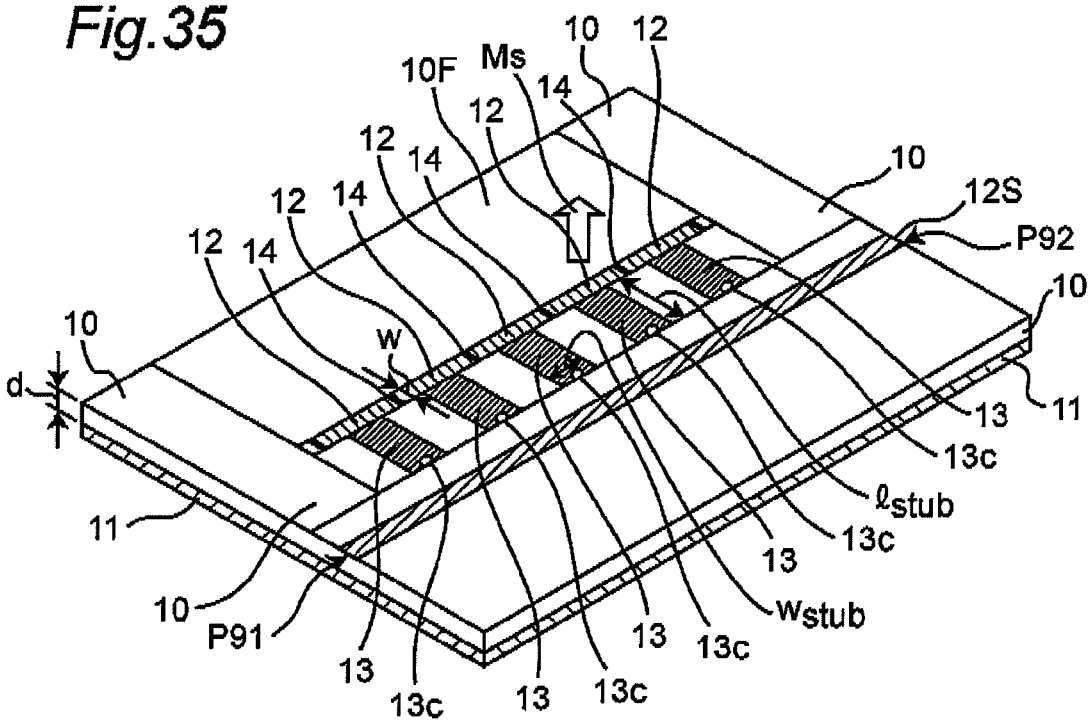
FIG. 35 is a perspective view showing the external appearance of a band-stop filter that employs the ladder-type nonreciprocal right/left handed transmission line of the first preferred embodiment according to an eleventh preferred embodiment of the present invention.
Figure 36:
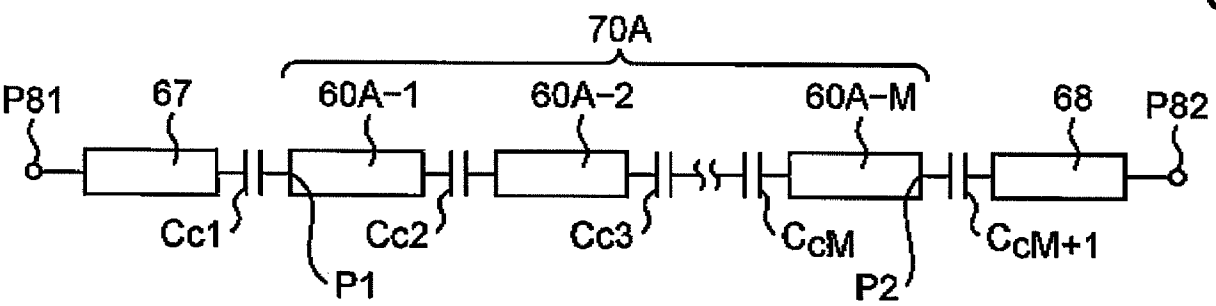
FIG. 36 is a block diagram showing a configuration of a band-pass filter that employs the ladder-type nonreciprocal right/left handed transmission line of the first preferred embodiment according to a twelfth preferred embodiment of the present invention.

FIG. 35 is a perspective view showing the external appearance of a band-stop filter that employs the ladder type nonreciprocal right/left handed transmission line of the first preferred embodiment according to an eleventh preferred embodiment of the present invention. FIG. 36 is a block diagram showing a configuration of a band-pass filter that employs the ladder type nonreciprocal right/left handed transmission line of the first preferred embodiment according to a twelfth preferred embodiment of the present invention.

By coupling at least one or more nonreciprocal resonators and a power feeding transmission line at an edge or a side as a filter that employs the nonreciprocal transmission line type resonator of the present preferred embodiment as in the prior art filter that employs the transmission line type resonator, the following filters can be constituted:

(i) A filter including a transmission line type resonator that employs a nonreciprocal transmission line in which the right-handed transmission is performed in the forward direction, the effective wavelength is infinite and no phase change occurs between input and output in the backward direction at an identical frequency.

(ii) A filter including a transmission line type resonator that employs a nonreciprocal transmission line in which the left-handed transmission is performed in the forward direction, the effective wavelength is infinite and no phase change occurs between input and output in the backward direction at an identical frequency.

(iii) A filter including a transmission line type resonator that employs a nonreciprocal right/left handed transmission line in which the wave number vectors in the two modes of propagation in the forward direction and the backward direction are equal to each other.

These filters, which have an advantageous feature that the amplitude becomes constant on the transmission line type resonator that constitutes the filter, therefore have neither null point of current nor null point of voltage also depending on the terminal conditions in comparison with the standing wave that have nodes and bellies in the voltage and current distributions as in the prior art resonator, allowing the configuration of a higher degree of freedom to be achieved.

FIG. 35 shows one example of a nonreciprocal transmission line type resonator that employs the nonreciprocal transmission line of FIG. 18 and a band-stop filter constituted of a power feeding transmission line. In this case, the power feeding transmission line is a microstrip line 12S that has two ports P91 and P92 formed on a dielectric substrate 10 and is placed spaced apart by a predetermined interval on the stub conductor 13 side of the nonreciprocal transmission line of FIG. 18 so as to be electromagnetically side-coupled with the resonator. It is noted that each stub conductor 13 is connected to the ground conductor 11 via through hole conductors 13*c* that penetrate the dielectric substrate 10 in the thickness direction. With the above configuration, a band-stop filter including the two ports P91 and P92 can be constituted. It is noted that port strip conductors 12P1 and 12P2 and so on are removed in FIG. 35.

Figure 66:
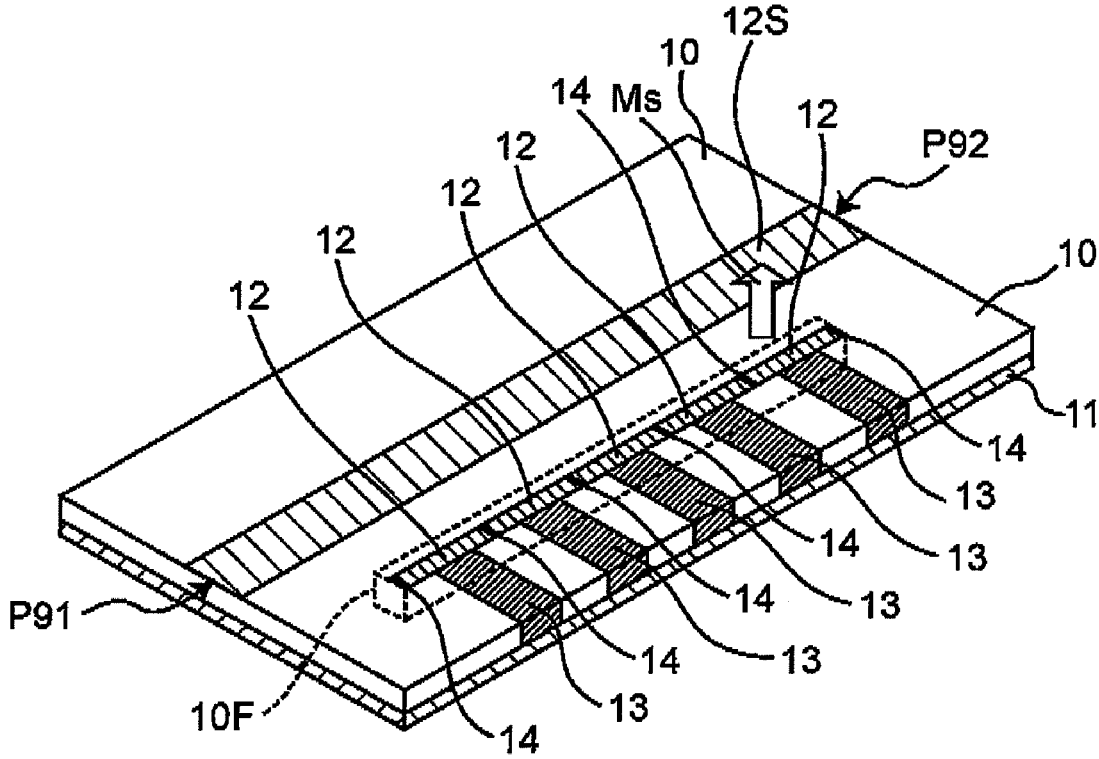
FIG. 66 is a perspective view showing the external appearance of a band-stop filter that employs the ladder-type nonreciprocal right/left handed transmission line of the first preferred embodiment according to a first modified preferred embodiment of the eleventh preferred embodiment of the present invention.

FIG. 66 is a perspective view showing the external appearance of a band-stop filter that employs the ladder type nonreciprocal right/left handed transmission line of the first preferred embodiment according to a first modified preferred embodiment of the eleventh preferred embodiment of the present invention. The band-stop filter of FIG. 66 is characterized in that the microstrip line 12S having the two ports P91 and P92 is provided on the strip conductor 12 side along the lengthwise direction of the microstrip line 12S of the strip conductors 12 in comparison with the band-stop filter of FIG. 35. This has a structure in which a ferrite substrate 10F is partially embedded in a portion located just below the strip conductor 12 in the dielectric substrate 10 placed on the ground conductor 11. The ferrite substrate 10F is magnetized perpendicularly to the substrate surface, and a nonreciprocal right/left handed transmission line of a limited number of cells (five cells in FIG. 66) constitutes a resonator in a state in which both ends are open on the ferrite substrate 10F. By placing the transmission line type resonator parallel and adjacent to the microstrip line 12S constituted on the dielectric substrate 10, the resonator exploits energy from the microwave signal that is propagating along the microstrip line 12S in the vicinity of the resonant frequency and operates as a band-stop filter.

Figure 67:
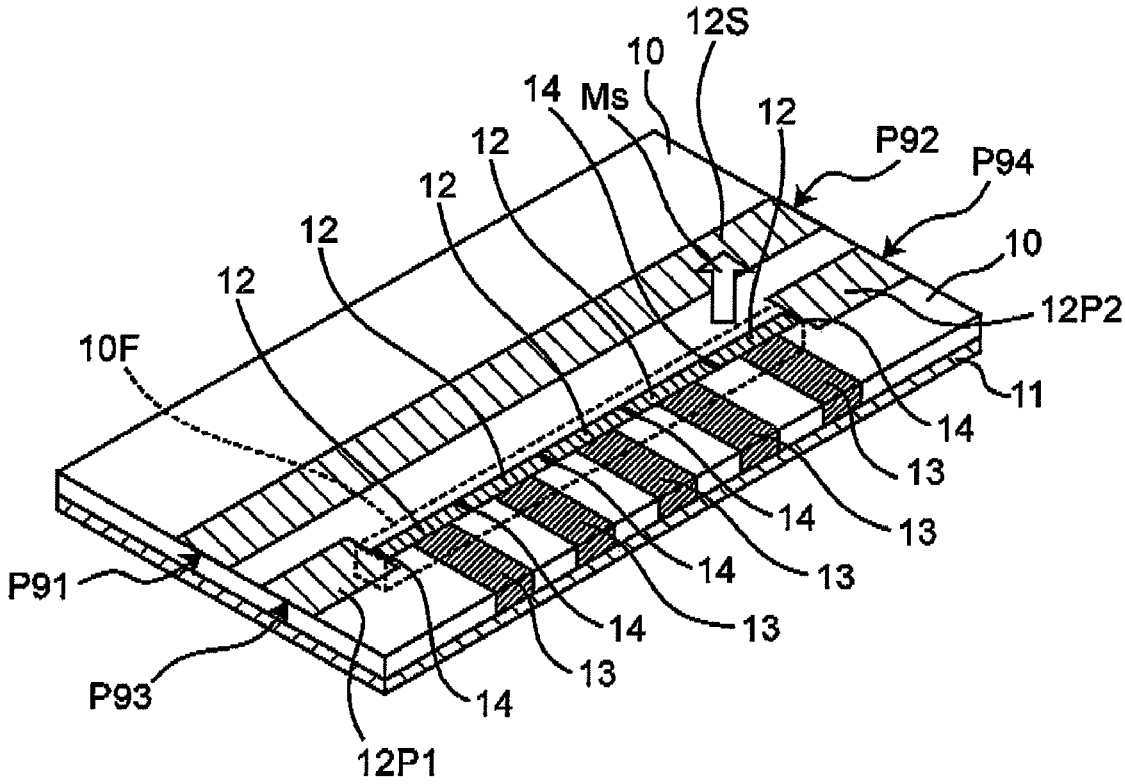
FIG. 67 is a perspective view showing the external appearance of a directional coupler that employs the ladder-type nonreciprocal right/left-handed transmission line of the first preferred embodiment according to a second modified preferred embodiment of the eleventh preferred embodiment of the present invention.

FIG. 67 is a perspective view showing the external appearance of a directional coupler that employs the ladder-type nonreciprocal right/left handed transmission line of the first preferred embodiment according to a second modified preferred embodiment of the eleventh preferred embodiment of the present invention. Referring to FIG. 67, by placing the nonreciprocal right/left handed transmission line and the microstrip line 12S that is the opposite transmission line parallel and adjacent to each other, a directional coupler that has four ports P91 to P94 are constituted. It is noted that the ferrite substrate 10F is embedded in the dielectric substrate 10 just below the strip conductors 12. As a counterpart transmission line of the opposed transmission line, for example, a right-handed transmission line, a left-handed transmission line, a right-handed/left-handed transmission line or a nonreciprocal right/left handed transmission line can be used.

FIG. 36 shows an example of a band-pass filter when the resonator is edge-coupled. Referring to FIG. 36, the nonreciprocal transmission line 70A is constituted by cascade-connecting a plurality M of transmission line parts 60A-1 to 60A-M via coupling capacitors Cc2 to CcM. A port P81 is connected to a port P82 via the transmission line 67, a coupling capacitor Cc1, a non-reciprocal transmission line 70A, a coupling capacitor CcM+1 and a transmission line 68, constituting a band-pass filter therewith.

Although the coupling via the coupling capacitors of a series capacitance is used in the preferred embodiments of FIGS. 35 and 36, it may be acceptable to constitute a filter via magnetic coupling when the unit cell of the resonator is of the π type and a shunt inductive element is placed at the terminal end.

When the nonreciprocal transmission line type resonator that constitutes the filter is constituted of the resonator of the type (iii), the operating frequency scarcely changes even if the line length (size) of each resonator is changed. On the other hand, it is possible to change the Q value by changing the number of unit cells, i.e., the line length. For example, in the case of the band-pass filter of FIG. 36, the terminal end position of the non-reciprocal transmission line type resonator that constitutes the filter can be electrically changed by electrically changing the capacitance of the coupling capacitor inserted in series, and therefore, it is possible to change the total number of resonators that constitute the filter or to change the number of unit cells that constitute each individual resonator. This makes it possible to perform timewise switchover of the pass-band and the bandwidth. The same thing can be said for the band-stop filter shown in FIG. 35. A method for timewise switchover of the operating band and bandwidth can also be achieved by mechanically, electrically, magnetically or optically changing not only the series capacitance element but also other structural parameters besides the electrical method described above.

A relation between the magnetization direction of magnetization Ms for constituting the nonreciprocal phase shift transmission line employed in each of the above preferred embodiments and the propagation direction of the electromagnetic field of microwave is described below. An asymmetric structure in the nonreciprocal transmission line of the present preferred embodiment refers to a structure asymmetric to a plane constituted by two vectors of "the propagation direction of the electromagnetic wave" and "the magnetization direction" caused by spontaneous magnetization or magnetization by an external magnetic field (the magnetization direction is a direction different from the propagation direction and is preferably an orthogonal direction).

Thirteenth and Fourteenth Preferred Embodiments

Figure 37:
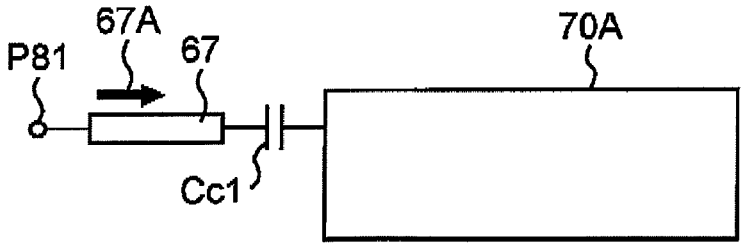
FIG. 37 is a block diagram showing a configuration of an antenna apparatus that employs the ladder type nonreciprocal right/left handed transmission line 70A (when a T type unit cell is used) of the first preferred embodiment according to a thirteenth preferred embodiment of the present invention.
Figure 38:
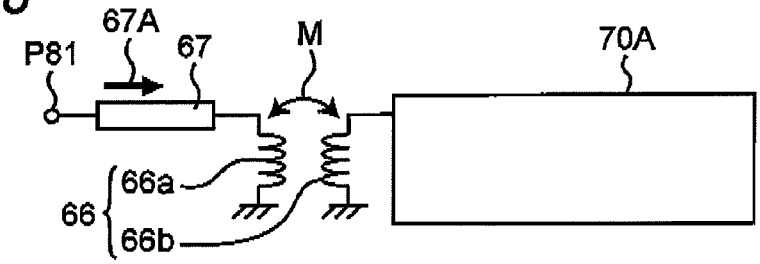
FIG. 38 is a block diagram showing a configuration of an antenna apparatus that employs the ladder-type nonreciprocal right/left handed transmission line 70A (when a $\pi$ type unit cell is used) of the first preferred embodiment according to a fourteenth preferred embodiment of the present invention.

FIG. 37 is a block diagram showing a configuration of an antenna apparatus that employs the ladder type nonreciprocal right/left handed transmission line 70A (when a T type unit cell is used) of the first preferred embodiment according to a thirteenth preferred embodiment of the present invention. FIG. 38 is a block diagram showing a configuration of an antenna apparatus that employs the ladder type nonreciprocal right/left handed transmission line 70A (when a π type unit cell is used) of the first preferred embodiment according to a fourteenth preferred embodiment of the present invention.

Many of the prior art antenna apparatuses are constituted by an antenna resonator part, a feeding line part to it, and a matching circuit part between them. A patch antenna apparatus, a dielectric antenna apparatus, and so on can be enumerated as examples. In the case of the antenna apparatus constituted of a resonator as described above, standing wave arise in the resonator configuration, and nodes and bellies exist in the electromagnetic field distribution, providing an almost in-phase state. Moreover, it often results in non-directional or a case where the main lobe is directed toward the broadside with respect to the antenna radiation plane. In contrast to the above, the antenna apparatus that employs the nonreciprocal transmission-line-type resonator of the present preferred embodiment has the following advantageous features:

(A) Since it is possible to make the amplitude distribution constant and make the phase distribution have a gradient, the radiation beam direction can be set in the desired direction regardless of the fact that it is a single resonator type antenna apparatus.

(B) Pertaining to (A), improvements in the gain and the directivity can be achieved by increasing the resonator line length since the amplitude distribution is constant.

(C) Radiation beam scanning becomes possible by mechanically, electrically, magnetically or optically changing the structural parameters regardless of the fact that it is a single resonator type antenna apparatus.

FIGS. 37 and 38 show constitutional examples of an antenna apparatus that employs the nonreciprocal transmission line type resonator. FIG. 37 shows one example in a case where the unit cell is of the T type and both ends of the resonator have a series branch capacitance. FIG. 38 shows one example in a case where the unit cell is of the π type and parallel inductance elements are placed. In FIGS. 37 and 38, reference numeral 67A denotes the power feeding direction of a microwave signal.

Referring to FIG. 37, the port P81 is connected to the antenna apparatus of the nonreciprocal transmission line type resonator constituted of the transmission line apparatus 70 via the transmission line 67 and the coupling capacitor Cc1. In this case, by feeding the port P81 with a microwave signal, the antenna apparatus of the nonreciprocal transmission line type resonator constituted of the transmission line apparatus 70 resonates, and the electromagnetic wave of the microwave signal are radiated into a free space.

Figure 68:
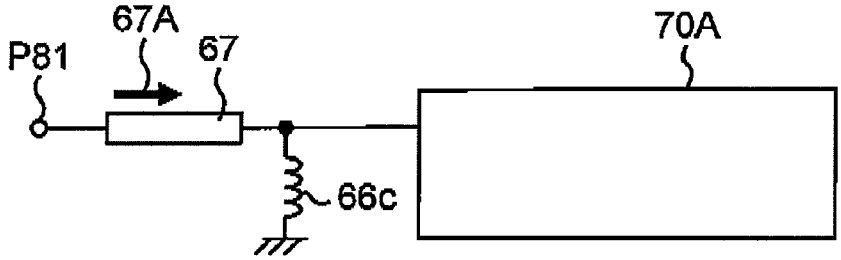
FIG. 68 is a block diagram showing a configuration of an antenna apparatus that employs the ladder-type nonreciprocal right/left handed transmission line 70A (when the π type unit cell is used) of the first preferred embodiment according to a modified preferred embodiment of the fourteenth preferred embodiment of the present invention.

Moreover, in FIG. 38, the port P81 is connected to the antenna apparatus of the nonreciprocal transmission line type resonator constituted of the transmission line apparatus 70 via the transmission line 67 and a transformer 66 constituted of a primary coil 66*a* and a secondary coil 66*b* that have mutual electromagnetic coupling M. In this case, by feeding the port P81 with a microwave signal, the antenna apparatus of the nonreciprocal transmission line type resonator constituted of the transmission line apparatus 70 resonates, and the electromagnetic wave of the microwave signal are radiated into a free space. Further, FIG. 68 shows a modified preferred embodiment of FIG. 38. FIG. 68 is characterized in that a shunt inductor 66*c* is inserted in place of the transformer 66 for magnetic coupling.

In the prior art leaky wave antenna, a microwave signal is inputted from one terminal of the transmission line that constitutes the antenna apparatus, and matching is made at the terminal end. Therefore, it largely differs from the fundamental operation of the resonator type antenna apparatus, and both of them have not been discussed as identical. Herein have been described the applications of the antenna apparatus as application examples of the nonreciprocal transmission line type resonator from the viewpoint that the leaky wave antenna apparatus as described above and the resonator type antenna apparatus are separately discussed. However, it is insisted that improvements in the antenna radiation characteristic be attempted by positively utilizing the reflected wave at the terminal end in the leaky wave antenna apparatus described above. When the reflected wave exists in the line depending on the terminal conditions of the transmission line in the leaky wave antenna apparatus as described above, the operation similar to that of the resonator type antenna apparatus is to be consequently performed. In particular, when a total reflection condition holds at the terminal ends, it is also possible to regard it as operating as a resonator. For the above reasons, the antenna apparatus that employs the nonreciprocal transmission line of the present preferred embodiment has a structure that concurrently has the operations of the resonator type and the leaky wave type, also depending on the degree of the reflection condition at the terminal ends of the transmission line.

Fifteenth Preferred Embodiment

Figure 39:
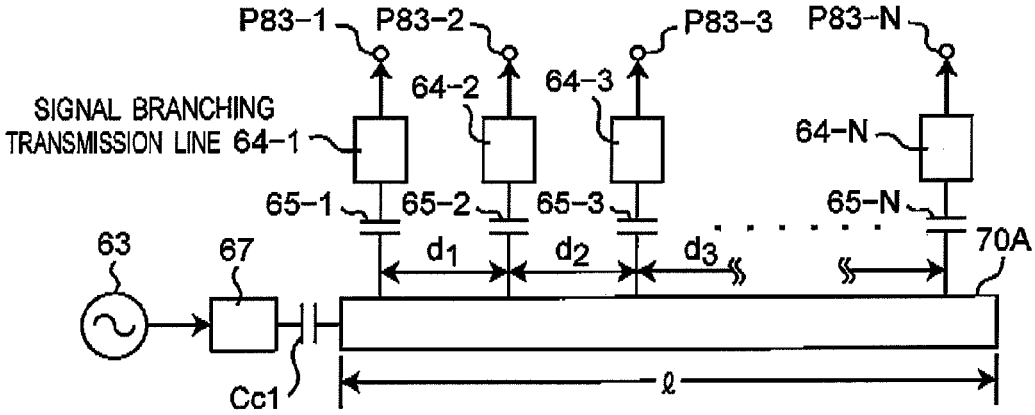
FIG. 39 is a block diagram showing a configuration of an equal power divider that has a phase gradient employing the ladder-type nonreciprocal right/left handed transmission line 70A of the first preferred embodiment according to a fifteenth preferred embodiment of the present invention.

FIG. 39 is a block diagram showing a configuration of an equal power divider that has a phase gradient employing the ladder-type nonreciprocal right/left handed transmission line 70A of the first preferred embodiment according to a fifteenth preferred embodiment of the present invention. In the present preferred embodiment, the equi-power divider of a kind of coupler that employs a nonreciprocal transmission line type resonator is described below with reference to FIG. 39.

Referring to FIG. 39, a microwave signal generated by a microwave signal generator 63 is inputted to the transmission line apparatus 70A of a line length 1 via the transmission line 67 and the coupling capacitor Cc1. To the transmission line apparatus 70A are connected signal branching transmission lines 64-1 to 64-N that have output ports 83-1 to 83-N, respectively, via coupling capacitors 65-1 to 65-N at predetermined intervals of d1, d2, in the line length direction. In the equal power divider of the nonreciprocal transmission line type resonator constituted as above, the output ports P83-1 to P83-N have a predetermined phase gradient, and power distribution can be achieved with the equal power. That is, in the present preferred embodiment, the equal power divider having phase changes between the output ports P83-1 to P83-N can be constituted.

In concrete, among the nonreciprocal transmission line type resonators of the present preferred embodiment, if any one of the following is used:

(i) a transmission line type resonator employing the nonreciprocal transmission line in which the right-handed transmission is performed in the forward direction, the effective wavelength is infinite and no phase change occurs between input and output in the backward direction, at an identical frequency;

(ii) a transmission line type resonator employing the nonreciprocal transmission line in which the left-handed transmission is performed in the forward direction, the effective wavelength is infinite and no phase change occurs between input and output in the backward direction, at an identical frequency; and (iii) a transmission line type resonator employing the nonreciprocal right/left handed transmission line, in which the wave number vectors in the two modes of propagation in the forward direction and the backward direction are equal to each other at an identical frequency, then the amplitude on the transmission line becomes constant. Therefore, the degree of electromagnetic coupling comes to have the same level regardless of the installation place of the coupling portion of the transmission line that constitutes the resonator and the transmission line for the output terminal, and this allows the designing to be easy.

Moreover, because the phase distribution exists on the transmission line, it is possible to give a phase change between a plurality of output ports by changing the installation place of the coupling portion between the resonator and the transmission line for the output ports. Moreover, it is also possible to continuously change the phase differences between the output ports by mechanically, electrically, magnetically or optically changing the structural parameters.

As one example of the applications of the phase gradient type equal power divider, the following ones can be enumerated. It is necessity to scan the radiation beam by placing each phase shifter and changing the phase of each individual phase shifter independently in the feed line parts to antenna elements that constitutes a prior art phased array antenna apparatus. However, in the case of the equal power divider described above, the phase differences between the output ports can be continuously changed by one-dimensionally changing the structural parameters of the nonreciprocal transmission line type resonator part by a mechanical, electrical, magnetic or optical method. This therefore produces the peculiar effects that beam scanning of the array antenna is possible, and the structure becomes very simple in comparison with the case where a plurality of the prior art phase shifters are used.

Sixteenth to Eighteenth Preferred Embodiments

Figure 40:
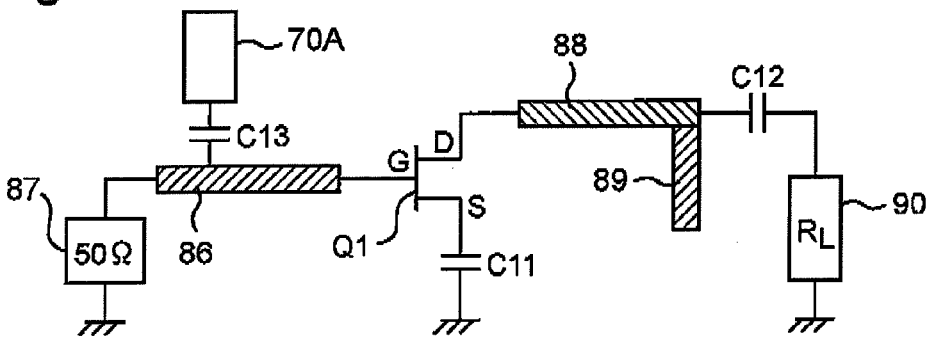
FIG. 40 is a block diagram showing a configuration of a series feedback type oscillator that employs the ladder-type nonreciprocal right/left handed transmission line 70A of the first preferred embodiment according to a sixteenth preferred embodiment of the present invention.
Figure 41:
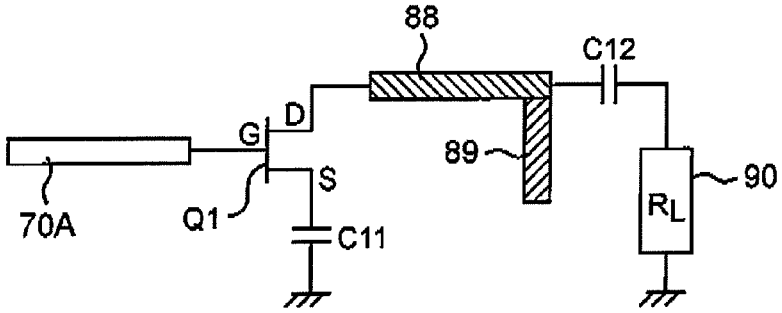
FIG. 41 is a block diagram showing a configuration of a series feedback type oscillator that employs the ladder-type nonreciprocal right/left handed transmission line 70A of the first preferred embodiment according to a seventeenth preferred embodiment of the present invention.

An oscillator that employs the nonreciprocal transmission line type resonator is described below with reference to FIGS. 40 to 42. FIG. 40 is a block diagram showing a configuration of a series feedback type oscillator that employs the ladder type nonreciprocal right/left handed transmission line 70A of the first preferred embodiment according to a sixteenth preferred embodiment of the present invention. FIG. 41 is a block diagram showing a configuration of a series feedback type oscillator that employs the ladder type nonreciprocal right/left handed transmission line 70A of the first preferred embodiment according to a seventeenth preferred embodiment of the present invention. Further, FIG. 42 is a block diagram showing a configuration of a parallel feedback type oscillator that employs the ladder type nonreciprocal right/left handed transmission line 70A of the first preferred embodiment according to an eighteenth preferred embodiment of the present invention.

A resonator of a high Q value is often inserted in a lot of oscillators for use in the microwave and millimeter wave bands for the reasons of noise suppression and so on. The nonreciprocal transmission line type resonator of the present preferred embodiment is able to concurrently have not only the function as the resonator but also the role of phase adjustment in a positive feedback loop since a phase change is given between the resonators. Moreover, by changing the structural parameters of the nonreciprocal transmission line type resonator part by a mechanical, electrical, magnetic or optical method, fine adjustment of the Q value and fine adjustment of the amount of phase shift are possible.

Referring to FIG. 40, the gate of a field-effect transistor (hereinafter, referred to as FET) QI that is an active device is grounded via a transmission line 86 and a load resistance 87 of 50Ω, and the resonator of the transmission line apparatus 70A is connected to the transmission line 86 via a coupling capacitor C13. The source of the FET QI is grounded via a coupling capacitor C11, and its drain is grounded via a transmission line 88, a coupling capacitor C12 and a load resistance 90 of a resistance value $R_L$. It is noted that a transmission line 89 having an open end is connected to one end of the transmission line 88. With the above configuration, a series feedback type oscillator is constituted. Moreover, in FIG. 41, only the resonator of the transmission line apparatus 70A is connected in place of the circuit connected to the gate of the FET Q1 in comparison with the oscillator of FIG. 40. With the above configuration, a series feedback type oscillator is constituted. Referring to FIGS. 40 and 41, the nonreciprocal transmission line type resonator or a combination of the resonator and the transmission line plays the role of a band-stop filter and performs the operation of a reflection type resonator in the same stop band. With the above arrangement, the series feedback type oscillator is constituted.

Figure 42:
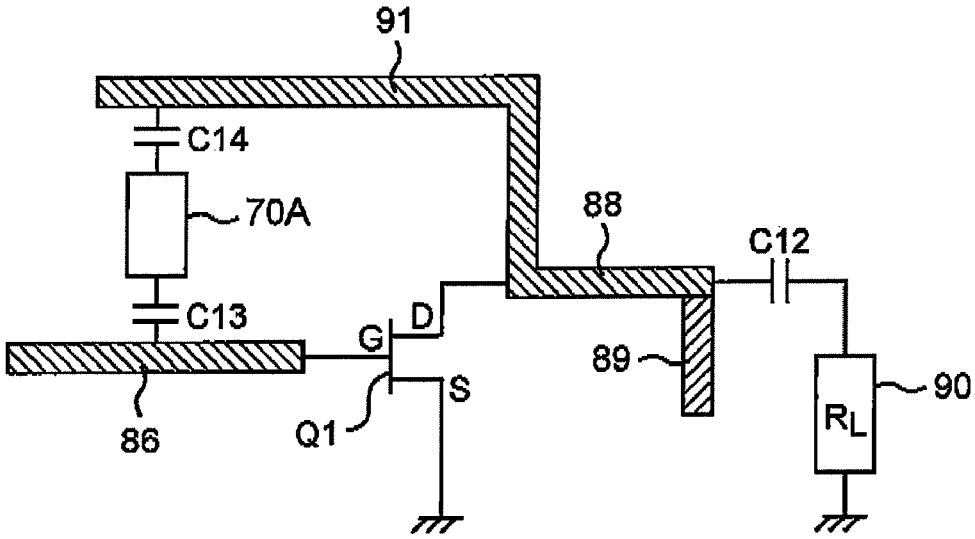
FIG. 42 is a block diagram showing a configuration of a parallel feedback type oscillator that employs the ladder-type nonreciprocal right/left handed transmission line 70A of the first preferred embodiment according to an eighteenth preferred embodiment of the present invention.

FIG. 42 is characterized in that the following feedback loop circuit is added in comparison with the oscillator of FIG. 40. Another end of the transmission line 88 is connected to another end of the resonator of the transmission line apparatus 70A via a transmission line 91 and a coupling capacitor C14. With this arrangement, the drain of the FET Q1 is connected to the gate of the FET Q1 via the transmission line 91, the coupling capacitor C14, the resonator of the transmission line apparatus 70A, the coupling capacitor C13 and the transmission line 86, constituting a parallel feedback type oscillator with the parallel feedback circuit. Referring to FIG. 42, a combination of the nonreciprocal transmission line type resonator and the transmission line plays the role of a band-pass filter, and a positive feedback loop circuit is constituted in the same band to perform the oscillating operation.

Nineteenth Preferred Embodiment

Figure 43:
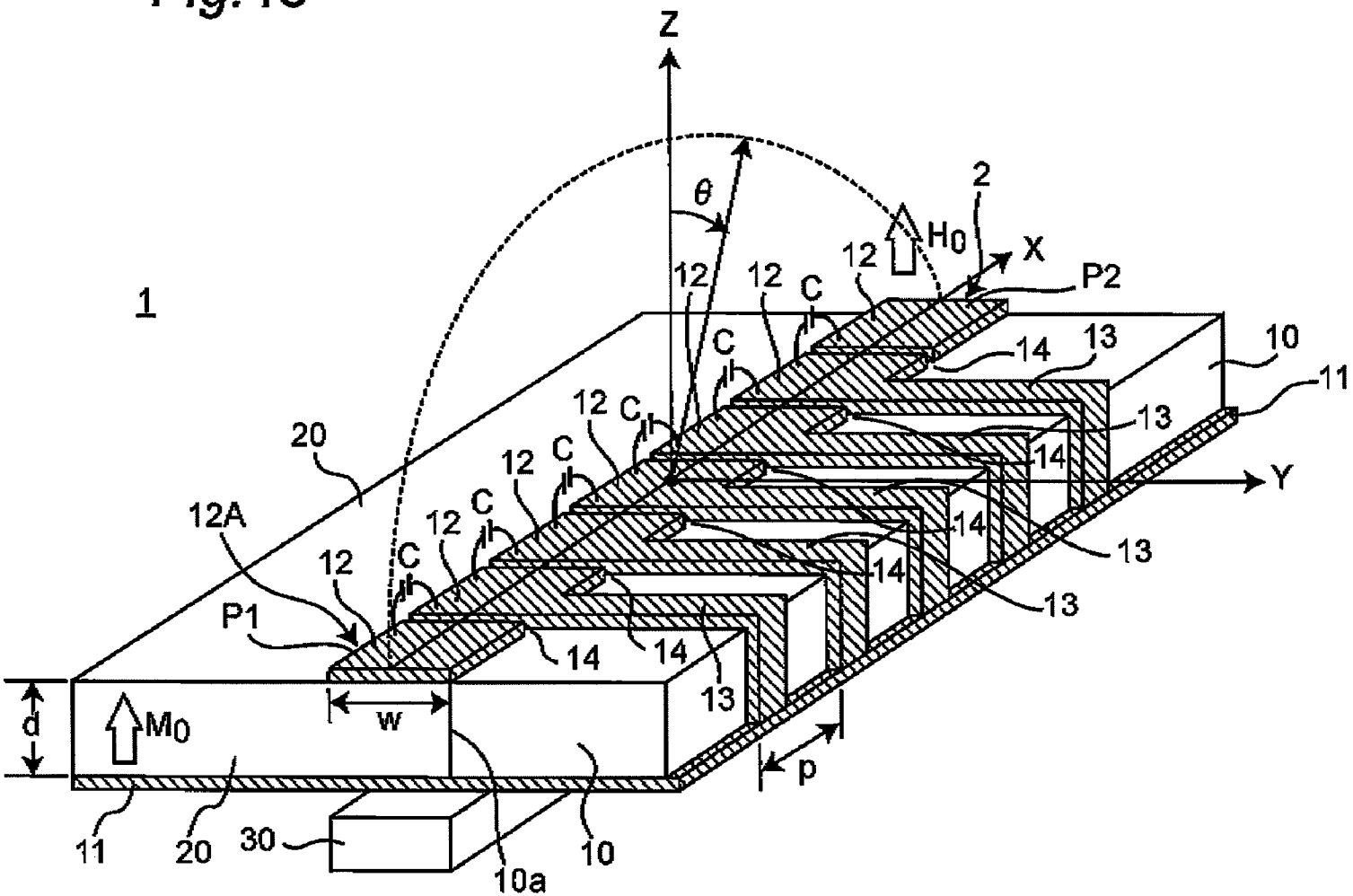
FIG. 43 is a perspective view showing the external appearance of a transmission-line antenna apparatus 1 according to a nineteenth preferred embodiment of the present invention.

FIG. 43 is a perspective view showing the external appearance of a transmission line antenna apparatus 1 according to a nineteenth preferred embodiment of the present invention. A transmission line 2 of the transmission line antenna apparatus 1 of the present preferred embodiment is constituted by including the following:

(a) a substrate, which is provided by coupling a magnetic substrate 20 made of a magnetic material of, for example, ferrite with a dielectric substrate 10 made of, for example, glass epoxy resin by a boundary portion 10*a* of their side surfaces and has a ground conductor 11 on a back surface thereof;

(b) a microstrip line 12A formed on the boundary portion 10*a* of the substrate;

(c) a plurality of capacitors C, which are provided by separating the microstrip line 12A into a plurality of strip conductors 12 that are line parts of a width w with respective gaps 14 formed and connecting mutually adjacent strip conductors 12 among the plurality of strip conductors 12; and (d) a plurality of short-circuit stub conductors 13, which connect each of the strip conductors 12 to the ground conductor 11.

In the transmission line 2 of FIG. 43, a distributed type transmission line of five periods is formed by six capacitors C loaded and five short-circuit stub conductors 13 formed. Moreover, the microstrip line 12A is constituted of the strip conductors 12 and the ground conductor 11 interposing the magnetic substrate 20 and the dielectric substrate 10. Further, the capacitor C may be provided by a real capacitor between mutually adjacent strip conductors 12 or by a capacitor C, only a stray capacitance of each gap 14 or a series capacitance constituted of the stray capacitance of each gap 14 and a capacitor connected in parallel, depending on the frequency of the inputted microwave signal. Moreover, a formation interval of the short-circuit stub conductors 13 is a period p [mm] Further, the lengthwise direction of the microstrip line 12A is assumed as the X-axis direction, a direction in which the short-circuit stub conductors 13 extend is assumed as the Y-axis direction, and an upward direction perpendicular to the magnetic substrate 20 is assumed as the Z-axis direction.

The transmission line antenna apparatus 1 of the present preferred embodiment is a transmission line antenna apparatus that employs the transmission line 2, which includes:

(a) a direct-current magnetic field generator 30 of, for example, an electromagnet, which is provided just below the transmission line 2 and applies a predetermined direct-current magnetic field $H_0$ to the transmission line 2; and (b) a controller 50 (See FIGS. 52 to 55), which performs control by inputting a microwave signal to at least one of one end (hereinafter, referred to as a port P1) and another end (hereinafter, referred to as a port P2) to operate the transmission line 2 as a forward wave transmission line or a backward wave transmission line at a predetermined frequency so that a main beam is formed with the leaky wave leaked from the transmission line 2 served as a radiation wave by controlling at least one of the amplitude and the phase of the inputted microwave signal with utilizing the nonreciprocal characteristic of the transmission line 2.

The circuit of the transmission line 2 constituted as above constitute a circuit, which is a ferrite periodic structural transmission line and in which the ferrite microstrip line 12A is periodically loaded with the short-circuit stub conductor 13 (operating as a shunt inductance) whose one end is short-circuited on the dielectric substrate 10 and the capacitor C that is a series capacitance. A direct-current magnetic field is applied from the direct-current magnetic field generator 30 perpendicularly to the magnetic substrate 20, and the edge guided mode propagates to the transmission line 2. In this case, paying attention to a band in which the effective permeability becomes negative in the dispersion curve of the edge guided mode, transmission characteristics in the band and the peripheries are obtained. An equivalent circuit method is effective as a simple method for theoretically obtaining the scattering parameters of the circuit of the transmission line 2, and this method has difficulties in obtaining the nonreciprocal characteristic of the edge guided mode that appears due to the spreading of a two-dimensional electromagnetic field. In this case, the propagation characteristic is numerically obtained by using HFSS produced by ANSOFT based on the finite element method as an electromagnetic simulator.

Exemplified frequency characteristics of the scattering parameters obtained by numerical calculations are described below. The parameters used for the calculations are as follows: direct-current magnetic field $\mu_0H_0$=30 mT; ferrite saturation magnetization $\mu_0M_0$=175 mT; magnetic loss $\mu_0\Delta H$=5 mT, relative permittivity 15 of the ferrite magnetic substrate 20; relative permittivity 2.6 of the dielectric substrate 10; thickness d=1 mm of the magnetic substrate 20 and the dielectric substrate 10; width w=0.5 mm of the microstrip line 12A; period (interval) p=5 mm of the transmission line 2; width of 1 mm of the short-circuit stub conductor 13; its length of 7 mm; series capacitance capacitor C=1 pF; and the number of periods=5.

The transmission line 2 has a configuration in which the microstrip line 12A of the perpendicularly magnetized magnetic substrate is periodically loaded with capacitive and inductive elements in series and shunt branch, respectively. In this case, in order to secure the operation of the inductive element to be inserted in shunt branch regardless of the magnitudes of the applied magnetic field and saturation magnetization, the short-circuit stab conductors 13 are formed on the adjacent dielectric substrate 10, but it is also possible to replace them by a lumped element. That is, although the dielectric substrate 10 is provided to constitute the short-circuit stub conductors 13, the dielectric substrate 10 need not be provided when the lumped elements are inserted periodically in parallel with the microstrip line. That is, the placement of the dielectric substrate 10 is not indispensable in obtaining the nonreciprocal transmission characteristics. Further, although the Z direction is selected as the forward direction as the magnetization direction of the direct-current application magnetic field and the magnetic material of the magnetic substrate 20 in FIG. 43, the present invention is not limited to this, and the −Z direction may be selected as the forward direction. In this case, the transmission characteristics of the port P1 and the port P2 can be replaced with each other as they are.

Figure 44:
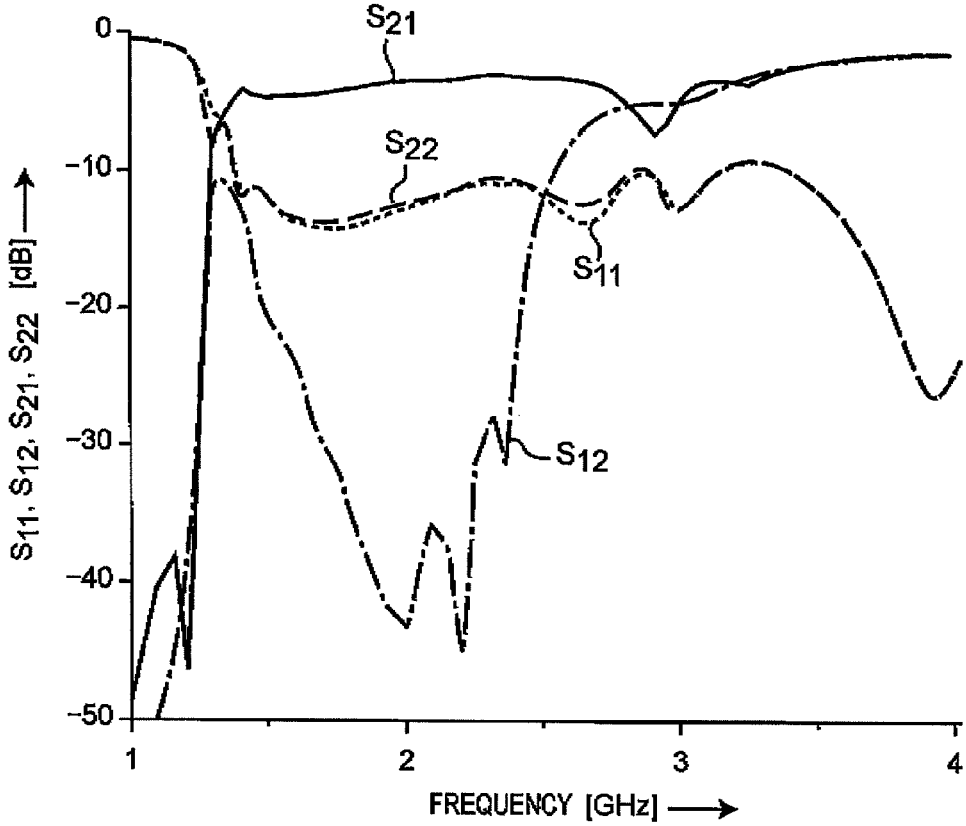
FIG. 44 is a graph showing the frequency characteristics of the amplitudes of transmission coefficients $S_{21}$ and $S_{12}$ and reflection coefficients $S_{11}$ and $S_{22}$ of the transmission-line antenna apparatus 1 of FIG. 43.
Figure 45:
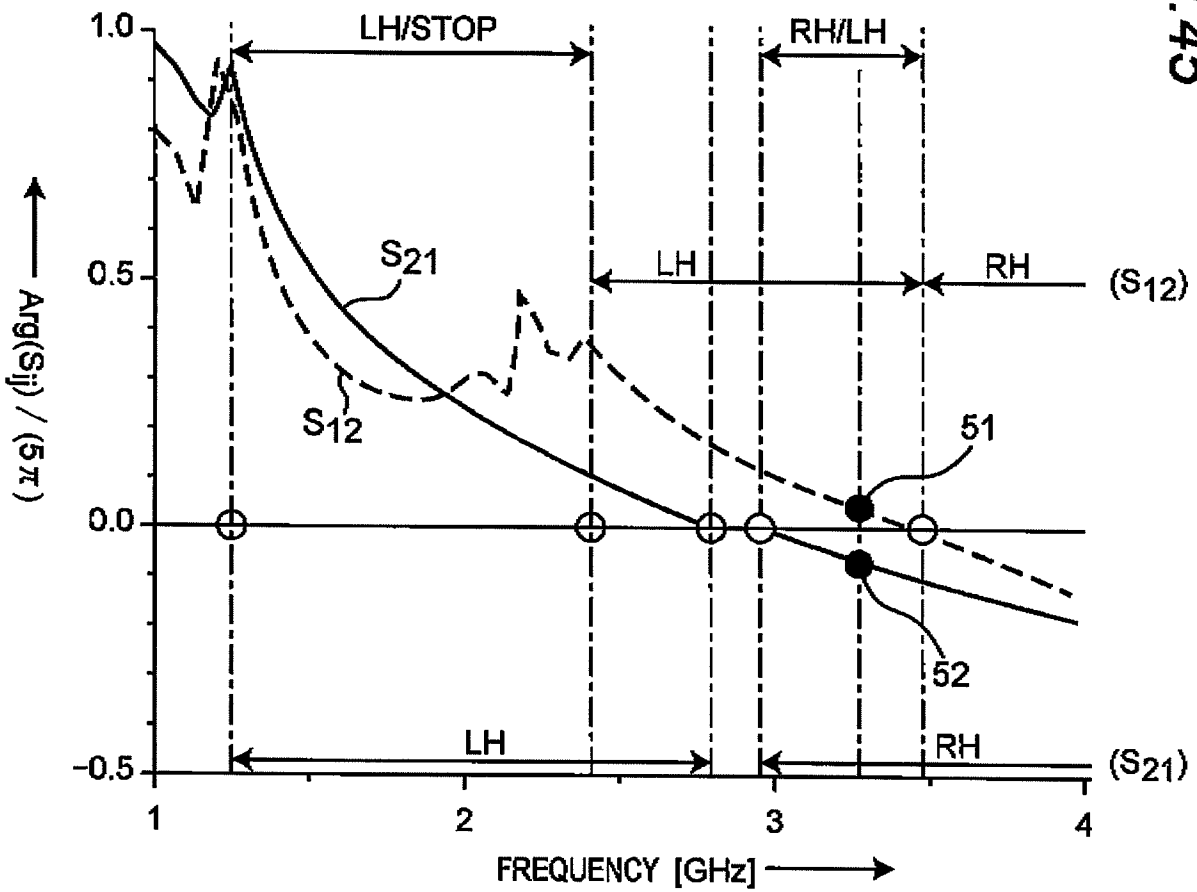
FIG. 45 is a graph showing the frequency characteristics of the phases of the transmission coefficients $S_{21}$ and $S_{12}$ of the transmission-line antenna apparatus 1 of FIG. 43.
Figure 46:
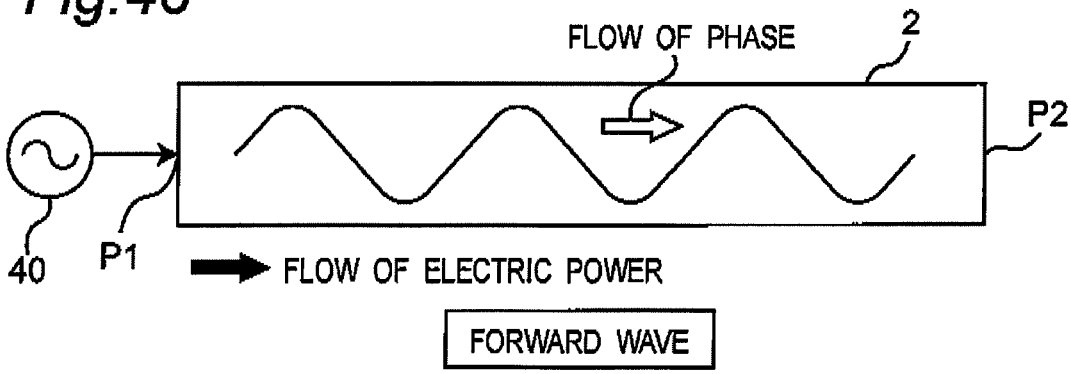
FIG. 46 is a side schematic view showing the flow of the phase of a forward wave and the flow of the transmitted power in the right-handed transmission line when a microwave signal is inputted to the port P1 of the transmission-line antenna apparatus 1 of FIG. 43.
Figure 47:
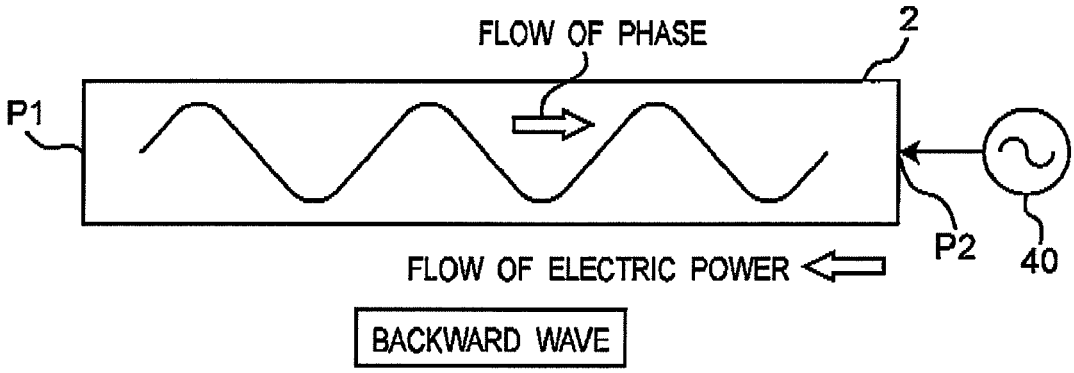
FIG. 47 is a side schematic view showing the flow of the phase of a backward wave and the flow of the transmitted power in the left-handed transmission line when a microwave signal is inputted to the port P2 of the transmission-line antenna apparatus 1 of FIG. 43.

FIG. 44 is a graph showing the frequency characteristics of the amplitudes of the transmission coefficients $S_{21}$ and $S_{12}$ and the reflection coefficients $S_{11}$, $S_{22}$ of the transmission line antenna apparatus 1 of FIG. 43. FIG. 45 is a graph showing the frequency characteristics of the phases of the transmission coefficients $S_{21}$ and $S_{12}$ of the transmission line antenna apparatus 1 of FIG. 43. FIG. 46 is a side schematic view showing the flow of the phase of a forward wave and the flow of the power in the right-handed transmission line when a microwave signal is inputted to the port P1 of the transmission line antenna apparatus 1 of FIG. 43. FIG. 47 is a side schematic view showing the flow of the phase of a backward wave and the flow of the transmitted power in the left-handed transmission line when a microwave signal is inputted to the port P2 of the transmission line antenna apparatus 1 of FIG. 43.

In the magnetic substrate microstrip line 12A magnetized perpendicularly, the edge guided mode in which the electromagnetic field distribution is concentrated under the edge on one side of the strip becomes the dominant mode. Therefore, when the configuration has asymmetricity, nonreciprocal characteristic appears depending on the transmission direction as shown in FIGS. 44 and 45. The nonreciprocal characteristic of the transmission characteristic observed in the configuration handled in the present preferred embodiment is categorized roughly into the following two ones.

First of all, as observed in the frequency band of the frequencies from 1.5 GHz to 2.8 GHz in FIG. 45, it is the case where transmission (transmission coefficient $S_{21}$ is about −5 dB, and there is little loss) is achieved in the forward transmission from the port P1 to the port P2, and attenuation (transmission coefficient $S_{12}$ is not greater than about −20 dB, and there is little transmission) is achieved in the backward transmission from the port P2 to the port P1. In this case, the transmission line 2 can be used as an isolator.

As another nonreciprocal characteristic, a case where no difference is observed in the amplitude characteristic, but the phase characteristic has nonreciprocal characteristics can be enumerated. In FIG. 45, the vertical axis is provided by standardizing the phases of the transmission coefficients $S_{21}$ and $S_{12}$ of the scattering matrix components as a phase change per unit cell, and this has a dimension identical to $\beta p/\pi$ standardized through division by $\pi$ since the product of the propagation constant $\beta$ and the period p represents the phase [rad] per unit cell. Therefore, FIG. 45 corresponds to a dispersion curve. Referring to FIG. 45, the right-handed (forward wave) transmission line (FIG. 46) operates in the forward direction and as the left-handed (backward wave) transmission line (FIG. 47) operates in the backward direction in the frequency domain of frequencies from 3 GHz to 3.5 GHz. As described above, the phase characteristic is largely varied depending on the way of taking the transmission direction, and therefore, the line can be used for transmission direction selecting phase control. In particular, in the vicinity of the frequency of 3.3 GHz in FIG. 45, the magnitude of the propagation constant is same in the case of the forward direction input and in the case of the backward direction input (indicated by the black dots 51, 52 in FIG. 45). The gradients of two curves that represent the phase characteristics in the forward direction and the backward direction are both inclined rightward to the bottom in FIG. 45. However, since the gradient of the dispersion curve corresponds to the direction of energy propagation (group velocity), FIG. 45 does not correspond to the direction of actual power transmission and represents the propagation constant when the electric powers propagated in the forward direction and the backward direction are both selected positive. Of course, the transmitted power practically becomes mutually anti-parallel in the forward direction and the backward direction, and therefore, the propagation constant consequently becomes identical not only in the magnitude but also in the direction (sign) in the vicinity of the frequency of 3.3 GHz.

Figure 48:
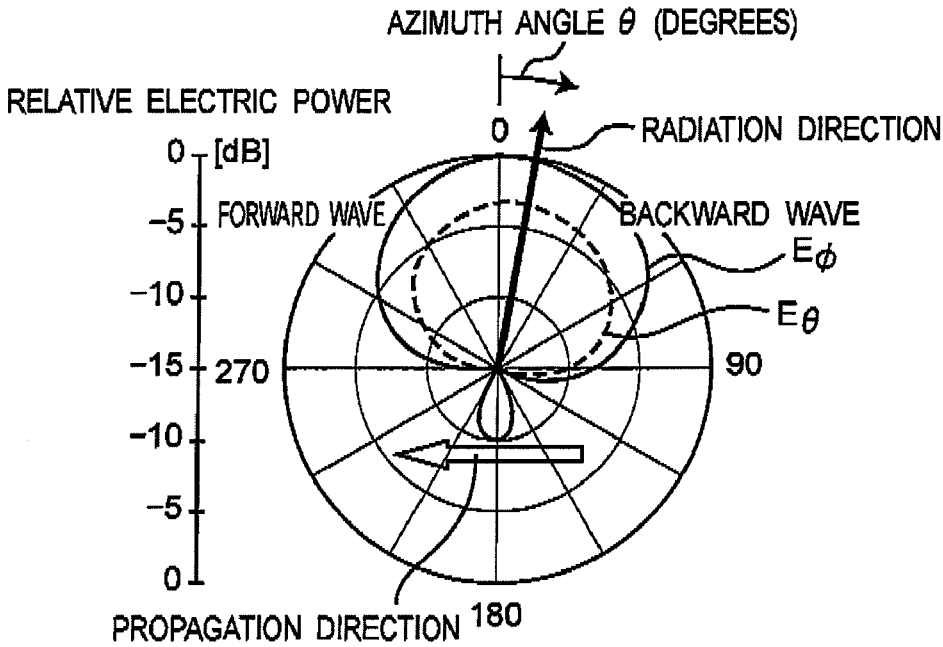
FIG. 48 is a radiation pattern chart in the ZX plane when the transmission-line antenna apparatus 1 of FIG. 43 operates as a transmitting nonreciprocal transmission-line antenna apparatus at a frequency f=2.4 GHz.
Figure 49:
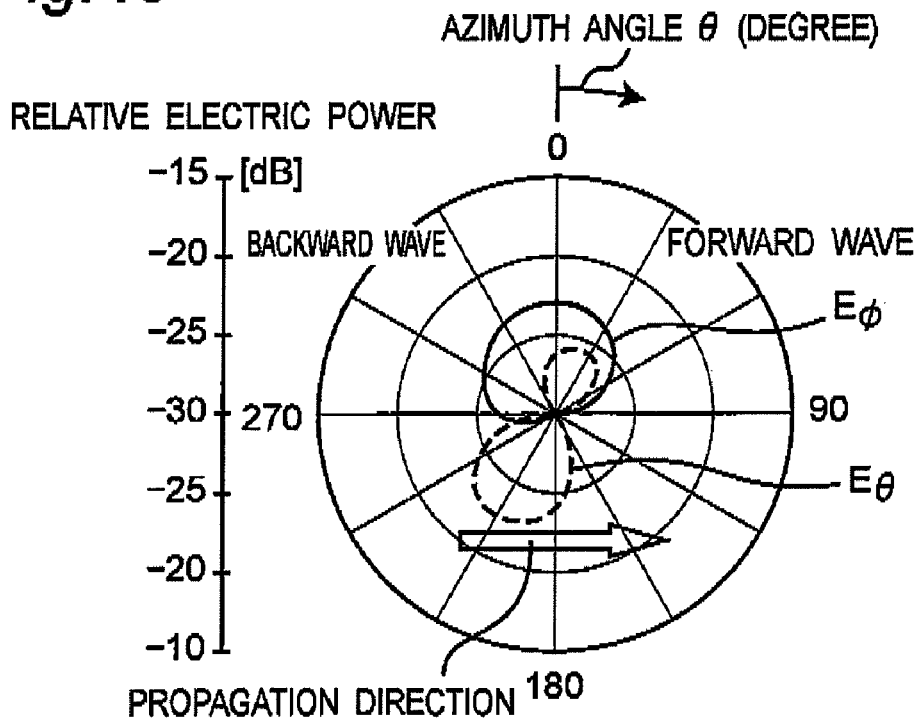
FIG. 49 is a radiation pattern chart in the ZX plane when the transmission-line antenna apparatus 1 of FIG. 43 operates as an attenuating nonreciprocal transmission-line antenna apparatus at a frequency f=2.4 GHz.
Figure 50:
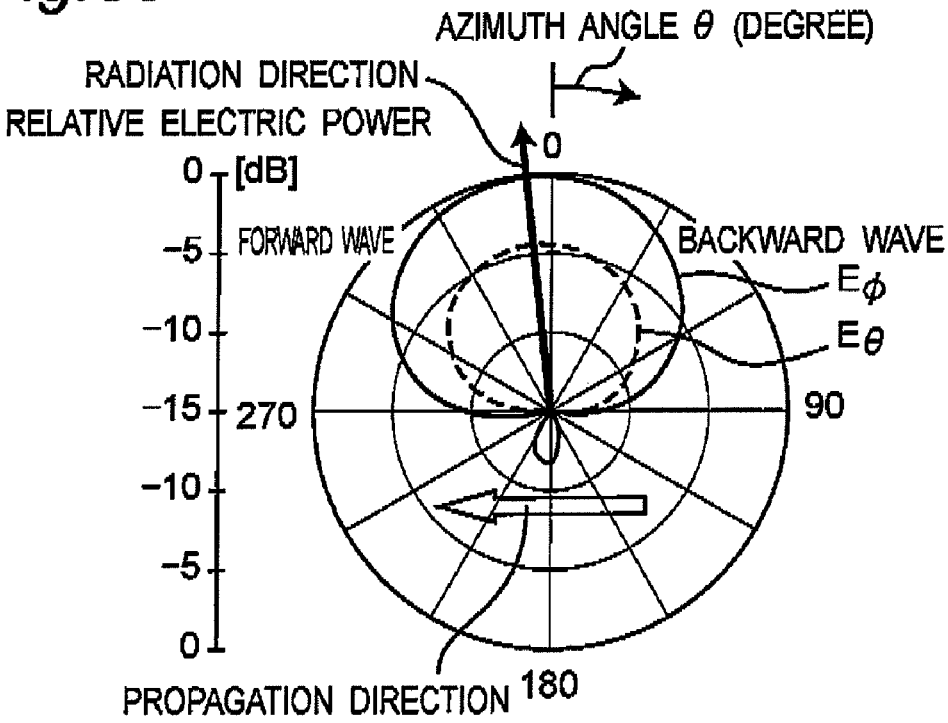
FIG. 50 is a radiation pattern chart in the ZX plane when the transmission line antenna apparatus 1 of FIG. 43 operates as a nonreciprocal right-handed transmission-line antenna apparatus at a frequency f=3.3 GHz.
Figure 51:
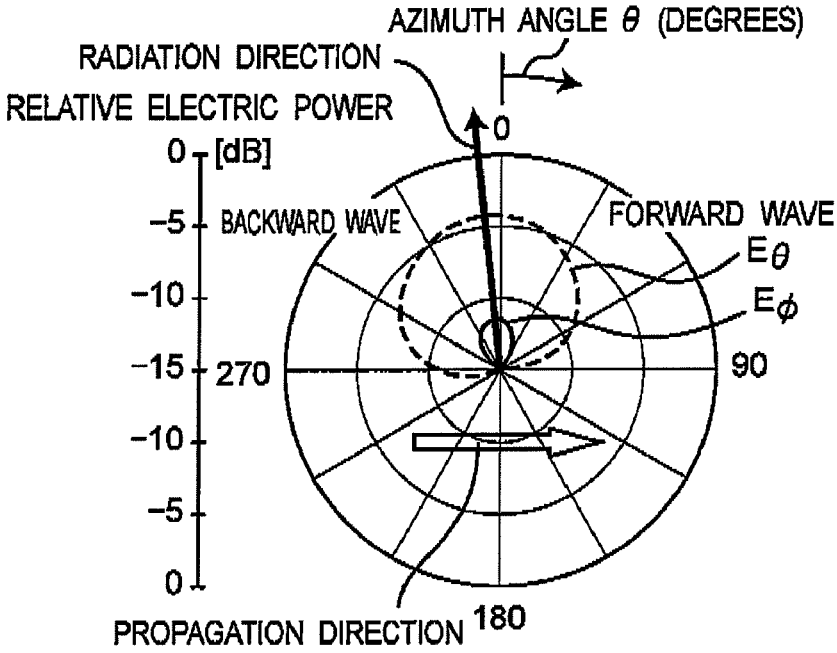
FIG. 51 is a radiation pattern chart in the ZX plane when the transmission line antenna apparatus 1 of FIG. 43 operates as a nonreciprocal left-handed transmission-line antenna apparatus at a frequency f=3.3 GHz.

Next, the radiation characteristic when the transmission line 2 is used as the antenna apparatus 1 is described below. FIG. 48 is a radiation pattern chart in the ZX plane when the transmission line antenna apparatus 1 of FIG. 43 operates as a transmitting nonreciprocal transmission line antenna apparatus at a frequency f=2.4 GHz. FIG. 49 is a radiation pattern chart in the ZX plane when the transmission line antenna apparatus 1 of FIG. 43 operates as an attenuating nonreciprocal transmission line antenna apparatus at a frequency f=2.4 GHz. FIG. 50 is a radiation pattern chart in the ZX plane when the transmission line antenna apparatus 1 of FIG. 43 operates as a right-handed non-reciprocal transmission line antenna apparatus at a frequency f=3.3 GHz. FIG. 51 is a radiation pattern chart in the ZX plane when the transmission line antenna apparatus 1 of FIG. 43 operates as a left-handed non-reciprocal transmission line antenna apparatus at a frequency f=3.3 GHz.

In correspondence with the non-reciprocal characteristic of the transmission characteristic of the transmission line 2, the following two cases are considered by rough categorization regarding the non-reciprocal characteristic observed in the leaky wave radiation from the transmission line 2. First non-reciprocality causes a state in which leaky wave radiation is performed only for transmission in one direction and no radiation occurs in the backward direction in correspondence with the case where the transmission characteristic has transmission in the forward direction and attenuation in the backward direction (See FIGS. 48 and 49). With regard to the other non-reciprocality, the leaky wave can be radiated in an identical direction regardless of the transmission direction in correspondence with the case where the forward wave propagation is performed in the forward direction and backward wave propagation is performed in the backward direction (See FIGS. 50 and 51). As described above, the radiation direction of the leaky wave radiation beam is able to have selectivity with utilizing the non-reciprocality owned by the ferrite line.

Further, an example of the leaky wave antenna apparatus that employs the right-handed/left-handed non-reciprocal transmission line is shown in FIGS. 52 to 55.

Figure 52:
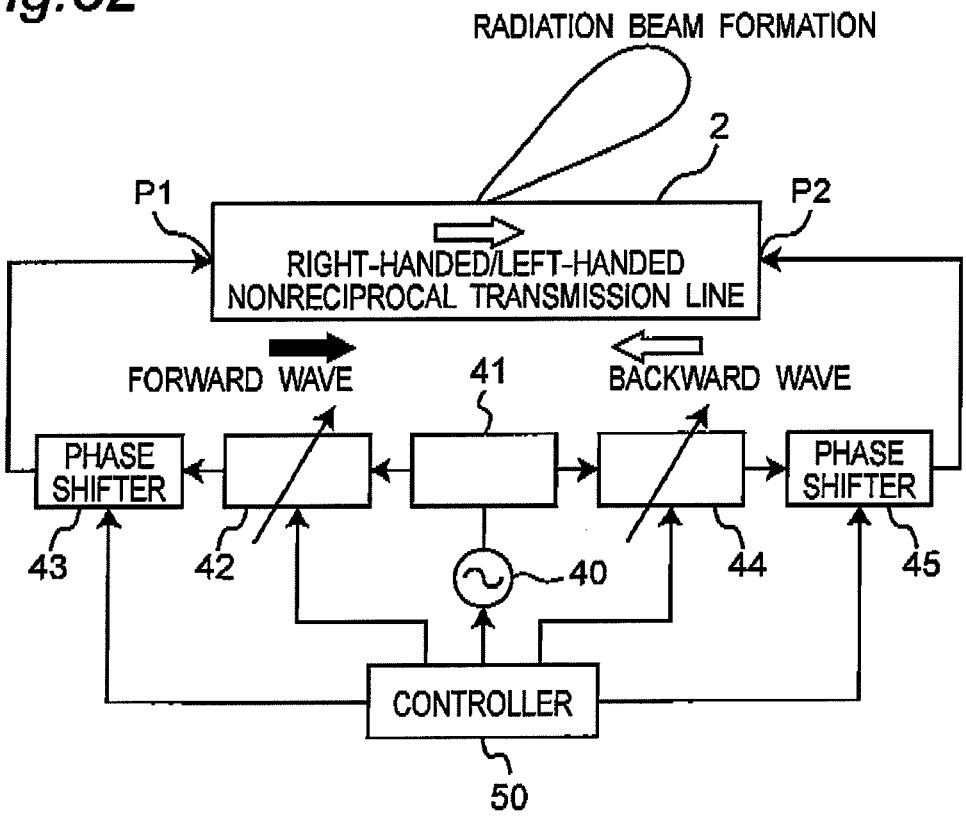
FIG. 52 is a side schematic view showing a configuration and an operation of a bidirectional input antenna apparatus that employs the transmission-line antenna apparatus 1 of FIG. 43.

FIG. 52 is a side schematic view showing a configuration and an operation of a bidirectional input antenna apparatus that employs the transmission line antenna apparatus 1 of FIG. 43. Referring to FIG. 52, a high-frequency signal from one high-frequency signal generator 40 is distributed into two ways by an electric power distributor 41 and made incident via both terminal ports P1 and P2 bi-directionally in the mutually opposite directions on one transmission line 2, radiating a leaky wave. That is, one high-frequency signal from the electric power distributor 41 is made incident on the transmission line 2 via a variable attenuator 42 and a phase shifter 43 and via the port P1, while the other high-frequency signal from the electric power distributor 41 is made incident on the transmission line 2 via a variable attenuator 44 and a phase shifter 45 and via the port P2. In this case, by changing the attenuations of the variable attenuators 42 and 44 and the phase shift amounts of the phase shifters 43 and 45, the radiation pattern (including the main beam direction and the radiation electric power in each direction) of the leaky wave radiated from the transmission line 2 can be changed. By setting through optimal selection of input electric power ratios incident on the input ports P1 and P2 and the initial phase relation, the electromagnetic field distribution on the transmission line 2 is optimized, and this leads to improvement in the radiation characteristics of the leaky wave antenna. That is, the main beam direction, the beam width and so on of the leaky wave from the transmission line 2 can be changed to the desired values.

Figure 53:
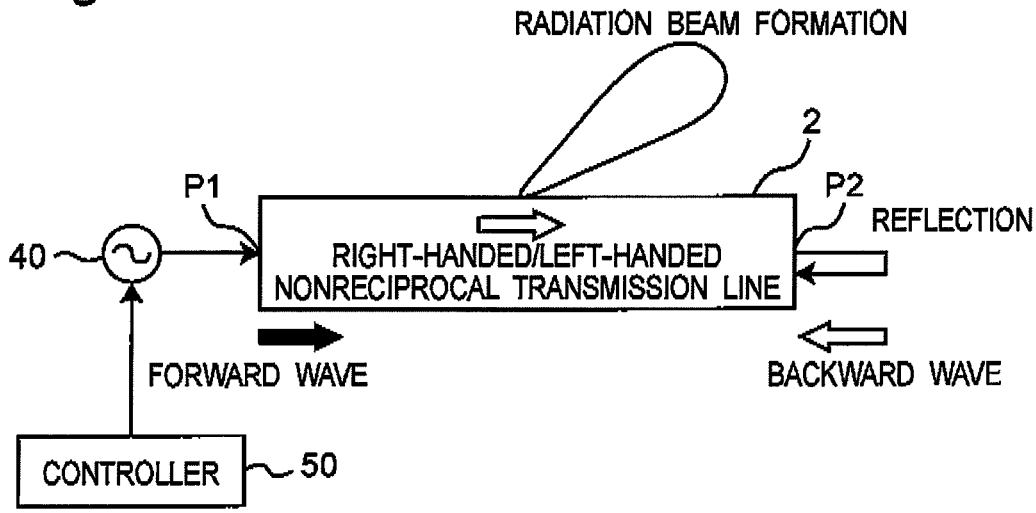
FIG. 53 is a side schematic view showing a configuration and an operation of a right-handed transmission line side input antenna apparatus that employs the transmission-line antenna apparatus 1 of FIG. 43.

FIG. 53 is a side schematic view showing a configuration and an operation of a right-handed transmission line side input antenna apparatus that employs the transmission line antenna apparatus 1 of FIG. 43. FIG. 53 shows a unidirectional input antenna apparatus that selects only one port P1 as an input port. In this case, it is not always necessary to insert a special matching circuit at the terminal end (port P2) of the transmission line 2. That is, no matching is made at the terminal end (port P2), and a leaky wave caused by the propagation of a reflected wave is also directed in an identical direction even if the reflected wave is generated. Therefore, a side lobe due to the reflected wave as observed in the leaky wave radiation from the conventional transmission line is not generated. The leaky wave radiation characteristic can be improved by rather optimally selecting the impedance at the terminal end (port P2) (e.g., selecting the electrical length of the transmission line 2 to a predetermined value) to optimize the electromagnetic field distribution on the transmission line 2 from the viewpoint of positively utilizing the reflection characteristic. That is, the main beam direction, beam width and so on of the leaky wave from the transmission line 2 can be changed to the desired values.

Figure 54:
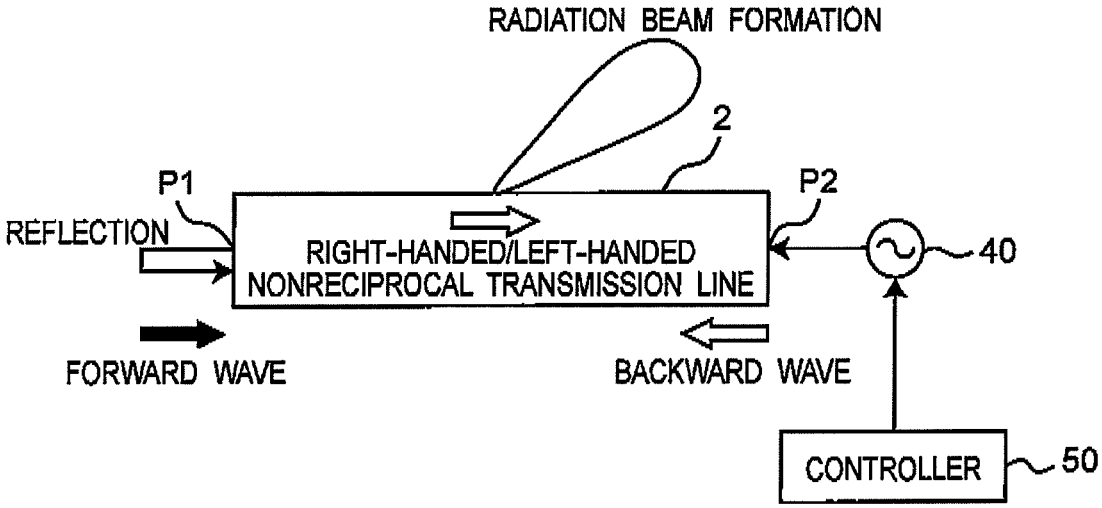
FIG. 54 is a side schematic view showing a configuration and an operation of a left-handed transmission line side input antenna apparatus that employs the transmission-line antenna apparatus 1 of FIG. 43.

FIG. 54 is a side schematic view showing a configuration and an operation of a left-handed transmission line side input antenna apparatus that employs the transmission line antenna apparatus 1 of FIG. 43. FIG. 54 shows a unidirectional input antenna apparatus that selects only one port P2 as an input port. In this case, it is not always necessary to insert a special matching circuit at the terminal end (port P1) of the transmission line 2. That is, no matching is made at the terminal end (port P1), and a leaky wave caused by the propagation of a reflected wave is also directed in an identical direction even if the reflected wave is generated. Therefore, a side lobe due to the reflected wave as observed in the leaky wave radiation from the conventional transmission line is not generated. The leaky wave radiation characteristic can be improved by rather optimally selecting the impedance at the terminal end (port P1) (e.g., selecting the electrical length of the transmission line 2 to a predetermined value) to optimize the electromagnetic field distribution on the transmission line 2 from the viewpoint of positively utilizing the reflection characteristic. That is, the main beam direction, beam width and so on of the leaky wave from the transmission line 2 can be changed to the desired values.

Figure 55:
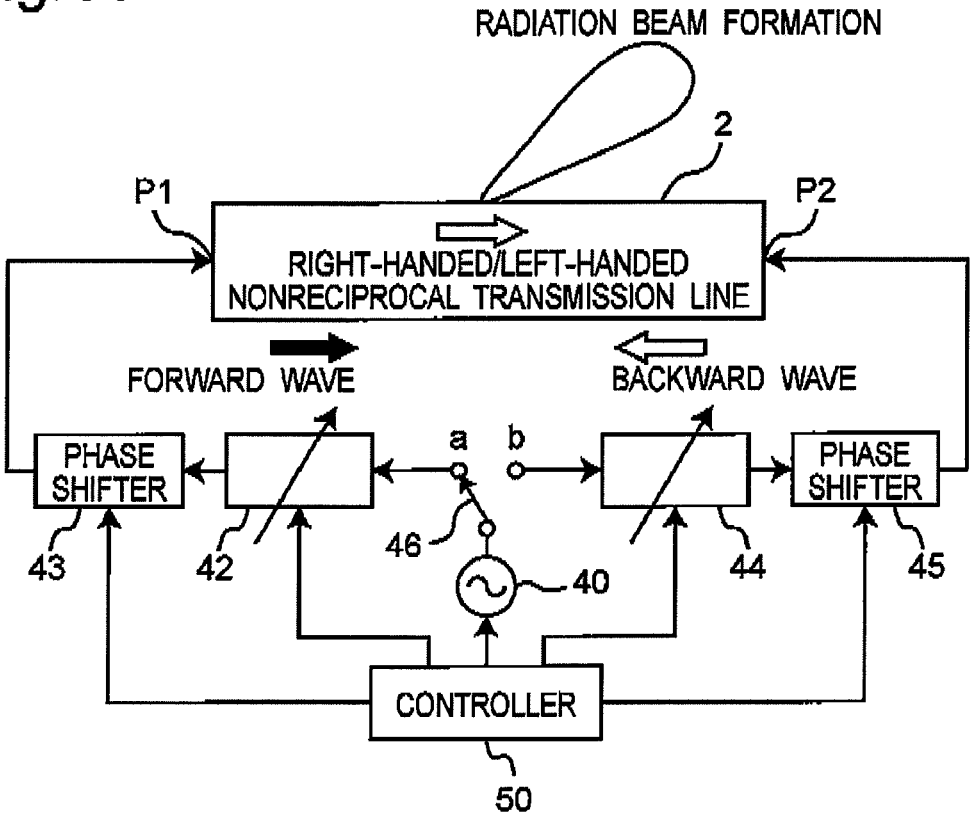
FIG. 55 is a side schematic view showing a configuration and an operation of an input direction switchover antenna apparatus that employs the transmission line antenna apparatus 1 of FIG. 43.

FIG. 55 is a side schematic view showing a configuration and an operation of an input direction switchover antenna apparatus that employs the transmission line antenna apparatus 1 of FIG. 43. FIG. 55 shows an antenna apparatus capable of performing switchover of the input direction by a switch 46. The antenna apparatus of FIG. 55 is characterized in that the switch 46 is inserted in place of the electric power distributor 41 in comparison with the antenna apparatus of FIG. 52. Referring to FIG. 55, when the magnitude of the propagation constant is same as observed at a frequency f=3.3 GHz in FIG. 45, the radiation direction is directed in the propagation direction as shown in FIGS. 50 and 51 regardless of the selection of the propagation direction, and therefore, a change in the radiation wave due to the switchover of the switch 46 occurs only in the polarization characteristic. For the above reasons, the switchover of the polarization characteristic can be performed by switching the operation with beam angle maintained. With regard to another utilization method of the antenna apparatus of FIG. 55, when a frequency at which the magnitude of the propagation constant is changed in the forward direction and the backward direction is selected as the operation frequency, or when, for example, a frequency of 3.2 GHz or 3.4 GHz in FIG. 45 is selected as the operating frequency, the radiation beam direction can be changed by selecting the propagation direction. Moreover, by changing the attenuations of the variable attenuators 42 and 44 and the phase shift amounts of the phase shifters 43 and 45, the radiation pattern (including the main beam direction and the radiation electric power in each direction) of the leaky wave radiated from the transmission line 2 can be changed.

Twentieth Preferred Embodiment

Figure 56:
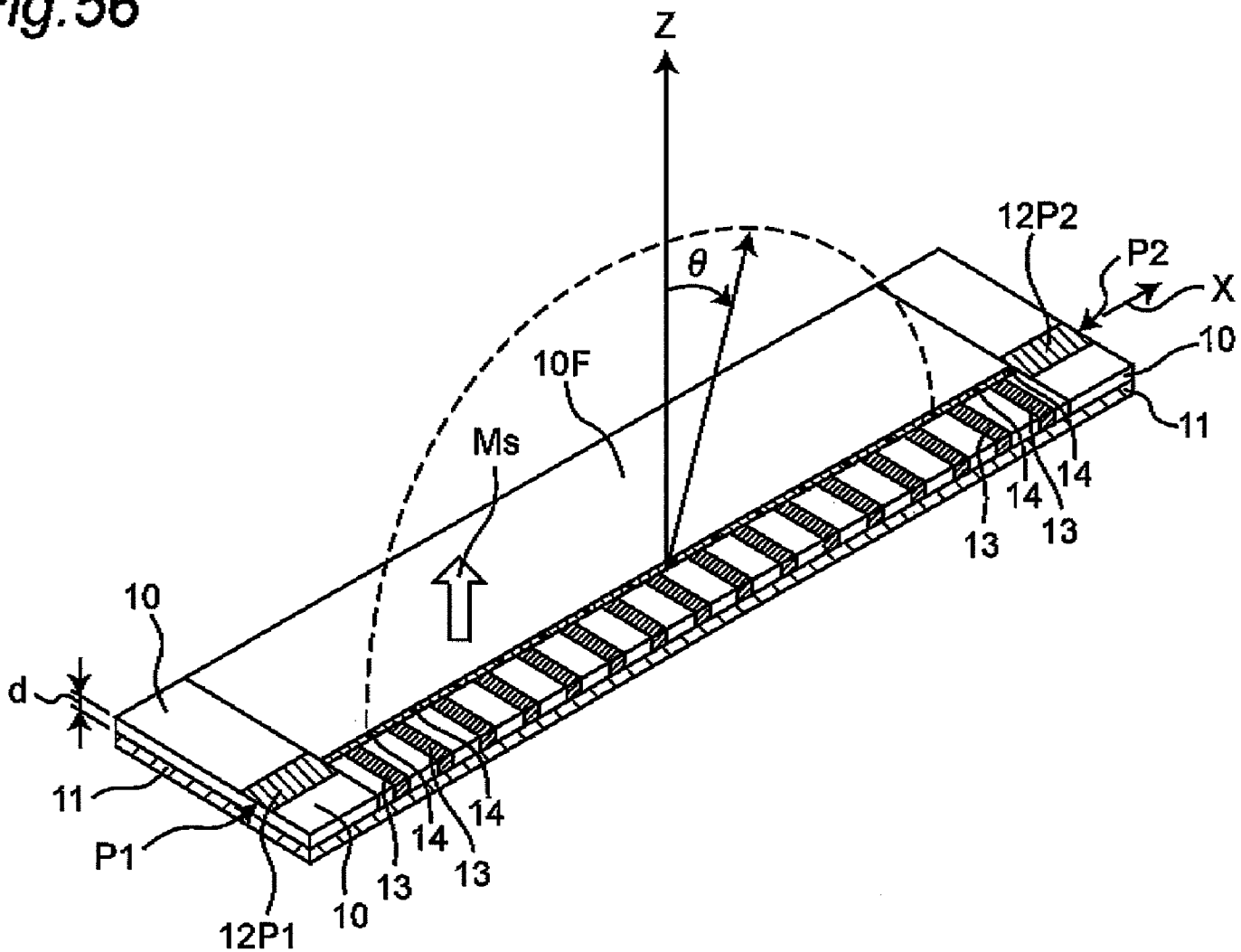
FIG. 56 is a perspective view showing the external appearance of a transmission-line antenna apparatus (prototype circuit) according to a twentieth preferred embodiment of the present invention.

FIG. 56 is a perspective view showing the external appearance of a transmission line antenna apparatus (prototype circuit) according to a twentieth preferred embodiment of the present invention. The configuration of the antenna apparatus is changed in the number of stub conductors 13 and so on although it is similar to the configuration of FIG. 18. Concrete structural parameters of the prototype circuit are as follows.

(1) A polycrystalline yttrium/iron/garnet substrate having dimensions of 51 mm×15 mm×1 mm was used as the ferrite substrate 10F.

(2) A substrate having a relative permittivity of 2.6 and dimensions of 51 mm×3 mm×1 mm was used as the dielectric substrate 10.

(3) A permanent magnet (not shown) having dimensions of 60 mm×20 mm×10 mm was placed under the ground conductor 11 so as to be magnetized in a direction perpendicular to the plane of the ferrite substrate 10F.

(4) The microstrip line of the input/output ports P1 and P2 had a 50-Ω line width of 0.5 mm, short-circuit stub conductors 13 of a line width of 1 mm at a period of 3 mm, and short-circuit stub conductors 13 of a line length of 3 mm and used a chip capacitor of a series capacitance of 0.4 pF (not shown). It is noted that sixteen unit cells were provided, and the external application magnetic field was set to 131 mT (measured value).

Figure 57:
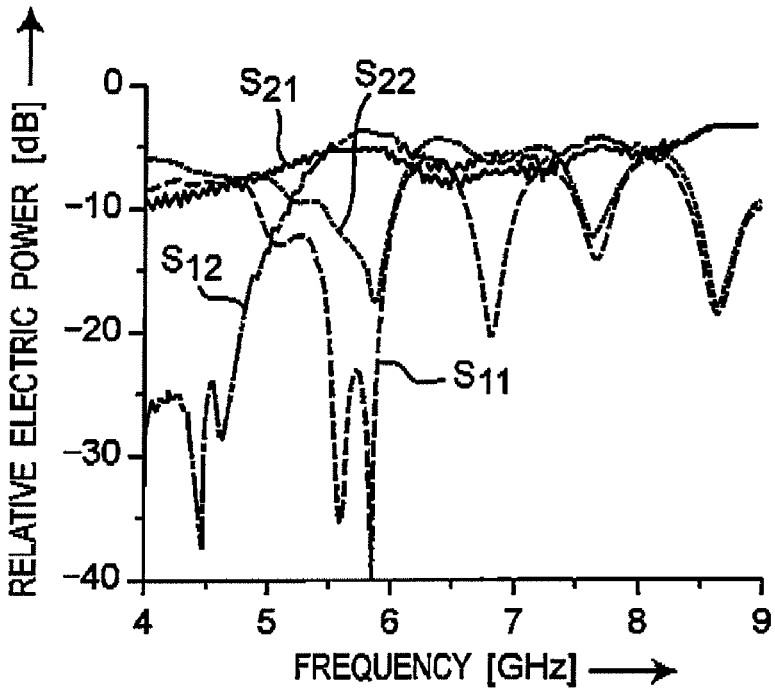
FIG. 57 is a graph of measurement results of the transmission-line antenna apparatus of FIG. 56, showing the transmission characteristics (frequency characteristics of relative power)
Figure 58:
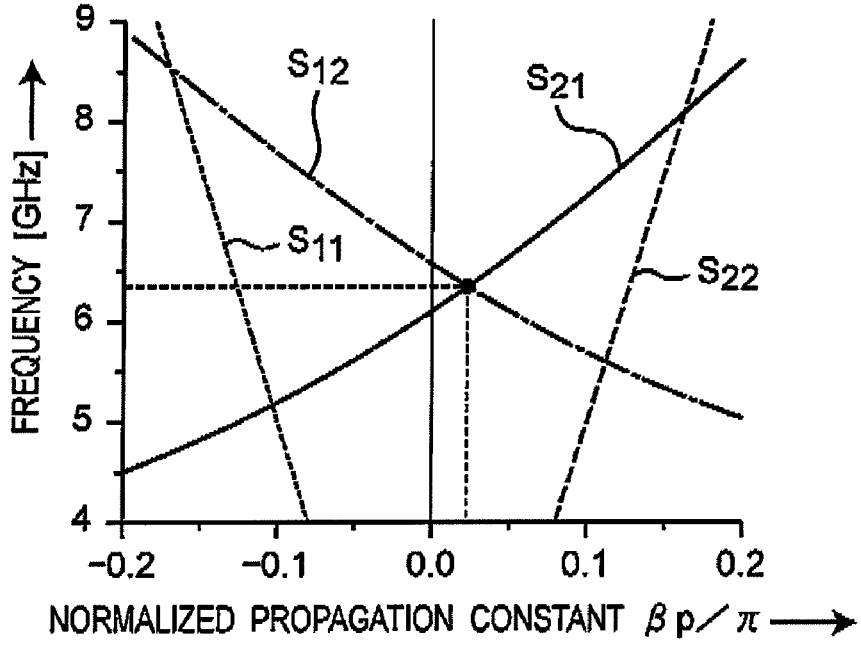
FIG. 58 is a graph of measurement results of the transmission line antenna apparatus of FIG. 56, showing the transmission characteristics (frequency characteristics to normalized propagation constant $\beta p/\pi$)

FIG. 57 is a graph of measurement results of the transmission line antenna apparatus of FIG. 56, showing the transmission characteristics (frequency characteristics of relative power). FIG. 58 is a graph of measurement results of the transmission line antenna apparatus of FIG. 56, showing the transmission characteristics (frequency characteristics to normalized propagation constant $\beta p/\pi$). That is, FIG. 57 shows a size of the scattering matrix, and FIG. 58 is a graph in which the phase characteristics of the parameters $S_{21}$ and $S_{12}$ are converted into dispersion curves. Referring to FIG. 58, it can be understood that the propagation constant is equal regardless of the electric power transmission direction at the point of a frequency of 6.35 GHz at which the two lines of $S_{12}$ and $S_{21}$ intersect each other.

Figure 59:
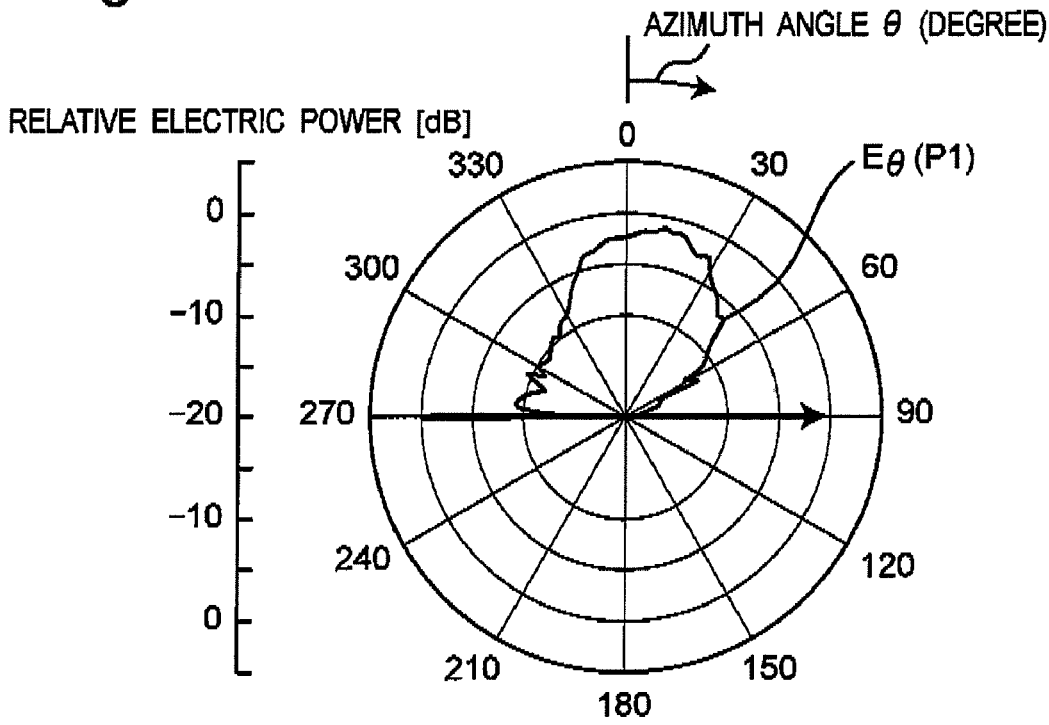
FIG. 59 is a chart of a measurement result of the transmission-line antenna apparatus of FIG. 56, showing a radiation pattern $E_\theta$(P1) in the XZ plane of a right-handed transmission line in the forward direction.
Figure 60:
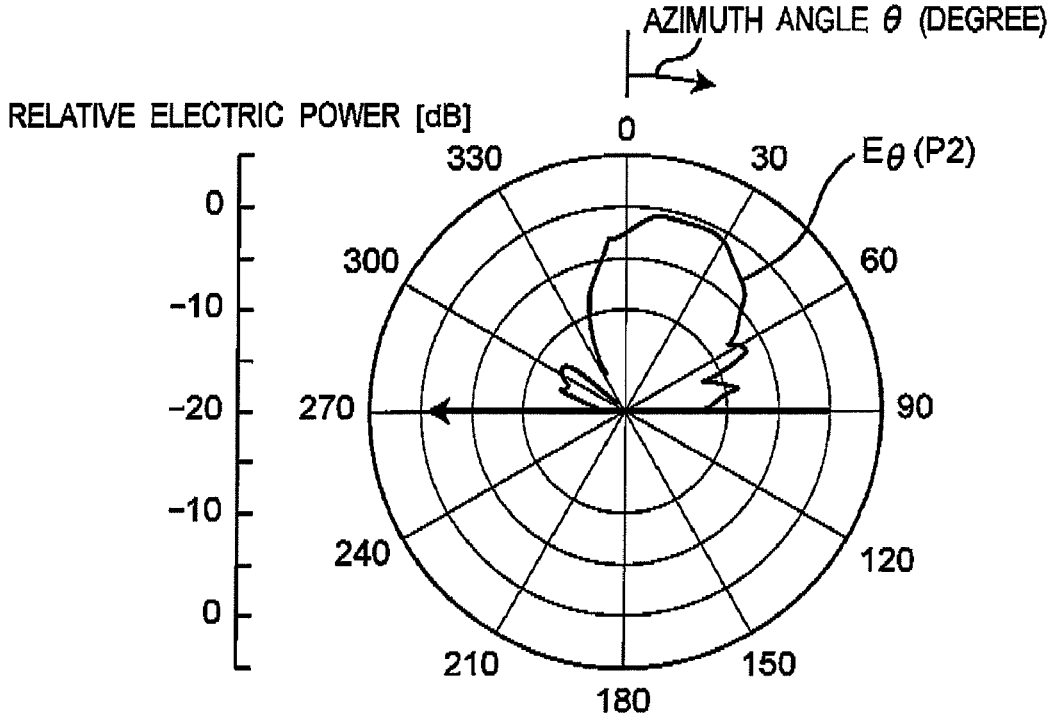
FIG. 60 is a chart of a measurement result of the transmission line antenna apparatus of FIG. 56, showing a radiation pattern $E_\theta$(P2) in the XZ plane of a left-handed transmission line in the backward direction.

FIG. 59 is a chart of a measurement result of the transmission line antenna apparatus of FIG. 56, showing a radiation pattern Eθ(P1) in the XZ plane of a forward direction right-handed transmission line. FIG. 60 is a chart of a measurement result of the transmission line antenna apparatus of FIG. 56, showing a radiation pattern Eθ(P2) in the XZ plane of a backward direction left-handed transmission line. If FIG. 59 is compared with FIG. 60, it can be confirmed that the direction of the radiation beam is directed almost in an identical direction despite that the electric power directions of propagation along the transmission line are opposite to each other.

Twenty-First Preferred Embodiment

Figure 61:
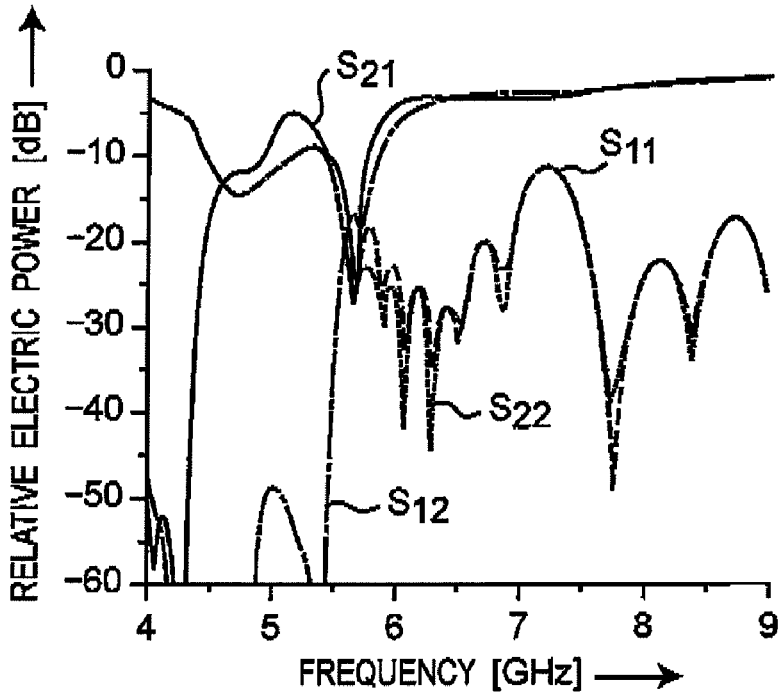
FIG. 61 is a graph of measurement results of the transmission-line antenna apparatus (designed circuit) according to a twenty-first preferred embodiment of the present invention, showing the transmission characteristics (amplitude characteristics when a shunt inductive element and a series capacitive element are inserted) of the nonreciprocal transmission line.
Figure 62:
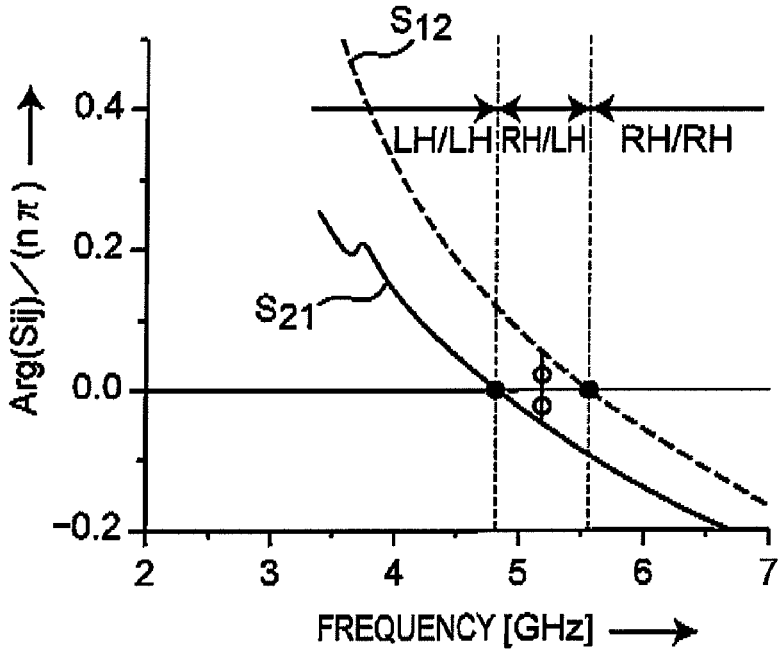
FIG. 62 is a graph of numerical calculation results of the transmission-line antenna apparatus (designed circuit) of the twenty-first preferred embodiment, showing the transmission characteristics (phase characteristics when a shunt inductive element and a series capacitive element are inserted) of the nonreciprocal transmission line.

FIG. 61 is a graph of measurement results of the transmission line antenna apparatus (designed circuit) according to a twenty-first preferred embodiment of the present invention, showing the transmission characteristics (amplitude characteristics when a parallel inductance element and a series capacitance element are inserted) of the non-reciprocal transmission line. FIG. 62 is a graph of numerical calculation results of the transmission line antenna apparatus (designed circuit) of the twenty-first preferred embodiment, showing the transmission characteristics (phase characteristics when a parallel inductance element and a series capacitance element are inserted) of the non-reciprocal transmission line. In the present preferred embodiment, another implemental example constituted similar to that of FIG. 56 is described below. In this case, structural parameters used for numerical calculations are described below.

(1) An yttrium/iron/garnet (YIG) substrate was assumed as the ferrite substrate 10F, saturation magnetization $\mu_0 Ms$=0.175T, magnetic loss ΔH=50 Oe, relative permittivity=15, and internal direct-current magnetic field $\mu_0 H_0$=0.05 T.

(2) Relative permittivity of the dielectric substrate 10 was set to 2.6. Thickness of the substrates 10F, 10 was both set to 1 mm Strip width was set to 2.4 mm so that the characteristic impedance of the microstrip line of the input/output ports P1 and P2 became almost 50Ω.

(3) The width of the microstrip line provided in the vicinity of the edge of the ferrite substrate 10F was set to 0.5 mm for similar reasons.

(4) A symmetric T type transmission line (period p=3 mm) corresponding to FIG. 3 is used as the unit cell, and an insertion capacitance C=0.6 pF (2C at both ends of the line part of the ferrite substrate 10F, See FIG. 3) is inserted. A strip conductor of a width of 1 mm and a length of 3.5 mm was used as the inductivity short-circuit stub conductor 13.

(5) The number of cells was set to 16.

As apparent from FIGS. 61 and 62, in the microstrip line 12A on the ferrite substrate 10F magnetized in the direction perpendicular to the substrate, the edge mode in which the electromagnetic field distribution is concentrated under the edge on one side of the strip becomes the dominant mode. Therefore, when the transmission line has an asymmetric structure, non-reciprocality appears depending on the transmission direction. The non-reciprocal characteristics of the transmission characteristics observed in the structure handled in the present preferred embodiment are roughly categorized into the following two. The first one is the case where transmission is performed in the forward direction ($S_{21}$) and attenuation is performed in the backward direction ($S_{12}$) as observed in the frequency band ranging from 4.2 GHz to 5.5 GHz in FIG. 61. In this case, the line can be used as an isolator. As the other non-reciprocal characteristic, a case where the phase characteristic has non-reciprocality although no difference is observed in the amplitude characteristic can be enumerated. In FIG. 62, the vertical axis is provided by standardizing the phases of the transmission coefficients 521 and 512 of the scattering matrix components as a phase change per unit cell, and this has a dimension identical to $\beta p/\pi$ standardized through multiplication of the propagation constant β by the period p. Therefore, FIG. 62 corresponds to a dispersion curve. Referring to FIG. 62, the gradients of two curves that represent the phase characteristics in the forward direction and the backward direction are both sloped rightward to the bottom. However, since the gradient of the dispersion curve corresponds to the direction of energy propagation (group velocity), FIG. 62 does not correspond to the direction of actual electric power transmission and represents the propagation constant when the electric powers propagated in the forward direction and the backward direction are both selected positive.

Figure 63:
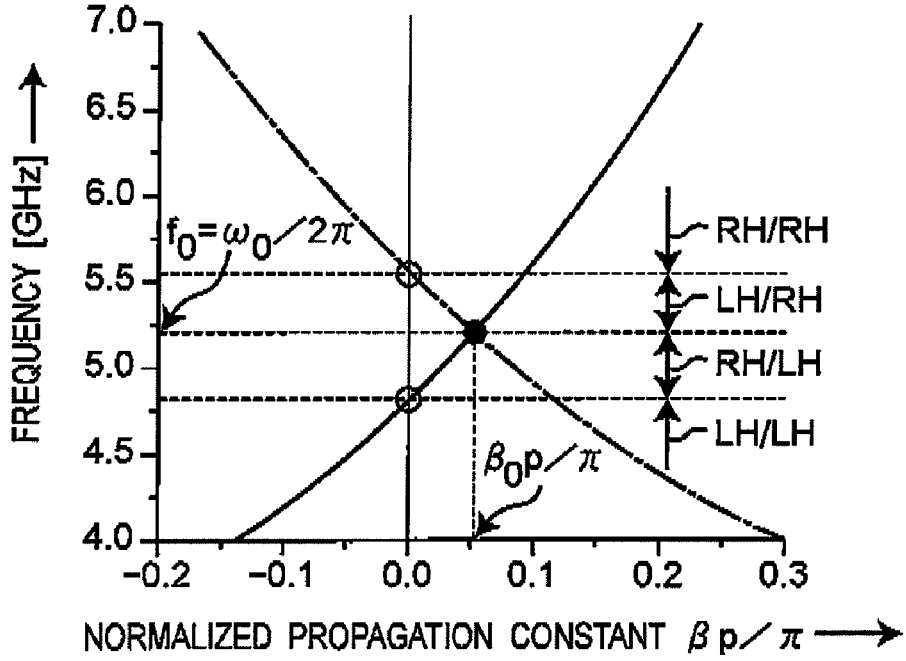
FIG. 63 is a graph of numerical calculation results of the transmission-line antenna apparatus (designed circuit) of the twenty-first preferred embodiment, showing a dispersion curve of the nonreciprocal transmission line.

FIG. 63 is a graph of numerical calculation results of the transmission line antenna apparatus (designed circuit) of the twenty-first preferred embodiment, showing a dispersion curve of the non-reciprocal transmission line. That is, FIG. 63 shows a conversion of FIG. 62 into a ω-β diagram in consideration of the direction of transmission electric power. Referring to FIG. 63, in the frequency domain of frequencies from 4.6 GHz to 5.6 GHz, the line operates as the right-handed (forward wave) transmission line in the forward direction and as the left-handed (backward wave) transmission line in the backward direction. As described above, the phase characteristic is largely varied depending on the way of taking the transmission direction, and therefore, the line can be used for transmission electric power direction selecting phase control. In particular, in the vicinity of the frequency of 5.2 GHz in FIG. 63, the magnitude of the propagation constant is same in the case of the forward direction input and in the case of the backward direction input (referring to the intersection indicated by the black dot in FIG. 63). The frequency corresponds to the angular frequency $\omega_0$ of FIG. 8. As described above, the fact that the dual mode having an equal wave number vector could be independently transmitted without causing coupling was demonstrated by numerical calculations using three-dimensional full-vector electromagnetic field simulation in the concrete configuration.

Further, the magnetic syntony of the non-reciprocal transmission line of the present preferred embodiment is described below.

As described above, the fact that the configuration of the non-reciprocal transmission line was practically possible was clarified by using the ferrite substrate magnetized perpendicularly. In fact, when the direct-current magnetic field in such a ferrite substrate is almost zero or very large and the magnetic resonance frequency is sufficiently larger than the relevant frequency band, the ferrite substrate behave similar to the dielectric substrate. That is, the non-reciprocal phase shift phenomenon as described above disappears. As a result, quite the same operation as that of the prior art right-handed/left-handed composite transmission line is performed.

Figure 64:
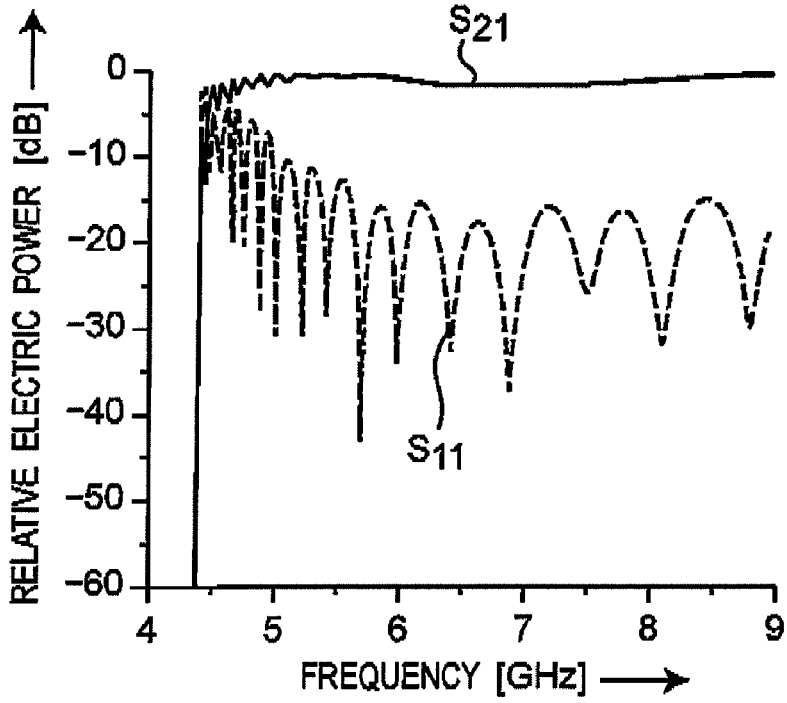
FIG. 64 is a graph of numerical calculation results of the transmission-line antenna apparatus (designed circuit) of the twenty-first preferred embodiment, showing the transmission characteristics (amplitude characteristics) of the reciprocal transmission line when the internal direct-current magnetic field is zero.
Figure 65:
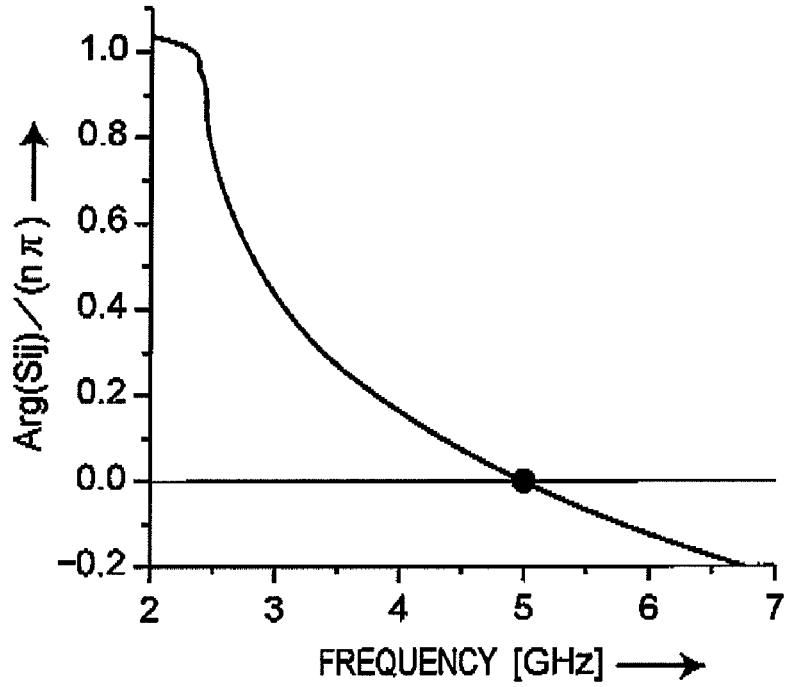
FIG. 65 is a graph of a numerical calculation result of the transmission-line antenna apparatus (designed circuit) of the twenty-first preferred embodiment, showing the transmission characteristic (phase characteristic) of the reciprocal transmission line when the internal direct-current magnetic field is zero.

FIG. 64 is a graph of numerical calculation results of the transmission line antenna apparatus (designed circuit) of the twenty-first preferred embodiment, showing the transmission characteristics (amplitude characteristics) of the reciprocal transmission line when the internal direct-current magnetic field is zero. FIG. 65 is a graph of a numerical calculation result of the transmission line antenna apparatus (designed circuit) of the twenty-first preferred embodiment, showing the transmission characteristic (phase characteristic) of the reciprocal transmission line when the internal direct-current magnetic field is zero. That is, the transmission characteristics when the structural parameters are the same as those of FIG. 62 and only the internal direct-current magnetic field is zero is shown in FIGS. 64 and 65. As apparent from FIGS. 64 and 65, it can be understood that no stop band appears between the right-handed and left-handed transmission bands, and impedance matching is almost kept. However, it can be understood that a frequency at which the propagation constant $\beta=\beta p=\beta_m=0$ between the right-handed and left-handed transmission bands is the frequency f=4.95 GHz as apparent from FIG. 65 and is lowered by several percent than at the frequency f=5.2 GHz at which the propagation constant $\beta p=\beta_m$ in FIG. 63. In order to compensate for this, a change in the internal direct-current magnetic field appears mainly in a change in the magnetic permeability tensor, i.e., a change in the effective magnetic permeability of the line. Therefore, it is also possible that the frequency at which the propagation constant $\beta p=\beta_m$ can be made constant by electrically changing the capacitive elements inserted in series. For the above reasons, it is possible to electrically change a physical quantity corresponding to the shift amount $\Delta\beta/2$ of the axis of symmetry of FIG. 8 by changing the internal direct-current magnetic field and the series capacitive elements.

Moreover, an application to the non-reciprocal phase shifter can be achieved as follows. By inserting a non-reciprocal transmission line between two terminals, the desired phase difference can be given from one terminal to the other terminal regardless of the signal propagation direction. Moreover, it is also possible to electrically change the phase difference by electrically changing the structural parameters.

By employing the transmission line microwave apparatus according to each of the preferred embodiments described above, the following various application apparatuses can be constituted:

(A) Non-Reciprocal Transmission Lines (1) The configuration of a non-reciprocal right-handed/left-handed transmission line in which the right-handed transmission (forward wave propagation) is performed in the forward direction and the left-handed transmission (backward wave propagation) is performed in the backward direction at an identical frequency. A case where the transmission characteristics in the forward direction and the backward direction are reversed is also included.

(2) The configuration of a non-reciprocal transmission line in which the right-handed transmission is performed in the forward direction, the effective wavelength in the backward direction is infinite, and no phase change occurs between input and output at an identical frequency. A case where the transmission characteristics in the forward direction and the backward direction are reversed is also included.

(3) The configuration of a non-reciprocal transmission line in which the left-handed transmission is performed in the forward direction, the effective wavelength in the backward direction is infinite, and no phase change occurs between input and output at an identical frequency. A case where the transmission characteristics in the forward direction and the backward direction are reversed is also included.

(4) The configuration of a non-reciprocal transmission line in which the right-handed transmission is performed in both the forward direction and the backward direction, whereas the phase change changes.

(5) The configuration of a non-reciprocal transmission line in which the left-handed transmission is performed in both the forward direction and the backward direction, whereas the phase change changes.

(6) A non-reciprocal transmission line that enables combining of at least two or more of (1) to (5).

(7) The configuration of a non-reciprocal right-handed/left-handed transmission line in which the wave number vectors in two modes of propagation in the forward direction and the backward direction are equal to each other at an identical frequency as a special case of (1). The configuration of a line in which two modes of equal operating frequency and wave number vector can be propagated degenerated (without coupling) although the directions of transmission electric power are opposed.

(8) Although the direction of transmission electric power is changed, applications to degeneration, decoupling and orthogonalization between different kinds of modes of equal operating frequency and wave number vector.

(B) Non-Reciprocal Phase Shifters (9) Application to a non-reciprocal phase shifter that employs any one of the non-reciprocal transmission lines (1) to (6).

(C) Non-Reciprocal Leaky Wave Antennas

(10) A non-reciprocal leaky wave antenna apparatus in which a leaky wave forms a forward radiation beam in response to a signal that propagates in the forward direction in, the line and forms a backward radiation beam in response to the backward propagation of the signal at an identical frequency.

(11) A non-reciprocal leaky wave antenna apparatus in which a leaky wave forms a forward radiation beam in response to a signal that propagates in the forward direction in the line and forms a broadside radiation beam in response to the backward propagation of the signal at an identical frequency.

(12) A non-reciprocal leaky wave antenna apparatus in which a leaky wave forms a backward radiation beam in response to a signal that propagates in the forward direction in the line and forms a broadside radiation beam in response to the backward propagation of the signal at an identical frequency.

(13) A non-reciprocal leaky wave antenna apparatus in which a radiation beam caused by a leaky wave from the line is directed in an identical direction at an identical frequency regardless of the propagation direction of the signal as a special case of (10).

(14) A non-reciprocal leaky wave antenna apparatus in which a leaky wave forms a forward radiation beam at an identical frequency regardless of the signal propagation direction in the line, whereas the angle of radiation changes.

(15) A non-reciprocal leaky wave antenna apparatus in which a leaky wave forms a backward radiation beam at an identical frequency regardless of the signal propagation direction in the line, whereas the angle of radiation changes.

(16) A non-reciprocal leaky wave antenna apparatus that enables combining of at least two or more of (10) to (15).

(17) Improvements in antenna gain and directivity and size reduction are made possible by using a non-reciprocal right-handed/left-handed transmission line as a line that constitutes a leaky wave antenna.

(D) Non-Reciprocal Transmission Line Type Resonators.

(18) The configuration of a non-reciprocal transmission line type resonator that employs the non-reciprocal transmission line of (1) to (6).

(19) When the non-reciprocal transmission line of (2) or (3) is employed, the configuration of a transmission line type resonator, which can operate with the signal amplitude on the transmission line almost constant and a phase gradient kept although the resonance frequency depends on the line length.

(20) When the non-reciprocal right-handed/left-handed transmission line of (7) that is a special case of (1) is employed, the configuration of a transmission line type resonator, which can operate with the signal amplitude on the transmission line almost constant and a phase gradient kept and in which the resonance frequency does not depend on the line length is possible. Since the resonance frequency does not depend on the line length, a free size selection is possible even in obtaining an identical resonance frequency. Moreover, since the unloaded Q of the resonator changes depending on the line length, a degree of freedom is given to the selection of the Q value.

(E) Filters Employing the Non-Reciprocal Transmission Line Type Resonator

(21) A band-stop filter configuration constituted of a resonator that employs the non-reciprocal transmission line of (1) to (6), an electric power feeding line and a coupling element.

(22) A band-pass filter configuration constituted of a resonator that employs the non-reciprocal transmission line of (1) to (6), an electric power feeding line and a coupling element.

(23) A band-stop filter and a band-pass filter constituted of (19) or (20) or both of the resonators. Since the amplitude is constant on the line that constitutes each resonator, there is a degree of freedom in the arrangement between the resonators.

(24) A band-stop filter and a band-pass filter constituted of the non-reciprocal transmission line type resonator of (20). Since the resonance frequency of each resonator that constitutes the filter does not depend on the line length, free size designing is possible. Moreover, since the unloaded Q of the resonator can be changed by the line length, a degree of freedom is given to the filter design.

(F) Antennas Employing a Non-Reciprocal Transmission Line Type Resonator

(25) An antenna having directivity constituted of the non-reciprocal transmission line type resonator of (19), an electric power feeding line and a coupling portion. The operating frequency of the antenna depends on the antenna size.

(26) An antenna having directivity constituted of the non-reciprocal transmission line type resonator of (20), an electric power feeding line and a coupling portion. The operating frequency of the antenna does not depend on the antenna size.

(G) Couplers Employing a Non-Reciprocal Transmission Line Type Resonator

(27) An electric power distributor that gives a phase gradient and is constituted of the non-reciprocal transmission line type resonator of (19) or (20).

(H) Oscillators employing a non-reciprocal transmission line type resonator

(28) The configuration of a parallel feedback oscillator that employs a non-reciprocal transmission line type resonator.

(29) The configuration of a series feedback oscillator that employs a non-reciprocal transmission line type resonator.

The invention claimed is:

1. A transmission line microwave apparatus including a microwave transmission line constituted by cascade-connecting at least one unit cell between first and second ports, wherein said unit cell includes a series branch circuit equivalently including a capacitive element, a shunt branch circuit equivalently including an inductive element, and at least one nonreciprocal transmission line part, wherein the nonreciprocal transmission line part is made of a material that is magnetized by one of spontaneous method and magnetization method by an external magnetic field so as to have gyrotropic characteristic by being magnetized in a magnetization direction different from a propagation direction of a microwave, and the nonreciprocal transmission line part has an asymmetric structure with respect to a plane formed by the propagation direction and the magnetization direction, and wherein each of said unit cells of the microwave transmission line has such a circuit configuration that the microwave transmission line has a predetermined propagation constant in a dispersion curve that represents a relation between an operating frequency of a microwave signal inputted to the microwave transmission line, and the propagation constant of the microwave transmission line so that a propagation constant in a forward direction and a propagation constant in a backward direction have mutually different nonreciprocal phase characteristics.

2. The transmission line microwave apparatus as claimed in claim 1, wherein each of said unit cells of the microwave transmission line has such a circuit configuration that the microwave transmission line has a predetermined propagation constant in the dispersion curve, so that a power of the microwave signal is transmitted by left-handed transmission in a direction from the first port toward the second port, and the power of the microwave signal is transmitted by right-handed transmission in a direction from the second port to the first port in the microwave transmission line at the operating frequency.

3. The transmission line microwave apparatus as claimed in claim 1, wherein each of said unit cells of the microwave transmission line has such a circuit configuration that the microwave transmission line has a predetermined propagation constant in the dispersion curve, so that a power of the microwave signal is transmitted by one of left-handed transmission and right-handed transmission in a direction from the first port toward the second port, and the power of the microwave signal is transmitted to have a zero propagation constant and an infinite guide wavelength in a direction from the second port to the first port in the microwave transmission line at the operating frequency.

4. The transmission line microwave apparatus as claimed in claim 2, wherein the transmission line microwave apparatus further comprises a circuit for performing one of making both the first port and the second port open, and making both the first port and the second port short-circuited, wherein each of said unit cells of the microwave transmission line has such a circuit configuration that the microwave transmission line has a predetermined propagation constant so that, when a propagation constant in a first mode of propagation of the microwave signal in the direction from the first port toward the second port is set to $\beta_+$ and a propagation constant in a second mode of propagation of the microwave signal in a direction from the second port toward the first port is set to $\beta_-$ in the microwave transmission line at the operating frequency, then $\beta_+=-\beta_-\neq 0$ is satisfied, whereby the transmission line microwave apparatus is a microwave resonator.

5. The transmission line microwave apparatus as claimed in claim 4, further comprising a power feeding transmission line provided to be coupled with the microwave resonator, thereby constituting a microwave antenna apparatus.

6. The transmission line microwave apparatus as claimed in 1, further a controller for controlling an electromagnetic field distribution of the microwave signal on the microwave transmission line, wherein, when a microwave signal propagates in a propagation direction from the first port to the second port in the microwave transmission line at the operating frequency, said controller controls the electromagnetic field distribution of the microwave signal on the microwave transmission line so as to radiate a microwave signal of a radiation pattern that has at least one beam of the following:

(a) a beam of a forward leaky wave having a direction inclined from the propagation direction, (b) a beam of a backward leaky wave having a direction inclined from a direction opposite to the propagation direction, and (c) a beam of a leaky wave having a direction substantially perpendicular to the propagation direction, wherein the transmission line microwave apparatus operates as a leaky wave antenna apparatus.

7. The transmission line microwave apparatus claimed in claim 6, wherein the controller controls at least one of an input electric power ratio of microwave signals inputted to the first port and the second port, and phases of each of the microwave signals.

8. The transmission line microwave apparatus as claimed in claim 1, further comprising a microwave resonator; and a power feeding transmission line provided to be coupled with the microwave resonator, thereby constituting a microwave antenna apparatus.

9. The transmission line microwave apparatus as claimed in claim 1, further comprising:

a circuit for performing one of making both the first port and the second port open, and making both the first port and the second port short-circuited;

a microwave resonator, wherein each of said unit cells of the microwave transmission line has such a circuit configuration that the microwave transmission line has a predetermined propagation constant so that, when a propagation constant in a first mode of propagation of the microwave signal in the direction from the first port toward the second port is set to $\beta_+$ and a propagation constant in a second mode of propagation of the microwave signal in a direction from the second port toward the first port is set to $\beta_-$ in the microwave transmission line at the operating frequency, then $\beta_+=-\beta_-\neq 0$ is satisfied; and a power feeding transmission line provided to be coupled with the microwave resonator, thereby constituting a microwave antenna apparatus.

10. A transmission line antenna apparatus comprising:

a substrate that is magnetized by one of spontaneously method and magnetization method by an external magnetic field and has a ground conductor on a back surface thereof;

a microstrip line formed on the substrate;

a plurality of capacitors that separate the microstrip line into a plurality of line parts and connect mutually adjacent line parts of the plurality of separated line parts;

a plurality of short-circuit stub conductors that connect the line parts to the ground conductor; and a controller for forming a main beam that uses a leaky wave leaked from a transmission line as a radiation wave, by inputting a microwave signal to at least one of one end and another end of the transmission line, making the transmission line operate as one of a forward wave transmission line and a backward wave transmission line at a predetermined operating frequency, and controlling at least one of an amplitude and a phase of the inputted microwave signal with utilizing nonreciprocal characteristic of the transmission line.

11. The transmission line antenna apparatus as claimed in claim 10, wherein the substrate further includes a dielectric substrate, wherein the magnetic substrate and the dielectric substrate are combined integrally together by their side surfaces at a boundary portion, and wherein the dielectric substrate further includes a ground conductor on the back surface thereof.

12. The transmission line antenna apparatus as claimed in claim 10, wherein the controller forms the main beam of the radiation wave by inputting the microwave signal to one end and another end of the transmission line and controlling at least one of the amplitude and the phase of the inputted microwave signal.

13. The transmission line antenna apparatus as claimed in claim 10, wherein the controller forms the main beam of the radiation wave by inputting the microwave signal to one end of the transmission line and controlling at least one of the amplitude and the phase of the inputted microwave signal, thereby reflecting a forward wave at another end of the transmission line.

14. The transmission line antenna apparatus as claimed in claim 10, wherein the controller forms the main beam of the radiation wave by inputting the microwave signal to another end of the transmission line and controlling at least one of the amplitude and the phase of the inputted microwave signal, thereby reflecting a backward wave at one end of the transmission line.

15. The transmission line antenna apparatus as claimed in claim 10, wherein the controller forms the main beam of the radiation wave by performing one of inputting the microwave signal to one end of the transmission line and inputting the microwave signal to another end of the transmission line, and controlling at least one of the amplitude and the phase of the inputted microwave signal.

* * * * *